US011523727B2

(12) United States Patent
Xiong et al.

(10) Patent No.: US 11,523,727 B2
(45) Date of Patent: Dec. 13, 2022

(54) SPRAY ARM ASSEMBLY AND WASHING APPLIANCE PROVIDED WITH SAME

(71) Applicants: FOSHAN SHUNDE MIDEA WASHING APPLIANCES MANUFACTURING CO., LTD., Foshan (CN); MIDEA GROUP CO., LTD., Foshan (CN)

(72) Inventors: Haoping Xiong, Foshan (CN); Liming Zhao, Foshan (CN); Wangchun Fei, Foshan (CN); Jingyi Zhang, Foshan (CN)

( * ) Notice: Subject to any disclaimer, the term of this patent is extended or adjusted under 35 U.S.C. 154(b) by 54 days.

(21) Appl. No.: 17/272,619

(22) PCT Filed: Jul. 1, 2019

(86) PCT No.: PCT/CN2019/094246
§ 371 (c)(1),
(2) Date: Mar. 1, 2021

(87) PCT Pub. No.: WO2020/042750
PCT Pub. Date: Mar. 5, 2020

(65) Prior Publication Data

US 2021/0228056 A1 Jul. 29, 2021

(30) Foreign Application Priority Data

Aug. 28, 2018 (CN) ..... 201810989072.1
Aug. 28, 2018 (CN) ..... 201810989075.5
(Continued)

(51) Int. Cl.
*A47L 15/23* (2006.01)
*B05B 3/02* (2006.01)
*B05B 3/06* (2006.01)

(52) U.S. Cl.
CPC ..... *A47L 15/23* (2013.01); *B05B 3/025* (2013.01); *B05B 3/06* (2013.01)

(58) Field of Classification Search
None
See application file for complete search history.

(56) References Cited

U.S. PATENT DOCUMENTS 3,866,837 A 2/1975 Jenkins
5,725,002 A 3/1998 Payzant
(Continued)

FOREIGN PATENT DOCUMENTS

CN 86203638 U 1/1987
CN 1269195 A 10/2000
(Continued)

OTHER PUBLICATIONS

OA for CN application 201910240001.6.
OA for EP application 19853826.6 dated May 9, 2022.

*Primary Examiner* — Levon J Shahinian
(74) *Attorney, Agent, or Firm* — Kilpatrick Townsend & Stockton, LLP

(57) ABSTRACT

A spray arm assembly and a washing appliance provided with same. The spray arm assembly comprises an upper spray arm and a lower spray arm, the upper spray arm being connected to the lower spray arm and being located above the lower spray arm; and further comprises a first ball assembly, and the first ball assembly is arranged at a position where the upper spray arm is connected to and cooperates with the lower spray arm; and the upper spray arm is rotatable relative to the lower spray arm. The hydrodynamic loss caused by using a connection method in a sliding friction manner in the prior art is reduced by means of the
(Continued)

first ball assembly, and the smoothness during rotation of the upper and lower spray arms can be improved, and the noise can also be reduced.

30 Claims, 16 Drawing Sheets

(30) Foreign Application Priority Data

| | | |
|---|---|---|
| Aug. 28, 2018 | (CN) | 201810991107.5 |
| Aug. 28, 2018 | (CN) | 201821397613.3 |
| Aug. 28, 2018 | (CN) | 201821410952.0 |
| Aug. 28, 2018 | (CN) | 201821410955.4 |

(56) References Cited

U.S. PATENT DOCUMENTS

| | | | |
|---|---|---|---|
| 6,371,138 | B1 | 4/2002 | Kamoto et al. |
| 2012/0037193 | A1 | 2/2012 | Bayer et al. |

FOREIGN PATENT DOCUMENTS

| | | | |
|---|---|---|---|
| CN | 105054882 | A | 11/2015 |
| CN | 105231970 | A | 1/2016 |
| CN | 105662306 | A | 6/2016 |
| CN | 105725947 | A | 7/2016 |
| CN | 208973738 | U | 6/2019 |
| CN | 208973744 | U | 6/2019 |
| CN | 208973763 | U | 6/2019 |
| CN | 209032217 | U | 6/2019 |

B

C

SPRAY ARM ASSEMBLY AND WASHING APPLIANCE PROVIDED WITH SAME

CROSS-REFERENCES TO RELATED APPLICATIONS

The present disclosure is a national phase application of International Application No. PCT/CN2019/094246, filed on Jul. 1, 2019, which claims priority to and benefits of Chinese Patent Application Serial No. 201810989075.5, 201821410952.0, 201810989072.1, 201821410955.4, 201810991107.5 and 201821397613.3, filed on Aug. 28, 2018, the entireties of which are herein incorporated by reference.

FIELD

The present application relates to the field of household appliance technologies, and more particularly to a spray arm assembly and a washing appliance provided with same.

BACKGROUND

At present, a spray arm of a washing appliance mostly rotates in one direction in a cleaning process. From the beginning of cleaning to the end of cleaning, cleaning trajectories are all consistent, so it is easy to produce a cleaning dead angle. Taking a dishwasher as an example, position designs of a bowl basket and a spray arm of the dishwasher are all well matched, and existing bowl baskets are mostly designed in accordance with standard tableware of the domestic market in China. When consumers actually use tableware in their own homes, if sizes, placement positions, and directions of the tableware are different from the standard size and placement of tableware, it is easy to result in that the dishwasher does not clean properly during operation, producing user pain points. In order to improve the cleaning capability, a satellite spray arm or water wall is adopted for some dishwashers. However, the structure of the satellite spray arm or water wall is complicated and costly, which is not conducive to popularization and application.

In addition, the spray arm and a spray arm base are mainly connected by engaging with a flange and a buckle, but such a connection manner may lead to a large gap between the spray arm and the spray arm base. When the dishwasher is operating, water in the spray arm is easy to leak through the gap, affecting the cleaning effect. Besides, when the spray arm moves relative to the spray arm base, the friction between the two is sliding friction, so the hydrodynamic loss is relatively large. On the other hand, the buckle connection directly leads to large dimensions of upper and lower heights of the spray arm base and the spray arm, which wastes a liner space of the washing appliance and reduces a placement space of to-be-cleaned items inside the washing appliance.

SUMMARY

The present application is intended to solve at least one of the above problems in the prior art to some extent. Therefore, the present application provides a spray arm assembly. The spray arm is simple in structure, and the cleaning effect is better when the spray arm is used to clean articles.

The present application further provides a washing appliance provided with the spray arm assembly.

The spray arm assembly according to an embodiment of the present application includes: an upper spray arm and a lower spray arm, the upper spray arm being connected to the lower spray arm and being located above the lower spray arm, and the upper spray arm being rotatable relative to the lower spray arm; and further includes a first ball assembly, and the first ball assembly is arranged at a position where the upper spray arm is connected to and cooperates with the lower spray arm.

In the spray arm assembly according to the embodiment of the present application, a lower spray arm and an upper spray arm are provided, and the number of spray arms is increased, which is conducive to enhancing the cleaning effect of the spray arms on to-be-cleaned items and shortening the cleaning time. At the same time, the upper spray arm and the lower spray arm are connected through the first ball assembly, which can effectively reduce a height dimension of the spray arm assembly, thus saving an inner space of the washing appliance, leaving more space for the placement of the to-be-cleaned items, and improving the capacity of the washing appliance.

According to some embodiments of the present application, the lower spray arm includes: a lower spray arm upper connecting sleeve, a lower spray arm body, and a lower spray arm lower connecting sleeve, the lower spray arm upper connecting sleeve is arranged on an upper side of the lower spray arm body, the lower spray arm lower connecting sleeve is arranged on a lower side of the lower spray arm body, the lower spray arm upper connecting sleeve, the lower spray arm body, and the lower spray arm lower connecting sleeve have a communicated lower chamber, and the first drive hole is in communication with the lower chamber.

Further, the upper spray arm includes: an upper spray arm body and an upper spray arm connecting sleeve, the upper spray arm connecting sleeve is arranged on a lower side of the upper spray arm body, the upper spray arm body and the upper spray arm connecting sleeve have a communicated upper chamber, the second drive hole is in communication with the upper chamber and the upper chamber is further in communication with the lower chamber, and the first ball assembly is arranged at a position where the upper spray arm connecting sleeve is connected to and cooperates with the lower spray arm upper connecting sleeve.

According to some embodiments of the present application, the first ball assembly includes at least a plurality of balls, and the plurality of balls are arranged between the lower spray arm upper connecting sleeve and the upper spray arm connecting sleeve.

Further, the first ball assembly further includes: a bearing base, and the balls are fitted between the lower spray arm upper connecting sleeve and the upper spray arm connecting sleeve through the bearing base.

In one embodiment, the bearing base includes: an inner sleeve configured to cooperate with one of the lower spray arm upper connecting sleeve and the upper spray arm connecting sleeve; a middle sleeve fitted over the inner sleeve, the middle sleeve being provided with a plurality of ball holes, the balls being mounted in the ball holes, and the balls protruding from inner and outer circumferential surfaces of the middle sleeve in a radial direction of the middle sleeve; and an outer sleeve fitted over the middle sleeve, the outer sleeve being configured to cooperate with the other one of the lower spray arm upper connecting sleeve and the upper spray arm connecting sleeve.

In one embodiment, the bearing base includes: an inner sleeve configured to cooperate with one of the lower spray arm upper connecting sleeve and the upper spray arm connecting sleeve; and an outer sleeve fitted over the inner sleeve, the outer sleeve being configured to cooperate with the other one of the lower spray arm upper connecting sleeve and the upper spray arm connecting sleeve.

According to some embodiments of the present application, the inner sleeve is integrated with one of the lower spray arm upper connecting sleeve and the upper spray arm connecting sleeve, so that the inner sleeve constitutes a part of the one; and/or the outer sleeve is integrated with the other one of the lower spray arm upper connecting sleeve and the upper spray arm connecting sleeve, so that the outer sleeve constitutes a part of the other one.

According to some embodiments of the present application, the upper spray arm connecting sleeve is fitted over an outer side of the lower spray arm upper connecting sleeve, the inner sleeve cooperates with the lower spray arm upper connecting sleeve, and the outer sleeve cooperates with the upper spray arm connecting sleeve or the outer sleeve is integrated with the upper spray arm connecting sleeve, so that the outer sleeve constitutes a part of the upper spray arm connecting sleeve.

In one embodiment, the lower spray arm upper connecting sleeve and the inner sleeve are detachably connected.

According to one embodiment of the present application, the top of the lower spray arm upper connecting sleeve is provided with a buckle, and the buckle is configured to clamp an upper surface of the inner sleeve.

Further, a top end of the lower spray arm upper connecting sleeve is provided with a plurality of grooves, an opening direction of the grooves is parallel to an axis direction of the lower spray arm upper connecting sleeve, the buckle extends upwards from a bottom wall of the grooves, two sides of the buckle are separated from two sidewalls of the grooves, and a top end of the buckle is provided with a hook toward the inner sleeve.

According to another embodiment of the present application, the lower spray arm upper connecting sleeve has lower spray arm external threads, the inner sleeve has inner sleeve internal threads, and the inner sleeve internal threads are configured to be screwed with and fixed to the lower spray arm external threads.

According to some embodiments of the present application, the spray arm assembly further includes a spray arm base, the lower spray arm includes a lower spray arm upper connecting sleeve, a lower spray arm body, and a lower spray arm lower connecting sleeve, and the spray arm base and the lower spray arm lower connecting sleeve are connected through a second buckle.

According to some embodiments of the present application, the upper spray arm is provided with a first drive hole for driving the upper spray arm to rotate around a first direction, the lower spray arm is provided with a second drive hole for driving the lower spray arm to rotate around a second direction, and the first direction is the same as or opposite to the second direction.

Further, an angle between a normal of the first drive hole and an axis of the lower spray arm upper connecting sleeve is 0°-90°, and an angle between a normal of the second drive hole and an axis of the upper spray arm connecting sleeve is 0°-90°.

According to some embodiments of the present application, a length of the upper spray arm body is 0.5 to 2 times that of the lower spray arm body.

According to some embodiments of the present application, the balls are arranged above the middle sleeve, and the ball holes are major-arc holes and ball fetching ports are formed at top notches.

In one embodiment, a weakening groove is arranged between two adjacent ball holes, and the weakening groove is provided with a weakening groove post.

According to some embodiments of the present application, the spray arm assembly further includes: a spray arm including: the lower spray arm and the upper spray arm; a spray arm base, and the spray arm is connected to the spray arm base, and the spray arm is rotatable relative to the spray arm base; and a second ball assembly arranged at a position where the spray arm is connected to and cooperates with the spray arm base.

In the spray arm assembly according to the embodiment of the present application, the lower spray arm and the upper spray arm are provided, and the number of spray arms is increased, which is conducive to enhancing the cleaning effect of the spray arms on tableware. In addition, the first ball assembly is arranged between the upper spray arm and the lower spray arm, to provide rolling contact between the upper spray arm and the lower spray arm, which can thus reduce the friction between the upper spray arm and the lower spray arm, is conducive to reducing the hydrodynamic loss, improving the utilization of the hydrodynamic power, and enhancing the cleaning effect of the washing appliance on to-be-cleaned items. At the same time, the upper spray arm and the lower spray arm are connected through the first ball assembly, which can effectively reduce a height dimension of the spray arm. In addition, a second ball assembly is arranged between the spray arm and the spray arm base, to provide rolling contact between the spray arm and the spray arm base, which can thus reduce the friction between the spray arm and the spray arm base, is conducive to further reducing the hydrodynamic loss, and enhancing the cleaning effect of the washing appliance on to-be-cleaned items, and at the same time, can effectively reduce a height dimension of the spray arm assembly, and saving an inner space of the washing appliance, leaving more space for the placement of the to-be-cleaned items, and improving the capacity of the washing appliance.

According to some embodiments of the present application, the lower spray arm includes: a lower spray arm upper connecting sleeve and a lower spray arm body, the lower spray arm upper connecting sleeve is arranged on an upper side of the lower spray arm body, the upper spray arm includes: an upper spray arm body and an upper spray arm connecting sleeve, the upper spray arm connecting sleeve is arranged on a lower side of the upper spray arm body, and the first ball assembly is arranged at a position where the upper spray arm connecting sleeve is connected to and cooperates with the lower spray arm upper connecting sleeve.

According to some embodiments of the present application, both the first ball assembly and the second ball assembly include at least a plurality of balls, the plurality of balls of the first ball assembly are arranged at the position where the upper spray arm connecting sleeve is connected to and cooperates with the lower spray arm upper connecting sleeve, and the plurality of balls of the second ball assembly are arranged at the position where the lower spray arm is connected to and cooperates with the spray arm base.

Further, both the first ball assembly and the second ball assembly further include: a middle sleeve, the middle sleeve is provided with a plurality of ball holes, the balls are mounted in the ball holes, and the balls protrude beyond inner and outer circumferential surfaces of the middle sleeve in a radial direction of the middle sleeve.

In one embodiment, both the first ball assembly and the second ball assembly further include:

an inner sleeve, the inner sleeve is arranged on inner sides of the balls, and an outer circumferential surface of the inner sleeve is provided with an inner sleeve ball groove configured to cooperate with the balls.

Further, both the first ball assembly and the second ball assembly further include: an outer sleeve, the outer sleeve is arranged on outer sides of the balls, and an inner circumferential surface of the outer sleeve is provided with an outer sleeve ball groove configured to cooperate with the balls.

According to some embodiments of the present application, both the first ball assembly and the second ball assembly further include: an outer sleeve, the outer sleeve is arranged on outer sides of the balls, and an inner circumferential surface of the outer sleeve is provided with an outer sleeve ball groove configured to cooperate with the balls.

According to some embodiments of the present application, the lower spray arm and the upper spray arm are detachably connected.

In one embodiment, the top of the lower spray arm upper connecting sleeve has a lower spray arm buckle, and the lower spray arm buckle is configured to clamp an upper surface of the inner sleeve of the first ball assembly.

In one embodiment, the inner sleeve of the first ball assembly has inner sleeve threads, the lower spray arm upper connecting sleeve has lower spray arm upper threads, and the lower spray arm upper threads are screwed with the inner sleeve threads.

According to some embodiments of the present application, the lower spray arm upper connecting sleeve is in interference fit with the inner sleeve of the first ball assembly.

According to some embodiments of the present application, the upper spray arm connecting sleeve is in interference fit with the outer sleeve of the first ball assembly; or the outer sleeve of the first ball assembly has outer sleeve threads, the upper spray arm connecting sleeve has upper spray arm threads, and the upper spray arm threads are screwed with the outer sleeve threads.

According to some embodiments of the present application, the lower spray arm and the spray arm base are detachably connected.

In one embodiment, the spray arm base includes: a spray arm base body, the top of the spray arm base body has a spray arm base buckle, and the spray arm base buckle is configured to clamp a top end of the inner sleeve of the second ball assembly.

In one embodiment, the inner sleeve of the second ball assembly has inner sleeve threads, the spray arm base has spray arm base threads, and the spray arm base threads are screwed with the inner sleeve threads.

According to some embodiments of the present application, the spray arm base is in interference fit with the inner sleeve of the second ball assembly.

According to some embodiments of the present application, the lower spray arm lower connecting sleeve is in interference fit with the outer sleeve of the second ball assembly; or the outer sleeve of the second ball assembly has outer sleeve threads, the lower spray arm lower connecting sleeve has lower spray arm lower threads, and the lower spray arm lower threads are screwed with the outer sleeve threads.

According to some embodiments of the present application, a length of the upper spray arm body is 0.5 to 2 times that of the lower spray arm body.

According to some embodiments of the present application, the spray arm assembly includes a first spray arm, a connector, and a spray arm base; the lower spray arm is the first spray arm, the first spray arm includes: a first spray arm body and a first spray arm water intake shaft, the first spray arm water intake shaft is arranged on one side of the first spray arm body toward the spray arm base, and the first spray arm is rotatable relative to the spray arm base; and the spray arm base is detachably connected to the first spray arm through the connector.

The connector includes: a connection support and a third ball assembly, the first spray arm water intake shaft is arranged through the connection support, and the third ball assembly is arranged at a position where the connection support is connected to and cooperates with the first spray arm water intake shaft.

In the spray arm assembly according to the embodiment of the present application, by arranging the connection support, the spray arm base and the first spray arm can be quickly disassembled and assembled to ensure convenient assembly or disassembly of the spray arm assembly and provide the first spray arm with support and a water channel. Moreover, by arranging the third ball assembly, the friction between the spray arm base and the first spray arm is small, which is conducive to saving the hydrodynamic power.

According to some embodiments of the present application, the connection support includes: a support body, a surface of the support body toward the first spray arm body is provided with a support connecting sleeve, and the third ball assembly is arranged between the support connecting sleeve and the first spray arm water intake shaft.

Further, the support connecting sleeve is fitted over an outer side of the first spray arm water intake shaft, the third ball assembly includes at least a plurality of third balls, and the plurality of third balls are arranged between the support connecting sleeve and the first spray arm water intake shaft.

Further, the third ball assembly further includes: a third middle sleeve, the third middle sleeve is provided with a plurality of third ball holes, the third balls are mounted in the third ball holes, and the third balls protrude beyond inner and outer circumferential surfaces of the third middle sleeve in a radial direction of the third middle sleeve.

Further, the third ball assembly further includes: a third inner sleeve, the third inner sleeve being arranged on inner sides of the third balls, and an inner circumferential surface of the third inner sleeve being configured to cooperate with the first spray arm water intake shaft, and an outer circumferential surface of the third inner sleeve being provided with a third inner sleeve ball groove configured to cooperate with the third balls; and/or a third outer sleeve arranged on outer sides of the third balls, an outer circumferential surface of the third outer sleeve being configured to cooperate with the support connecting sleeve, and an inner circumferential surface of the third outer sleeve being provided with a third outer sleeve ball groove configured to cooperate with the third balls.

In one embodiment, a plurality of ribbed plates are arranged between the support connecting sleeve and the support body.

Further, the connection support and the spray arm base are detachably connected.

In one embodiment, one side of the support body away from the first spray arm body is provided with a buckle, an outer circumferential surface of the spray arm base is provided with a projection, and the buckle is configured to engage with the projection.

Further, one side of the support body away from the first spray arm body is provided with a limiting buckle, and an outer circumferential surface of the spray arm base is provided with a slot configured to engage with the limiting buckle.

According to some embodiments of the present application, the upper spray arm is a second spray arm, the second spray arm is connected to the first spray arm and the second spray arm is rotatable relative to the first spray arm, the second spray arm is arranged on one side of the first spray arm away from the spray arm base, and the first ball assembly is arranged at a position where the first spray arm is connected to and cooperates with the second spray arm.

Further, the first spray arm further includes: a first spray arm connecting sleeve arranged on a surface of the first spray arm body toward the second spray arm; and the second spray arm includes: a second spray arm body and a second spray arm connecting sleeve, the second spray arm connecting sleeve being arranged on a surface of the second spray arm body toward the first spray arm body, and the first ball assembly being arranged between the first spray arm connecting sleeve and the second spray arm connecting sleeve.

According to some embodiments of the present application, the second spray arm connecting sleeve is fitted over an outer side of the first spray arm connecting sleeve, the first ball assembly includes at least a plurality of first balls, and the plurality of first balls are arranged between the first spray arm connecting sleeve and the second spray arm connecting sleeve.

Further, the first ball assembly further includes: a first middle sleeve, the first middle sleeve is provided with a plurality of first ball holes, the first balls are mounted in the first ball holes, and the first balls protrude beyond inner and outer circumferential surfaces of the first middle sleeve in a radial direction of the first middle sleeve.

In one embodiment, the first ball assembly further include: a first inner sleeve, the first inner sleeve being arranged on inner sides of the first balls, and an inner circumferential surface of the first inner sleeve being configured to cooperate with the first spray arm connecting sleeve, and an outer circumferential surface of the first inner sleeve being provided with a first inner sleeve ball groove configured to cooperate with the third balls; and/or a first outer sleeve arranged on outer sides of the first balls, an outer circumferential surface of the first outer sleeve being configured to cooperate with the second spray arm connecting sleeve, and an inner circumferential surface of the first outer sleeve being provided with a first outer sleeve ball groove configured to cooperate with the first balls.

According to some embodiments of the present application, an inner diameter of a water intake shaft of the spray arm base is equal to that of the first spray arm water intake shaft.

According to some embodiments of the present application, the connection support and the spray arm base are integrally formed.

A washing appliance according to an embodiment in another aspect of the present application includes the spray arm assembly described above.

Figure 1:
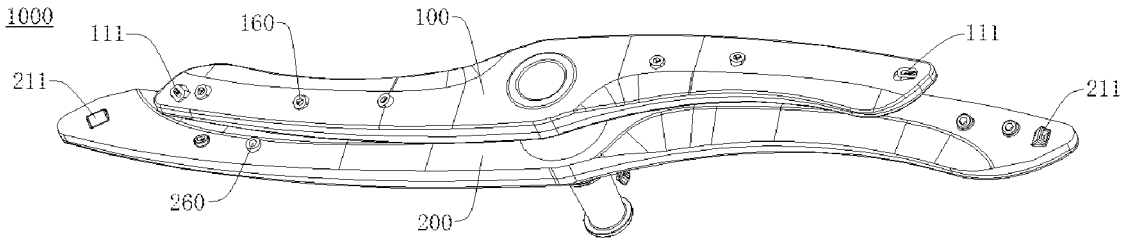
FIG. 1 is a schematic three-dimensional view of a spray arm assembly.

REFERENCE NUMERALS spray arm assembly 1000;

upper spray ram 100, second drive projection 110, second drive hole 111, upper spray arm body 120, upper spray arm connecting sleeve 130, upper spray arm ball groove 131, upper chamber 140, upper spray hole 160;

lower spray ram 200, first drive projection 210, first drive hole 211, lower spray arm upper connecting sleeve 220, buckle 223, lower spray arm body 230, lower spray arm lower connecting sleeve 240, lower chamber 250, lower spray hole 260, second buckle 270;

ball assembly 300, outer sleeve 310, outer sleeve ball groove 313, inner sleeve 320, inner sleeve ball groove 321, ball 330, ball hole 350, ball fetching port 351, weakening groove 360, weakening groove post 361, middle sleeve 370;

connecting sleeve circumferential wall 241, connecting sleeve bottom wall 242, lower spray arm ball groove 243, lower spray arm buckle 270, lower spray arm thread 280; first ball assembly 300, first outer sleeve 310, first outer sleeve ball groove 313, first inner sleeve 320, first inner sleeve ball groove 321, first ball 330, first ball hole 350, first ball fetching port 351, first weakening groove 360, first weakening groove post 361, first middle sleeve 370; second ball assembly 400, second outer sleeve 410, second outer sleeve circumferential wall 411, second outer sleeve bottom wall 412, second outer sleeve ball groove 413, second outer sleeve internal thread 414, second outer sleeve external thread 415, second inner sleeve 420, second inner sleeve ball groove 421, second inner sleeve external thread 422, second ball 430, second ball hole 450, second ball fetching port 451, second weakening groove 460, second weakening groove post 461, second middle sleeve 470; spray arm base 500, spray arm base body 510, spray arm base buckle 511, spray arm base flange 520, spray arm base internal thread 530, spray arm base water intake shaft 540, spray arm base ball groove 570, spray arm base chamber 580;

first spray arm 200*a*, first spray hole 260*a*, first spray arm body 230*a*, first spray arm water intake shaft 240*a*, first spray arm connecting sleeve 220*a*, second spray arm 100*a*, second spray hole 160*a*, second spray arm body 120*a*, second spray arm connecting sleeve 130*a*, spray arm base 500, projection 310*a*, slot 320*a*, water intake shaft 330*a*, connector 400*a*, connection support 410*a*, support body 411*a*, buckle 4111*a*, limiting buckle 4112*a*, support connecting sleeve 412*a*, ribbed plate 413*a*, third ball assembly 420*a*, third middle sleeve 421*a*, third ball hole 4211*a*, third ball fetching port 4212*a*, third weakening groove 4213*a*, third weakening groove post 4214*a*, third inner sleeve 422*a*, third inner sleeve ball groove 4221*a*, third ball 423*a*, third outer sleeve 424*a*, third outer sleeve ball groove 4241*a*, third outer sleeve circumferential wall 4242*a*, third outer sleeve top wall 4243*a*, first outer sleeve circumferential wall 542, first outer sleeve top wall 543.

DETAILED DESCRIPTION OF THE DISCLOSURE

Reference will be made in detail to embodiments of the present application, and the examples of the embodiments are illustrated in the drawings, and the same or similar elements and the elements having same or similar functions are denoted by like reference numerals throughout the descriptions. The embodiments described herein with reference to drawings are illustrative, and intended to explain the present application. The embodiments shall not be construed to limit the present application.

In the description of the present application, it is to be understood that terms such as "length", "width", "upper", "lower", "clockwise", "anticlockwise", "left", "right", "top", "bottom", "inner", and "outer" should be construed to refer to the orientation as then described or as shown in the drawings under discussion. These relative terms are for convenience of description and do not require that the present application be constructed or operated in a particular orientation, thus cannot be construed to limit the present application.

In the present application, unless specified or limited otherwise, the terms "mounted", "connected", "coupled", "fixed" and the like are used broadly, and may be, for example, fixed connections, detachable connections, or integral connections; may also be direct connections or indirect connections via intervening structures; may also be inner communications of two elements or interactions between two elements.

A spray arm assembly 1000 according to an embodiment of the present application is described below in detail with reference to FIG. 1 to FIG. 38. The spray arm assembly 1000 may be used in washing appliances. In the following, the spray arm assembly 1000 is applied to a dishwasher as an example to illustrate the structure of the spray arm assembly 1000.

The spray arm assembly 1000 according to the embodiment of the present application is described below in detail with reference to FIG. 1 to FIG. 15.

Referring to FIG. 1 to FIG. 4 and FIG. 7, the spray arm assembly 1000 according to the embodiment of the present application may include: a lower spray arm 200, an upper spray arm 100, and a first ball assembly 300.

The upper spray arm 100 is connected to the lower spray arm 200, and the upper spray arm 100 is located above the lower spray arm 200. The upper spray arm 100 is rotatable relative to the lower spray arm 200. The upper spray arm 100 is provided with an upper spray hole 160 for spraying water into the dishwasher. The lower spray arm 200 is provided with a lower spray hole 260 for spraying water into the dishwasher. When the water sprayed from the upper spray hole 160 and the lower spray hole 260 falls on tableware, the tableware can be cleaned. By arranging the upper spray arm 100 above the lower spray arm 200, the number of spray arms is increased, to increase a spray volume of the spray arm assembly 1000, which is conducive to enhancing the cleaning effect of the spray arm assembly 1000 on the tableware.

The lower spray arm 200 is provided with a first drive hole 211 for driving the lower spray arm 200 to rotate around a first direction. When a water column inside the spray arm assembly 1000 is sprayed from the first drive hole 211, the lower spray arm 200 may be subjected to reaction force (i.e. reverse driving force) of the water column sprayed from the first drive hole 211. In this case, the lower spray arm 200 may rotate around the first direction under the reaction force. The first direction is opposite to an opening direction of the first drive hole 211. The lower spray arm 200 may rotate continuously as the water column is continuously sprayed from the first drive hole 211. The water column sprayed from the first drive hole 211 may sprinkle around with the rotation of the lower spray arm 200, a water flow sprayed from the lower spray hole 260 of the lower spray arm 200 may also enter an operation region of the dishwasher, and then the two cooperate to clean the tableware in the dishwasher or stains on inner walls of the dishwasher.

The upper spray arm 100 is provided with a second drive hole 111 for driving the upper spray arm 100 to rotate around a second direction. When a water column is sprayed from the second drive hole 111, the upper spray arm 100 may be subjected to reaction force of the water column sprayed from the second drive hole 111. In this case, the upper spray arm 100 may rotate around the second direction under the reaction force. The second direction is opposite to an opening direction of the second drive hole 111. The upper spray arm 100 may rotate continuously as the water column is constantly sprayed from the second drive hole 111, and when the upper spray arm 100 rotates, the water column sprayed from the second drive hole 111 is sprinkled around, a water flow sprayed from the upper spray hole 160 of the upper spray arm 100 may also enter an operation region of the dishwasher, and then the upper spray arm 100 and the lower spray arm 200 jointly cooperate to clean the tableware in the dishwasher or stains on inner walls of the dishwasher.

It needs to be noted that in some embodiments, the first direction in which the lower spray arm 200 rotates is opposite to the second direction in which the upper spray arm 100 rotates. When water columns are simultaneously sprayed from the first drive hole 211 of the lower spray arm 200 and the second drive hole 111 of the upper spray arm 100, the lower spray arm 200 and the upper spray arm 100 rotate simultaneously, and rotation directions of the two are opposite (referring to FIG. 1 to FIG. 3, the lower spray arm 200 rotates counterclockwise, and the upper spray arm 100 rotates clockwise; in some unillustrated embodiments, the lower spray arm 200 may also rotate clockwise and the upper spray arm 100 may rotate counterclockwise). In this case, the water columns sprayed from the first drive hole 211 of the lower spray arm 200 and the second drive hole 111 of the upper spray arm 100 are sprayed in opposite directions. When the water columns sprayed from the first drive hole 211 and the second drive hole 111 simultaneously fall on the tableware or the inner walls of the dishwasher, due to the inconsistency of cleaning directions after the sprayed water columns are applied to the tableware or the inner walls of the dishwasher, the water columns sprayed from the first drive hole 211 and the second drive hole 111 produce rubbing force on the tableware or the inner walls of the dishwasher, and enhancing the cleaning effect of the spray arm assembly 1000, which can ensure the tableware or the inner walls of the dishwasher to be clean. In addition, rotation of the upper spray arm 100 and the lower spray arm 200 in opposite directions may also make the water sprayed from the upper spray hole 160 of the upper spray arm 100 and the water sprayed from the lower spray hole 260 of the lower spray arm 200 product rubbing force on the tableware, to further enhance the cleaning effect of the spray arm assembly 1000.

In some other embodiments, the first direction in which the lower spray arm 200 rotates may be the same as the second direction in which the upper spray arm 100 rotates. Rotation of the lower spray arm 200 and the upper spray arm 100 in the same direction may increase a spray volume of the spray arm assembly 1000, which is also conducive to enhancing the cleaning effect of the spray arm assembly 1000. By changing apertures of the first drive hole 211 and the second drive hole 111, the driving force of the first drive hole 211 on the lower spray arm 200 and the driving force of the second drive hole 111 on the upper spray arm 100 may be changed, to change rotation speeds of the lower spray arm 200 and the upper spray arm 100, so that the lower spray arm 200 and the upper spray arm 100 can rotate at the same speed and in the same direction or at different speeds and in the same direction.

Directions and positions of water columns sprayed by the lower spray arm 200 and the upper spray arm 100 onto the tableware are multi-directional, which reduces the dead angle and makes cleaning easier. Due to a large coverage rate of the water flow, the cleaning time may be reduced correspondingly, which is conducive to shortening the cleaning time.

It needs to be understood that the terms such as "first" and "second" are used herein for purposes of description and are not intended to indicate or imply relative importance or significance or to imply the number of indicated features. Thus, the feature defined with "first" and "second" may explicitly or implicitly include one or more of this feature.

As shown in FIG. 6 to FIG. 7, FIG. 11, and FIG. 12, the first ball assembly 300 is arranged at a position where the upper spray arm 100 is connected to and cooperates with the lower spray arm 200, and the upper spray arm 100 and the lower spray arm 200 are indirectly connected through the first ball assembly 300. The structure in which the upper spray arm 100, the first ball assembly 300, and the lower spray arm 200 are connected is simple and stable.

By arranging the first ball assembly 300, when the upper spray arm 100 rotates relative to the lower spray arm 200, the friction between the upper spray arm 100 and the lower spray arm 200 is in a form of rolling friction, instead of sliding friction. This ensures less friction force when the upper spray arm 100 rotates relative to the lower spray arm 200, that is, the rolling friction force has little resistance to the rotation of the upper spray arm 100. Therefore, the hydrodynamic loss caused by the friction can be reduced and the utilization of the hydrodynamic power can be improved. At the same time, the rotation of the upper spray arm 100 relative to the lower spray arm 200 is faster, so the arrangement of the first ball assembly 300 is conducive to improving the smoothness during rotation of the upper spray arm 100, thus helping to reduce the noise of the dishwasher.

In addition, the first ball assembly 300 is arranged between the upper spray arm 100 and the lower spray arm 200 to connect the upper spray arm 100 and the lower spray arm 200 integrally, which, compared with the original form that the upper spray arm 100 and the lower spray arm 200 are separately connected through a buckle 223, can effectively reduce the height at a position where the upper spray arm 100 is connected to the lower spray arm 200, and reducing a height dimension of the spray arm assembly 1000, saving an inner space of the dishwasher, leaving more space for placement of the tableware, and then increasing the tableware capacity of the dishwasher. In one embodiment, the internal loading capacity of the dishwasher can be increased by 10 mm to 40 mm.

In the spray arm assembly 1000 according to the embodiment of the present application, the lower spray arm 200 and the upper spray arm 100 are provided, and the number of spray arms is increased, which is conducive to enhancing the cleaning effect of the spray arm assembly 1000 on the tableware. Moreover, the lower spray arm 200 is provided with the first drive hole 211, and the upper spray arm 100 is provided with the second drive hole 111, which can ensure that the upper spray arm 100 rotates in an opposite direction or in the same direction relative to the lower spray arm 200. When the upper spray arm 100 rotates in an opposite direction relative to the lower spray arm 200, the water columns sprayed from the lower spray arm 200 and the upper spray arm 100 can produce rubbing force on the tableware, and enhancing the cleaning effect of the spray arm assembly 1000, which can ensure the tableware to be clean. When the upper spray arm 100 rotates in the same direction relative to the lower spray arm 200, a spray volume of the spray arm assembly 1000 can be increased, which is also conducive to enhancing the cleaning effect of the spray arm assembly 1000. In addition, by arranging the first ball assembly 300 between the upper spray arm 100 and the lower spray arm 200, rolling contact exists between the upper spray arm 100 and the lower spray arm 200, which can thus reduce the friction force between the upper spray arm 100 and the lower spray arm 200, is conducive to reducing the hydrodynamic loss, improving the utilization of the hydrodynamic power, ensuring higher pressure when the water is sprayed from the upper spray hole 160 and the lower spray hole 260, and is conducive to enhancing the cleaning effect of the dishwasher on the tableware. At the same time, the upper spray arm 100 and the lower spray arm 200 are connected through the first ball assembly 300, which can effectively reduce a height dimension of the spray arm assembly 1000, thus saving an inner space of the dishwasher, leaving more space for the placement of the tableware, and improving the tableware capacity of the dishwasher.

Figure 7:
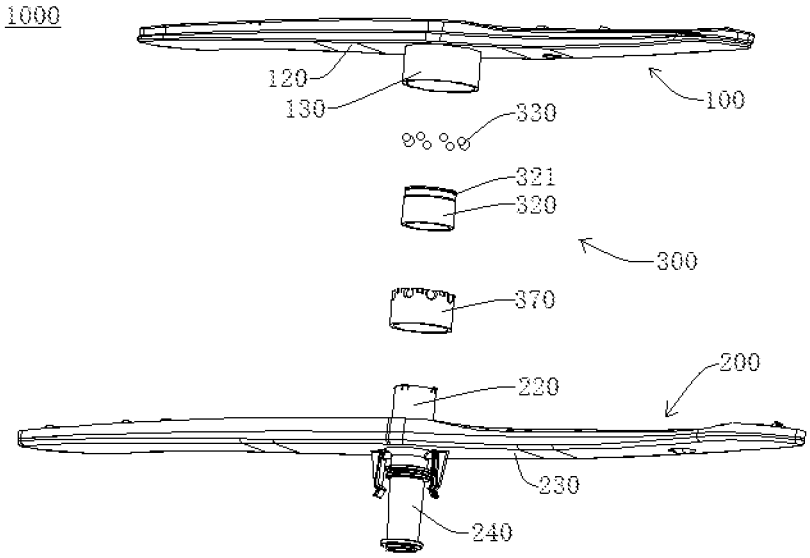
FIG. 7 is a schematic exploded view of the spray arm assembly.

Referring to FIG. 7, the lower spray arm 200 may include: a lower spray arm upper connecting sleeve 220, a lower spray arm body 230, and a lower spray arm lower connecting sleeve 240. The lower spray arm upper connecting sleeve 220 is arranged on an inner side of the lower spray arm body 230. The arrangement of the lower spray arm upper connecting sleeve 220 facilitates the connection between the upper spray arm 100 and the lower spray arm 200, and ensures that the upper spray arm 100 and the lower spray arm 200 can be reliably integrally connected.

The spray arm assembly 1000 may further include a spray arm base. The lower spray arm lower connecting sleeve 240 is arranged on a lower side of the lower spray arm body 230. The arrangement of the lower spray arm lower connecting sleeve 240 facilitates the fixing of the lower spray arm 200 to the spray arm base. The spray arm base and the lower spray arm lower connecting sleeve 240 are connected through a second buckle 270 shown in FIG. 6. The lower spray arm lower connecting sleeve 240 also serves as a water intake pipe of the spray arm assembly 1000, and ensuring that washing water can enter the spray arm assembly 1000 through the lower spray arm lower connecting sleeve 240. A plurality of second buckles 270 may be provided, which is thus conducive to enhancing the firmness of the connection between the spray arm base and the lower spray arm 200 as well as the smoothness of rotation of the lower spray arm 200 relative to the spray arm base.

Figure 6:
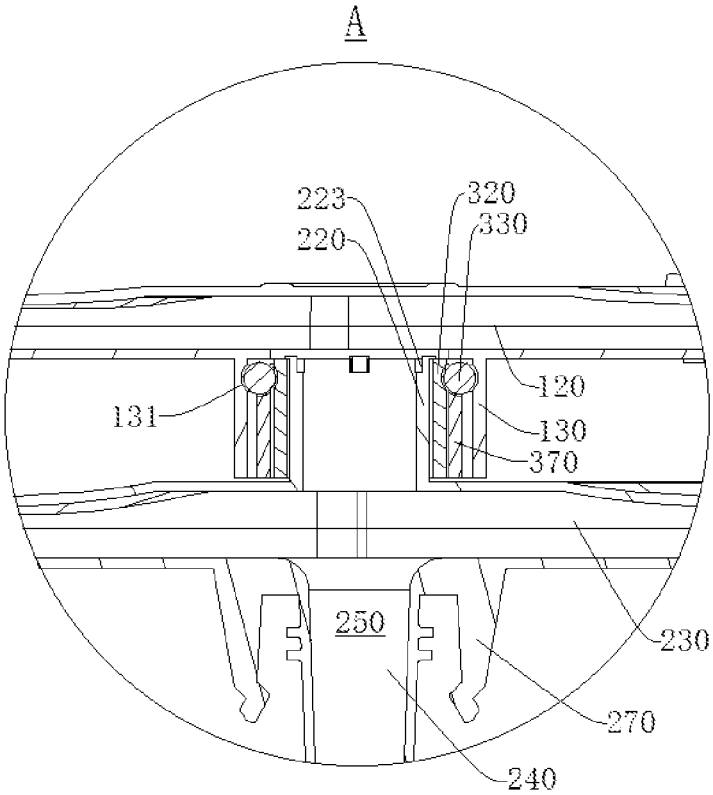
FIG. 6 is a partial enlarged view of A in FIG. 5.
Figure 11:
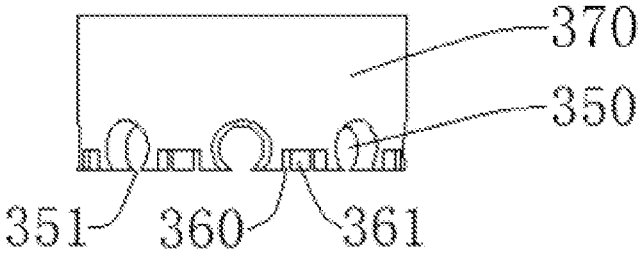
FIG. 11 is a front view of a middle sleeve provided with ball holes at the bottom.
Figure 12:
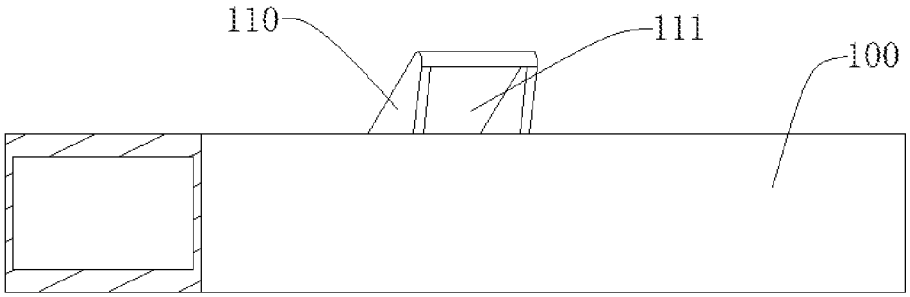
FIG. 12 is a schematic view of a second drive projection.

The lower spray arm upper connecting sleeve 220, the lower spray arm body 230, and the lower spray arm lower connecting sleeve 240 are integrally connected, and the lower spray arm upper connecting sleeve 220 and the lower spray arm lower connecting sleeve 240 are both located in the middle of the lower spray arm body 230, which is conducive to ensuring the balance of the spray arm assembly 1000. Referring to FIG. 6 and FIG. 11 to FIG. 12, the lower spray arm upper connecting sleeve 220, the lower spray arm body 230, and the lower spray arm lower connecting sleeve 240 have a communicated lower chamber 250, and the first drive hole 211 is in communication with the lower chamber 250. The lower spray arm upper connecting sleeve 220, the lower spray arm body 230, and the lower spray arm lower connecting sleeve 240 may all be hollow members. Hollow positions of the three members jointly form the lower chamber 250, and the first drive hole 211 is connected to the hollow position of the lower spray arm body 230. Therefore, the first drive hole 211 is in communication with the lower chamber 250.

Figure 8:
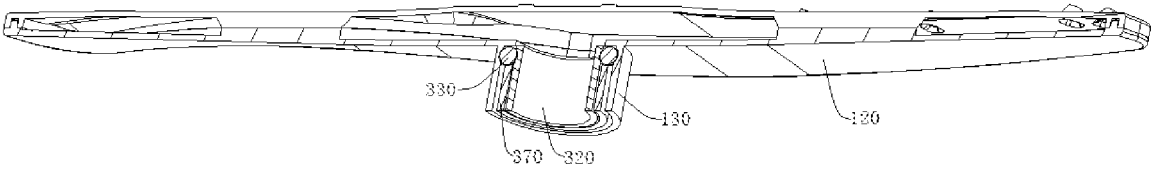
FIG. 8 is a three-dimensional view of assembly of an upper spray arm and a first ball assembly of the spray arm assembly.
Figure 9:
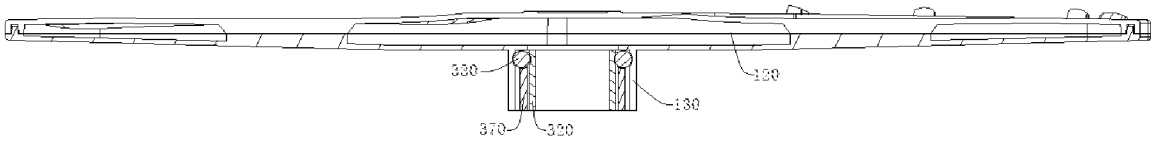
FIG. 9 is a front view of assembly of the upper spray arm and the first ball assembly of the spray arm assembly.

Further, referring to FIG. 7 to FIG. 9, the upper spray arm 100 may include: an upper spray arm body 120 and an upper spray arm connecting sleeve 130. The upper spray arm connecting sleeve 130 is arranged on a lower side of the upper spray arm body 120. The arrangement of the upper spray arm connecting sleeve 130 facilitates the connection between the upper spray arm 100 and the lower spray arm 200, and ensures that the upper spray arm 100 and the lower spray arm 200 can be reliably integrally connected.

The upper spray arm body 120 and the upper spray arm connecting sleeve 130 have a communicated upper chamber 140, the second drive hole 111 is in communication with the upper chamber 140, and the upper chamber 140 is further in communication with the lower chamber 250, which can thus ensure water from a water source of the dishwasher can smoothly enter the upper chamber 140 through the lower chamber 250, and then the water is sprayed to the tableware surface through the water spray holes and the drive holes on the spray arm assembly 1000, to complete the operation of tableware cleaning. As water continues to enter the upper chamber 140 and the lower chamber 250, the water pressure in the upper chamber 140 and the lower chamber 250 increases. In this case, the reaction force produced by the water columns from the first drive hole 211 and the second drive hole 111 is greater, and the upper spray arm 100 and the lower spray arm 200 rotate faster; at the same time, the sprayed water columns beat the tableware with greater force, which is conducive to cleaning stains on the tableware. Therefore, the arrangement of the upper chamber 140 and the lower chamber 250 can ensure sufficient water and a batter washing effect of the dishwasher.

The first ball assembly 300 is arranged at a position where the upper spray arm connecting sleeve 130 is connected to and cooperates with the lower spray arm upper connecting sleeve 220. Thus, when the upper spray arm connecting sleeve 130 and the lower spray arm upper connecting sleeve 220 rotate relative to each other, the first ball assembly 300 may roll, thus reducing the friction force between the upper spray arm connecting sleeve 130 and the lower spray arm upper connecting sleeve 220. At the same time, after the upper spray arm connecting sleeve 130 and the lower spray arm upper connecting sleeve 220 are connected through the first ball assembly 300, a height dimension of the upper spray arm connecting sleeve 130 can be reduced, and reducing an overall height dimension of the spray arm assembly 1000, and leaving more space for the placement of the tableware.

The spray arm assembly 1000 according to the present application is described in detail below with reference to FIG. 5 to FIG. 11.

Figure 5:
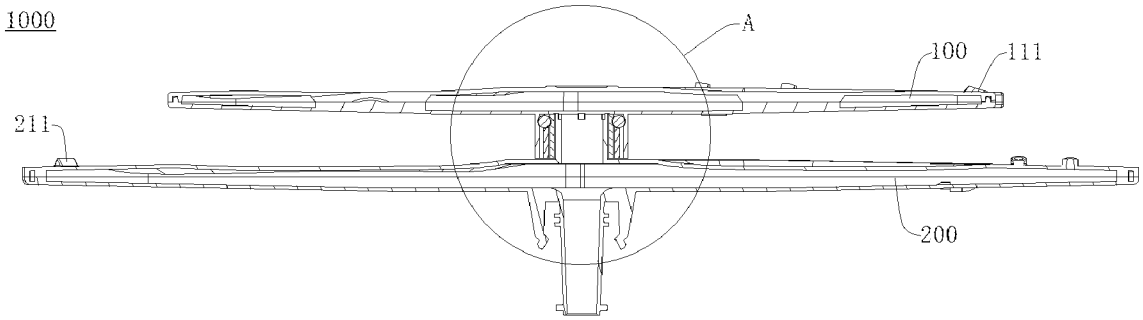
FIG. 5 is a sectional view of the spray arm assembly.

Referring to FIG. 5 to FIG. 6, the upper spray arm connecting sleeve 130 is fitted over an outer side of the lower spray arm upper connecting sleeve 220, and referring to FIG. 7, the first ball assembly 300 may include: a middle sleeve 370, balls 330, and an inner sleeve 320. The inner sleeve 320 is arranged inside the middle sleeve 370. The balls 330 are in rolling contact with an inner surface of the upper spray arm connecting sleeve 130, and the balls 330 are in rolling contact with an outer surface of the inner sleeve 320. At least a part of the lower spray arm upper connecting sleeve 220 is arranged inside the inner sleeve 320, and the inner sleeve 320 is fixedly connected to the lower spray arm upper connecting sleeve 220. Therefore, the upper spray arm 100 and the lower spray arm 200 are indirectly connected through the first ball assembly 300. The structure in which the upper spray arm 100, the lower spray arm 200, and the first ball assembly 300 are connected is simple and stable.

When the upper spray arm 100 rotates relative to the lower spray arm 200, the balls 330 roll, so that the upper spray arm 100 and the inner sleeve 320 rotate relative to each other. Also, since the lower spray arm 200 is fixed to the inner sleeve 320, the relative rotation between the upper spray arm 100 and the lower spray arm 200 is achieved.

Figure 10:
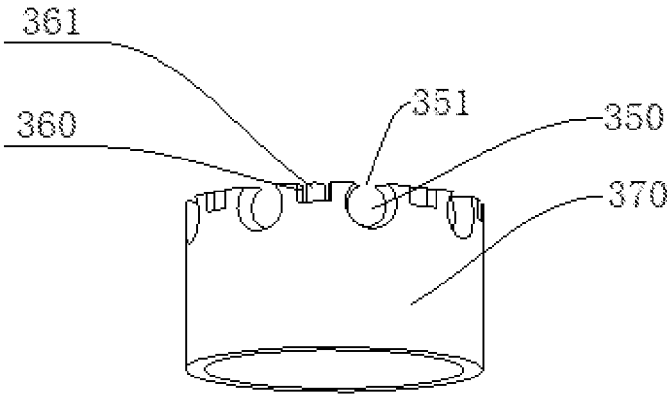
FIG. 10 is a schematic view of a middle sleeve of the spray arm assembly.

As shown in FIG. 10, the middle sleeve 370 is provided with a plurality of ball holes 350. The balls 330 are rotatably mounted in the ball holes 350, and the ball hole 350 provide support for the fixing of the balls 330, which ensures that relative positions of the plurality of balls 330 are unchanged, and prevents collision and extrusion between the plurality of balls 330, thus improving the operation stability of the first ball assembly 300, to further improve the smoothness during rotation of the upper spray arm 100 and the lower spray arm 200. In one embodiment, the number of the balls 330 is the same as that of the ball holes 350.

In a specific embodiment, a plurality of balls 330 are provided, and the plurality of balls 330 are evenly distributed along a circumferential direction of the middle sleeve 370, so that the relative rotation between the upper spray arm 100 and the lower spray arm 200 can be more stable. In one embodiment, the number of the balls 330 is an even number, which ensures the force balance of the first ball assembly 300 and alleviates the stress concentration.

In one embodiment, the diameter of the balls 330 is 3 mm to 8 mm, and the number of the balls 330 is 4 to 12.

The balls 330 protrude beyond inner and outer circumferential surfaces of the middle sleeve 370 in a radial direction of the middle sleeve 370. In other words, the diameter of the balls 330 is greater than a wall thickness of the middle sleeve 370. Only a middle part of the balls 330 are mounted in the middle sleeve 370. Outer sides of the balls 330 protrude outwards beyond the outer circumferential surface of the middle sleeve 370, and inner sides of the balls 330 protrude inwards beyond the inner circumferential surface of the middle sleeve 370.

The inner sleeve 320 is arranged on an inner side of the middle sleeve 370. In this way, the outer sides of the balls 330 may be in rolling contact with an inner surface of the upper spray arm connecting sleeve 130, the inner sides of the balls 330 may be in rolling contact with an outer surface of the inner sleeve 320, and the balls 330 are in rolling contact with both the upper spray arm connecting sleeve 130 and the inner sleeve 320. Also, since the inner sleeve 320 is fixed to the lower spray arm 200, it is equivalent to that rolling contact is also provided between the upper spray arm 100 and the lower spray arm 200. The balls 330 provide support for the connection of the upper spray arm 100 and the lower spray arm 200. When the upper spray arm 100 and the lower spray arm 200 rotate relative to each other, the upper spray arm 100 and the inner sleeve 320 contact through the balls 330. Therefore, rolling friction exists between the upper spray arm 100 and the inner sleeve 320. That is, rolling friction exists between the upper spray arm 100 and the lower spray arm 200.

An outer circumferential surface of the inner sleeve 320 is provided with an inner sleeve ball groove 321 configured to cooperate with the balls 330. An inner circumferential surface of the upper spray arm connecting sleeve 130 is provided with an upper spray arm ball groove 131 configured to cooperate with the balls 330. The upper spray arm ball groove 131 and the inner sleeve ball groove 321 are both circumferential annular grooves, which can ensure the smooth rotation of the upper spray arm 100 in the whole circle. The balls 330 are in rolling contact with the upper spray arm ball groove 131 and the inner sleeve ball groove 321, with less friction force. In a specific embodiment, diameters of the upper spray arm ball groove 131 and the inner sleeve ball groove 321 may be equal to the diameter of the balls 330, or may be slightly larger than the diameter of the balls 330, to ensure that the balls 330 well cooperate with the upper spray arm ball groove 131 and the inner sleeve ball groove 321.

Figure 2:
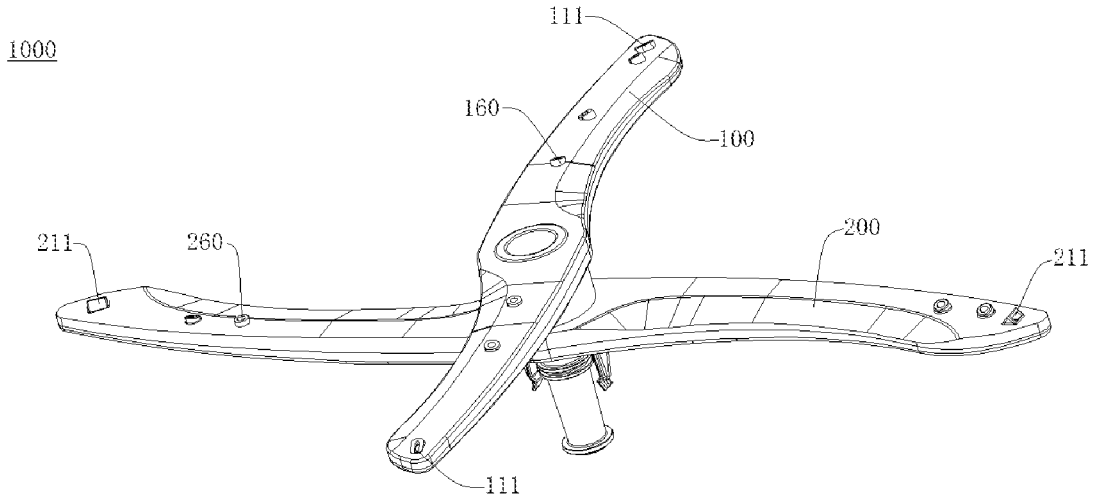
FIG. 2 is another schematic three-dimensional view of the spray arm assembly.
Figure 3:
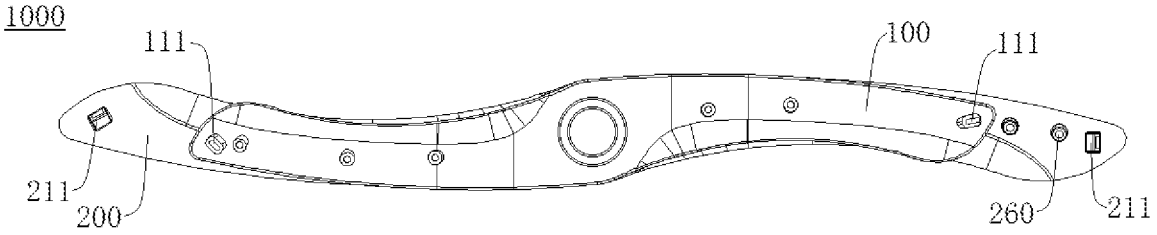
FIG. 3 is a top view of the spray arm assembly.
Figure 4:
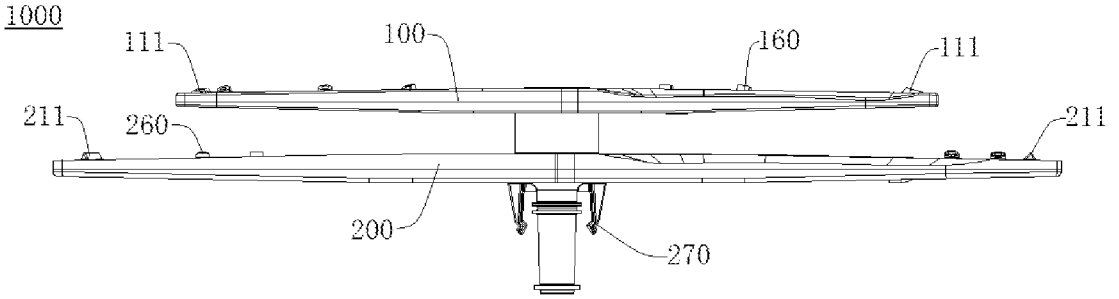
FIG. 4 is a front view of the spray arm assembly.

Further, referring to FIG. 6, in a central axis direction of the upper spray arm connecting sleeve 130, positions of the upper spray arm ball groove 131, the inner sleeve ball groove 321, and the ball holes 350 correspond to each other, and the balls 330 are partially arranged in the ball holes 350. Referring to FIG. 2 to FIG. 3, outer sides of the balls 330 are in contact with the upper spray arm ball groove 131, and inner sides of the balls 330 are in contact with the inner sleeve ball groove 321, to complete the connection between the upper spray arm 100 and the inner sleeve 320. Moreover, the inner sleeve 320 is fixedly connected to the lower spray arm 200, to complete the indirect connection between the upper spray arm 100 and the lower spray arm 200. The positions of the upper spray arm ball groove 131, the inner sleeve ball groove 321, and the ball holes 350 corresponding to each other can prevent impossible rotation of the upper spray arm 100 caused by extrusion of the balls 330 due to a sliding trajectory thereof being different from trajectories of the upper spray arm ball groove 131 and the inner sleeve ball groove 321 during rotation of the upper spray arm 100.

Referring to FIG. 6 to FIG. 7, the upper spray arm ball groove 131 and the inner sleeve ball groove 321 are both circumferential annular groves, which can ensure the smooth rotation of the upper spray arm 100 in the whole circle. The balls 330 are in rolling contact with the upper spray arm ball groove 131 and the inner sleeve ball groove 321, with less friction force.

In the embodiment illustrated in FIG. 10, the ball holes 350 are arranged at the top of the middle sleeve 370, the ball holes 350 are major-arc holes, and ball fetching ports 351 are formed at top notches of the ball holes 350. The balls 330 enter the ball holes 350 or come out of the ball holes 350 through the ball fetching ports 351, thus facilitating the mounting and removal of the balls 330 in the ball holes 350.

In the embodiment illustrated in FIG. 11, the ball holes 350 are arranged at the bottom of the middle sleeve 370, the ball holes 350 are major-arc holes, and ball fetching ports 351 are formed at bottom gaps of the ball holes 350.

The major-arc holes are holes with a center angle greater than 180° and less than 360°, so that most of each ball 330 can be located in the ball holes 350, to prevent the balls 330 from falling off from the ball holes 350 after mounting. During the mounting of the balls 330, the ball fetching ports can be opened with external force, then the balls 330 are mounted in the ball holes 350 through the ball fetching ports, the external force is removed, elastic deformation of the ball holes 350 disappears accordingly, and the ball holes 350 reconvert. In this case, the ball holes 350 tightly wrap the balls 330, making the mounting of the balls 330 in the ball holes 350 firmer and more reliable.

In some other unillustrated embodiments, the ball holes 350 may be further arranged in the middle of the middle sleeve 370. In this case, the ball holes 350 are complete holes.

The middle sleeve 370 mainly has following three functions: (1) the middle sleeve 370 is provided with ball holes 350, and the balls 330 are mounted in the ball holes 350, so that positions of the balls 330 can be fixed and limited to prevent the accumulation of the balls 330; (2) it plays a role of isolating food residue, to prevent the food residue from entering the ball groove to cause friction; and (3) it plays a strengthening role and can isolate the vibration of the spray arm 100 to prevent serious shaking of the spray arm 100.

In some embodiments, the lower spray arm upper connecting sleeve 220 and the inner sleeve 320 are detachably connected.

As shown in FIG. 6 to FIG. 7, the top of the lower spray arm upper connecting sleeve 220 is provided with a buckle 223, and the buckle 223 is configured to clamp an upper surface of the inner sleeve 320. The arrangement of the buckle 223 on the top of the lower spray arm upper connecting sleeve 220 can ensure that the lower spray arm 200 is reliably integrally connected to the inner sleeve 320 and make it easy for the lower spray arm 200 to be connected to and detached from the first ball assembly 300, facilitating the mounting of the spray arm assembly 1000.

A top end of the lower spray arm upper connecting sleeve 220 is provided with a plurality of grooves, an opening direction of the grooves is parallel to an axis direction of the lower spray arm upper connecting sleeve 220, the buckle 223 extends upwards from a bottom wall of the grooves, and two sides of the buckle 223 are separated from two sidewalls of the grooves, which can thus ensure that the buckle 223 can elastically deform in the grooves. A top end of the buckle 223 is provided with a hook toward the inner sleeve 320. The hook is configured to hook a top end of the inner sleeve 320, to limit relative axial positions of the lower spray arm 200 and the inner sleeve 320.

When the inner sleeve 320 is assembled with the lower spray arm upper connecting sleeve 220, an inner circumferential surface of the inner sleeve 320 extrudes the hook of the buckle 223 to make the buckle 223 deform toward the interior of the lower spray arm upper connecting sleeve 220, to ensure that the buckle 223 can reach the top end of the inner sleeve 320 from a bottom end of the inner sleeve 320 (i.e. from the bottom to the top). When the buckle 223 crosses the top end of the inner sleeve 320, extrusion force on the buckle 223 disappears. Under the action of the elastic force of the buckle 223, the buckle 223 approaches the inner sleeve 320, to cause the hook to hook the top end of the inner sleeve 320.

When the inner sleeve 320 needs to be separated from the lower spray arm upper connecting sleeve 220, it is only necessary to lift the upper spray arm 100 upwards by force, the top end of the inner sleeve 320 extrudes the hook, making the hook withdraw inside the inner sleeve 320, and the inner sleeve 320 can be separated from the lower spray arm 200 by continuously lifting the spray arm 100.

A plurality of (e.g., four) buckles 223 may be provided at the top of the lower spray arm upper connecting sleeve 220. The grooves one-to-one correspond to the buckles 223, and the plurality of buckles 223 are evenly distributed along a circumferential direction of the lower spray arm upper connecting sleeve 220, to improve the clamping stability between the buckles 223 and the inner sleeve 320.

In addition to the above clamping form, the detachable connection manner between the lower spray arm upper connecting sleeve 220 and the inner sleeve 320 may also be a threaded connection. In some unillustrated embodiments, the lower spray arm upper connecting sleeve 220 has lower spray arm external threads, the inner sleeve 320 has inner sleeve internal threads, and the inner sleeve internal threads are configured to be screwed with and fixed to the lower spray arm external threads, to implement a detachable threaded connection between the lower spray arm upper connecting sleeve 220 and the inner sleeve 320. When the inner sleeve internal threads and the lower spray arm external threads are unscrewed, the lower spray arm upper connecting sleeve 220 and the inner sleeve 320 can be disassembled. The lower spray arm upper connecting sleeve 220 and the inner sleeve 320 are connected by thread, which are easy to assemble and disassemble and reliable to connect.

Based on FIG. 6, the first ball assembly 300 in the present application may be transformed in a variety of manners, all of which fall within the protection scope of the present application. The following is an overview of a variety of transformed examples of the first ball assembly 300 according to the embodiment of the present application with reference to FIG. 6 and FIG. 14.

Figure 14:
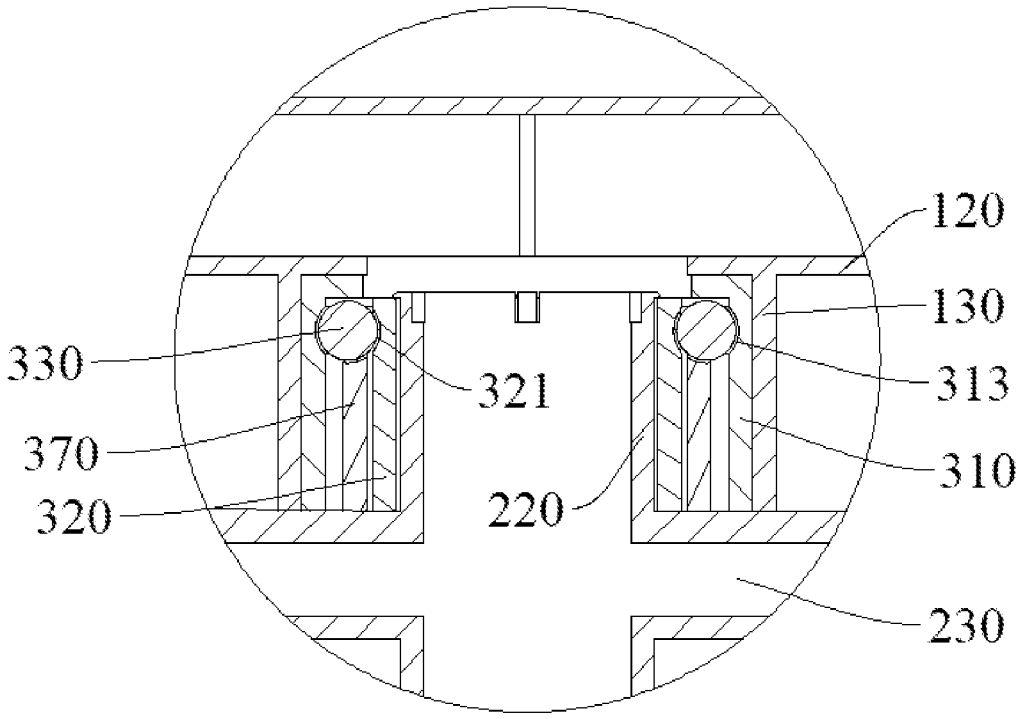
FIG. 14 is a schematic view of an embodiment in which the first ball assembly is connected to the upper spray arm and the lower spray arm.

In the embodiment illustrated in FIG. 14, the first ball assembly 300 may include: an inner sleeve 320, a middle sleeve 370, an outer sleeve 310, and balls 330. In this case, the balls 330 are in rolling contact with the inner sleeve ball groove 321 on the outer circumferential surface of the inner sleeve 320 and are further in rolling contact with the outer sleeve ball groove 313 on the inner circumferential surface of the outer sleeve 310. Moreover, the inner sleeve 320 is clamped with and fixed to the lower spray arm upper connecting sleeve 220 through the buckle 223, and the outer circumferential surface of the outer sleeve 310 is in interference fit with the inner circumferential surface of the upper spray arm connecting sleeve 130, to implement a rolling connection between the upper spray arm 100 and the lower spray arm 200. In the embodiment illustrated in FIG. 6, the outer sleeve 310 in FIG. 14 is integrated with the upper spray arm connecting sleeve 130, so that the outer sleeve 310 constitutes a part of the upper spray arm connecting sleeve 130. That is, the outer sleeve 310 is absent in FIG. 6.

In an unillustrated embodiment, the first ball assembly 300 may include: an inner sleeve 320 and balls 330, in which the middle sleeve 370 is absent compared with the embodiment in FIG. 6. In this case, the balls 330 are in rolling contact with the inner sleeve ball groove 321 on the outer circumferential surface of the inner sleeve 320 and are further in rolling contact with the upper spray arm ball groove 131 on the inner circumferential surface of the upper spray arm connecting sleeve 130. Moreover, the inner sleeve 320 is clamped with and fixed to the lower spray arm upper connecting sleeve 220 through the buckle 223, to implement a rolling connection between the upper spray arm 100 and the lower spray arm 200.

In another unillustrated embodiment, the first ball assembly 300 may include: an inner sleeve 320, an outer sleeve 320, and balls 330, in which the middle sleeve 370 is absent compared with the embodiment in FIG. 14. In this case, the balls 330 are in rolling contact with the inner sleeve ball groove 321 on the outer circumferential surface of the inner sleeve 320 and are further in rolling contact with the outer sleeve ball groove 313 on the inner circumferential surface of the outer sleeve 310. Moreover, the inner sleeve 320 is clamped with and fixed to the lower spray arm upper connecting sleeve 220 through the buckle 223, and the outer circumferential surface of the outer sleeve 310 is in interference fit with the inner circumferential surface of the upper spray arm connecting sleeve 130, to implement a rolling connection between the upper spray arm 100 and the lower spray arm 200.

In some embodiments, the lower spray arm upper connecting sleeve 220 and the inner sleeve 320 are detachably connected.

The first ball assembly 300 includes at least a plurality of balls 330. The plurality of balls 330 are arranged between the lower spray arm upper connecting sleeve 220 and the upper spray arm connecting sleeve 130.

The first ball assembly 300 further includes: a bearing base, and the balls 330 are fitted between the lower spray arm upper connecting sleeve 220 and the upper spray arm connecting sleeve 130 through the bearing base.

In one embodiment, the bearing base includes: an inner sleeve 320, a middle sleeve 370, and an outer sleeve 310. The inner sleeve 320 is configured to cooperate with one of the lower spray arm upper connecting sleeve 220 and the upper spray arm connecting sleeve 130. The middle sleeve 370 is fitted over the inner sleeve 320, the middle sleeve 370 is provided with a plurality of ball holes 350, the balls 330 are mounted in the ball holes 350, and the balls 330 protrude beyond inner and outer circumferential surfaces of the middle sleeve 370 in a radial direction of the middle sleeve 370. The outer sleeve 310 is fitted over the middle sleeve 370, and the outer sleeve 310 is configured to cooperate with the other one of the lower spray arm upper connecting sleeve 220 and the upper spray arm connecting sleeve 130.

In one embodiment, the bearing base includes: an inner sleeve 320 and an outer sleeve 310. The inner sleeve 320 is configured to cooperate with one of the lower spray arm upper connecting sleeve 220 and the upper spray arm connecting sleeve 130. The outer sleeve 310 is fitted over the inner sleeve 320, and the outer sleeve 310 is configured to cooperate with the other one of the lower spray arm upper connecting sleeve 220 and the upper spray arm connecting sleeve 130.

According to some embodiments of the present application, the inner sleeve 320 is integrated with one of the lower spray arm upper connecting sleeve 220 and the upper spray arm connecting sleeve 130, so that the inner sleeve 320 constitutes a part of the one; and/or the outer sleeve 310 is integrated with the other one of the lower spray arm upper connecting sleeve 220 and the upper spray arm connecting sleeve 130, so that the outer sleeve 310 constitutes a part of the other one.

It needs to be noted that the inner sleeve 320 being integrated with one of the lower spray arm upper connecting sleeve 220 and the upper spray arm connecting sleeve 130 may be the inner sleeve 320 being integrated with the lower spray arm upper connecting sleeve 220. That is, the inner sleeve 320 constitutes a part of the lower spray arm upper connecting sleeve 220. In this case, the upper spray arm connecting sleeve 130 is fitted over the outer side of the lower spray arm upper connecting sleeve 220, the first ball assembly 300 does not include the inner sleeve 320, and the inner sides of the balls 330 are directly in rolling contact with the lower spray arm upper connecting sleeve 220. Alternatively, the inner sleeve 320 is integrated with the upper spray arm connecting sleeve 130. That is, the inner sleeve 320 constitutes a part of the upper spray arm connecting sleeve 130. In this case, the lower spray arm upper connecting sleeve 220 is fitted over the outer side of the upper spray arm connecting sleeve 130, the first ball assembly 300 does not include the inner sleeve 320, and the inner sides of the balls 330 are directly in rolling contact with the upper spray arm connecting sleeve 130.

Similarly, the outer sleeve 310 being integrated with the other one of the lower spray arm upper connecting sleeve 220 and the upper spray arm connecting sleeve 130 may be the outer sleeve 310 being integrated with the upper spray arm connecting sleeve 130. That is, the outer sleeve 310 constitutes a part of the upper spray arm connecting sleeve 130. In this case, the upper spray arm connecting sleeve 130 is fitted over the outer side of the lower spray arm upper connecting sleeve 220, the first ball assembly 300 does not include the outer sleeve 310, and the outer sides of the balls 330 are directly in rolling contact with the upper spray arm connecting sleeve 130. Alternatively, the outer sleeve 310 is integrated with the lower spray arm upper connecting sleeve 220. That is, the outer sleeve 310 constitutes a part of the lower spray arm upper connecting sleeve 220. In this case, the lower spray arm upper connecting sleeve 220 is fitted over the outer side of the upper spray arm connecting sleeve 130, the first ball assembly 300 does not include the outer sleeve 310, and the outer sides of the balls 330 are directly in rolling contact with the lower spray arm upper connecting sleeve 220.

The structure of the first ball assembly 300 is described below with an example in which the lower spray arm upper connecting sleeve 220 is fitted over the outer side of the upper spray arm connecting sleeve 130.

Figure 15:
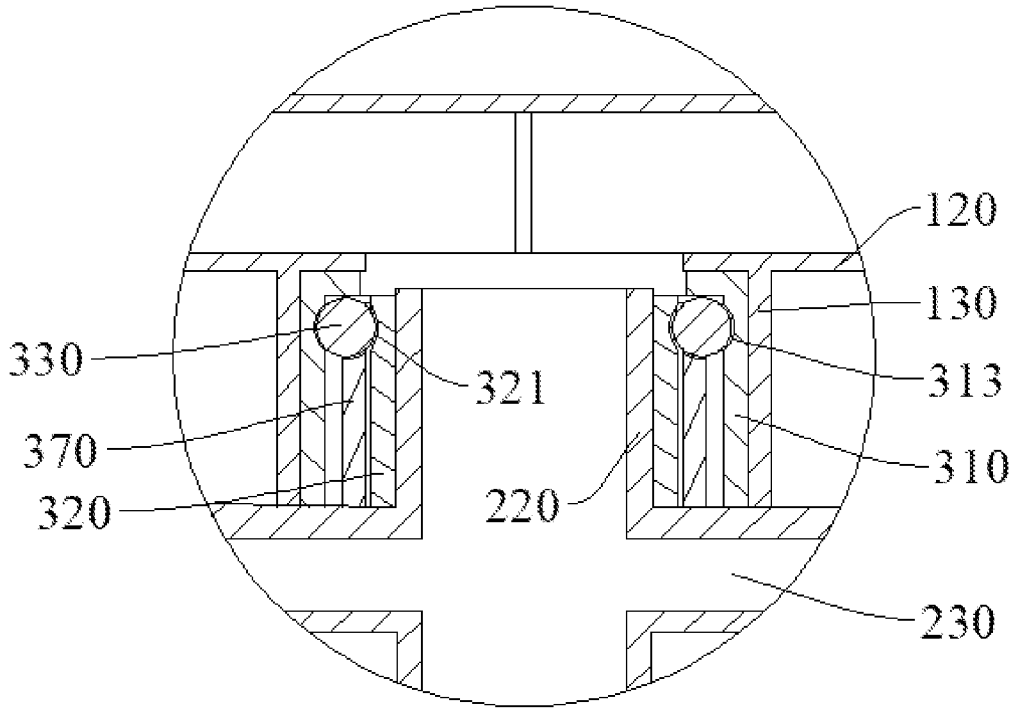
FIG. 15 is a schematic view of an embodiment in which the first ball assembly is connected to the upper spray arm and the lower spray arm.

In the embodiment illustrated in FIG. 15, the first ball assembly 300 may include: balls 330, an inner sleeve 320, a middle sleeve 370, and an outer sleeve 310. The middle sleeve 370 is arranged on an inner side of the outer sleeve 310. The inner sleeve 320 is arranged on an inner side of the middle sleeve 370. An inner circumferential surface of the outer sleeve 310 is provided with an outer sleeve ball groove 313 configured to cooperate with the balls 330. An outer circumferential surface of the inner sleeve 320 is provided with an inner sleeve ball groove 321 configured to cooperate with the balls 330. In this case, the first ball assembly 300 is an independent modular member, and can be supplied separately without changing the upper spray arm connecting sleeve 130 and the lower spray arm upper connecting sleeve 220, which is convenient to mount and remove and also reduces the processing cost of the lower spray arm 200 or the upper spray arm 100.

The balls 330 are in rolling contact with the inner sleeve ball groove 321 on the outer circumferential surface of the inner sleeve 320 and are further in rolling contact with the outer sleeve ball groove 313 on the inner circumferential surface of the outer sleeve 310, and the outer sleeve 310 is fixed to the upper spray arm connecting sleeve 130 and the inner sleeve 320 is fixed to the lower spray arm upper connecting sleeve 220, so that a rolling connection between the upper spray arm connecting sleeve 130 and the lower spray arm upper connecting sleeve 220 can be achieved. In other words, the upper spray arm 100 and the lower spray arm 200 are indirectly connected through the first ball assembly 300, that is, rolling contact is also provided between the upper spray arm 100 and the lower spray arm 200. The balls 330 provide support for the connection between the upper spray arm 100 and the lower spray arm 200. The structure in which the upper spray arm 100, the lower spray arm 200, and the first ball assembly 300 are connected is simple and stable.

When the upper spray arm 100 rotates relative to the lower spray arm 200, the balls 330 roll, so that the outer sleeve 310 rotates relative to the inner sleeve 320. Also, since the upper spray arm 100 is fixed to the outer sleeve 310 and the lower spray arm 200 is fixed to the inner sleeve 320, the relative rotation of the upper spray arm 100 and the lower spray arm 200 is achieved.

In one embodiment, the inner circumferential surface of the inner sleeve 320 is in interference fit with the outer circumferential surface of the lower spray arm upper connecting sleeve 220, and the outer circumferential surface of the outer sleeve 310 is in interference fit with the inner circumferential surface of the upper spray arm connecting sleeve 130, which is thus conducive to improving the firmness of the connection of the first ball assembly 300 with the upper spray arm 100 and the lower spray arm 200.

The inner sleeve ball groove 321 and the outer sleeve ball groove 313 are both circumferential annular groves, which can thus ensure the smooth rotation of the upper spray arm 100 in the whole circle. The balls 330 are in rolling contact with the inner sleeve ball groove 321 and the outer sleeve ball groove 313, with less friction force. In a specific embodiment, diameters of the inner sleeve ball groove 321 and the outer sleeve ball groove 313 may be equal to the diameter of the balls 330, or may be slightly larger than the diameter of the balls 330, to ensure that the balls 330 well cooperate with the inner sleeve ball groove 321 and the outer sleeve ball groove 313.

Further, referring to FIG. 11, in a central axis direction of the upper spray arm connecting sleeve 130, positions of the outer sleeve ball groove 313, the inner sleeve ball groove 321, and the ball holes 350 correspond to each other, and the balls 330 are partially arranged in the ball holes 350. The outer sides of the balls 330 are in contact with the outer sleeve ball groove 313, and the inner sides of the balls 330 are in contact with the inner sleeve ball groove 321, to complete the connection between the outer sleeve 310 and the inner sleeve 320. Moreover, the upper spray arm 100 is fixedly connected to the outer sleeve 310, and the inner sleeve 320 is fixedly connected to the lower spray arm 200, to complete the indirect connection between the upper spray arm 100 and the lower spray arm 200. The positions of the outer sleeve ball groove 313, the inner sleeve ball groove 321, and the ball holes 350 corresponding to each other can prevent impossible rotation of the upper spray arm 100 caused by extrusion of the balls 330 due to a sliding trajectory thereof being different from trajectories of the outer sleeve ball groove 313 and the inner sleeve ball groove 321 during rotation of the upper spray arm 100.

In some unillustrated embodiments, the outer circumferential surface of the outer sleeve 310 is provided with outer sleeve threads, the inner circumferential surface of the upper spray arm connecting sleeve 130 is provided with upper spray arm threads, and the upper spray arm threads are configured to fit with the outer sleeve threads, to achieve the fixed connection between the upper spray arm 100 and the outer sleeve 310.

Based on the embodiment of FIG. 15, the first ball assembly 300 in the present application may be transformed in a variety of manners, all of which fall within the protection scope of the present application. The following is an overview of a variety of transformed examples of the first ball assembly 300 according to the embodiment of the present application with reference to FIG. 15.

In a first unillustrated embodiment, the first ball assembly 300 may include only balls 330, in which the middle sleeve 370, the inner sleeve 320, and the outer sleeve 310 are absent compared with the embodiment of FIG. 15. The balls 330 are used to directly cooperate with the upper spray arm connecting sleeve 130 and the lower spray arm upper connecting sleeve 220, which can also achieve the rolling connection between the upper spray arm connecting sleeve 130 and the lower spray arm upper connecting sleeve 220. In this case, the inner circumferential surface of the upper spray arm connecting sleeve 130 is provided with an upper spray arm ball groove configured to cooperate with the balls 330, and the outer circumferential surface of the lower spray arm upper connecting sleeve 220 is provided with a lower spray arm ball groove configured to cooperate with the balls 330.

In a second unillustrated embodiment, the first ball assembly 300 may include only balls 330 and an inner sleeve 320, in which the middle sleeve 370 and the outer sleeve 310 are absent compared with the embodiment of FIG. 15. The balls 330 are used to directly cooperate with the inner sleeve 320 and the upper spray arm connecting sleeve 130, which can also achieve the rolling connection between the upper spray arm connecting sleeve 130 and the lower spray arm upper connecting sleeve 220. In this case, the inner circumferential surface of the upper spray arm connecting sleeve 130 is provided with an upper spray arm ball groove configured to cooperate with the balls 330.

In a third unillustrated embodiment, the first ball assembly 300 may include only balls 330 and an outer sleeve 310, in which the middle sleeve 370 and the inner sleeve 320 are absent compared with the embodiment of FIG. 15. The balls 330 are used to directly cooperate with the lower spray arm upper connecting sleeve 220 and the outer sleeve 310, which can also achieve the rolling connection between the upper spray arm connecting sleeve 130 and the lower spray arm upper connecting sleeve 220. In this case, the outer circumferential surface of the lower spray arm upper connecting sleeve 220 is provided with a lower spray arm ball groove configured to cooperate with the balls 330.

In a fourth unillustrated embodiment, the first ball assembly 300 may include only balls 330, an inner sleeve 320, and an outer sleeve 310, in which the middle sleeve 370 is absent compared with the embodiment of FIG. 15. The balls 330 are used to directly cooperate with the inner sleeve 320 and the outer sleeve 310, which can also achieve the rolling connection between the upper spray arm connecting sleeve 130 and the lower spray arm upper connecting sleeve 220. In this case, the outer sleeve 310 may be in interference fit with the upper spray arm connecting sleeve 130, and the inner sleeve 320 may be in interference fit with the lower spray arm upper connecting sleeve 220. In this case, the first ball assembly 300 is an independent modular member, which is convenient to mount and remove and also reduces the processing cost of the lower spray arm 200 or the upper spray arm 100.

In a fifth unillustrated embodiment, the first ball assembly 300 may include only balls 330 and a middle sleeve 370, in which the inner sleeve 320 and the outer sleeve 310 are absent compared with the embodiment of FIG. 15. The balls 330 are used to directly cooperate with the upper spray arm connecting sleeve 130 and the lower spray arm upper connecting sleeve 220, which can also achieve the rolling connection between the upper spray arm connecting sleeve 130 and the lower spray arm upper connecting sleeve 220. In this case, the inner circumferential surface of the upper spray arm connecting sleeve 130 is provided with an upper spray arm ball groove configured to cooperate with the balls 330, and the outer circumferential surface of the lower spray arm upper connecting sleeve 220 is provided with a lower spray arm ball groove configured to cooperate with the balls 330. In the embodiment illustrated in FIG. 15, the outer sleeve 310 is integrated with the upper spray arm connecting sleeve 130, and the inner sleeve 320 is integrated with the lower spray arm upper connecting sleeve 220, so that the outer sleeve 310 constitutes a part of the upper spray arm connecting sleeve 130 and the inner sleeve 320 constitutes a part of the lower spray arm upper connecting sleeve 220. That is, the outer sleeve 310 and the inner sleeve 320 are absent.

In a sixth unillustrated embodiment, the first ball assembly 300 may include only balls 330, an inner sleeve 320, and a middle sleeve 370, in which the outer sleeve 310 is absent compared with the embodiment of FIG. 15. The balls 330 are used to directly cooperate with the inner sleeve 320 and the upper spray arm connecting sleeve 130, which can also achieve the rolling connection between the upper spray arm connecting sleeve 130 and the lower spray arm upper connecting sleeve 220. In this case, the inner circumferential surface of the upper spray arm connecting sleeve 130 is provided with an upper spray arm ball groove configured to cooperate with the balls 330. In the embodiment illustrated in FIG. 15, the outer sleeve 310 is integrated with the upper spray arm connecting sleeve 130, so that the outer sleeve 310 constitutes a part of the upper spray arm connecting sleeve 130. That is, the outer sleeve 310 is absent.

In a seventh unillustrated embodiment, the first ball assembly 300 may include only balls 330, an outer sleeve 310, and a middle sleeve 370, in which the inner sleeve 320 is absent compared with the embodiment of FIG. 15. The balls 330 are used to directly cooperate with the lower spray arm upper connecting sleeve 220 and the outer sleeve 310, which can also achieve the rolling connection between the upper spray arm connecting sleeve 130 and the lower spray arm upper connecting sleeve 220. In this case, the outer circumferential surface of the lower spray arm upper connecting sleeve 220 is provided with a lower spray arm ball groove configured to cooperate with the balls 330. In the embodiment illustrated in FIG. 15, the inner sleeve 320 is integrated with the lower spray arm upper connecting sleeve 220, so that the inner sleeve 320 constitutes a part of the lower spray arm upper connecting sleeve 220. That is, the inner sleeve 320 is absent.

In one embodiment, the lower spray arm upper connecting sleeve 220 may also sleeve the outer side of the upper spray arm connecting sleeve 130. In this case, the inner side of the first ball assembly 300 is in contact with the upper spray arm connecting sleeve 130, and the outer side of the first ball assembly 300 is in contact with the lower spray arm upper connecting sleeve 220. The situation where the lower spray arm upper connecting sleeve 220 is fitted over the inner side of the upper spray arm connecting sleeve 130 is similar to the above seven embodiments, and is not repeated herein.

In the embodiment illustrated in FIG. 15, the ball holes 350 are arranged at the top of the middle sleeve 370. The outer sleeve 310 may include: an outer sleeve circumferential wall and an outer sleeve top wall. The outer sleeve top wall is arranged at the top of the outer sleeve circumferential wall, and the outer sleeve top wall extends inwards along a radial direction of the outer sleeve circumferential wall. The balls 330 are arranged below the outer sleeve top wall. Therefore, the outer sleeve top wall may protect the balls 330 to some extent, preventing the balls 330 from being exposed to affect the service life of the balls 330. In one embodiment, the outer sleeve 310 may also be constructed as a hollow cylindrical structure only.

Referring to FIG. 10 and FIG. 11, a weakening groove 360 is arranged between two adjacent ball holes 350. With the arrangement of the weakening groove 360, the stiffness between the two adjacent ball holes 350 can be reduced. Therefore, when the balls 330 are mounted, the ball holes 350 are easy to deform, which reduces the difficulty of mounting or removing the balls 330.

Further, the weakening groove 360 is provided with a weakening groove post 361. In one embodiment, a central axis of the weakening groove post 361 is parallel to that of the middle sleeve 370, which is conducive to simplifying the processing technology of the middle sleeve 370. The arrangement of the weakening groove post 361 can play a strengthening role, to prevent the weakening groove 360 from excessively weakening the stiffness of the middle sleeve 370, which is conducive to improving the operation reliability of the first ball assembly 300.

In a specific embodiment, the balls 330 may be plastic balls or stainless steel balls. The operation environment of the spray arm assembly 1000 is full of water, the spray arm assembly 1000 is in a hot and wet environment for a long time, and the balls 330 are prone to rust and stagnation; plastic balls or stainless steel balls have strong corrosion resistance, which can effectively slow down or even avoid the rust of the balls 330.

Figure 13:
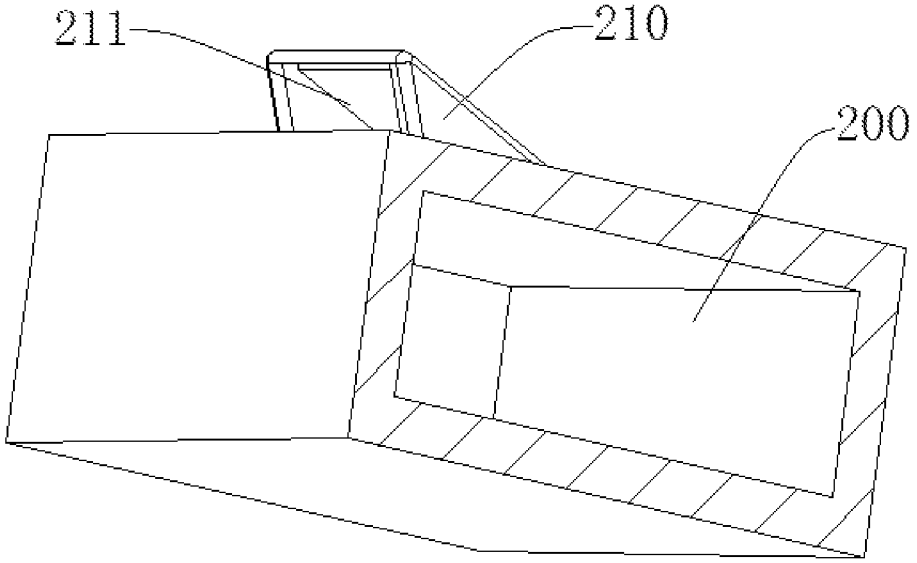
FIG. 13 is a schematic view of a first drive projection.

Referring to FIG. 7 and FIG. 13, the lower spray arm body 230 is provided with a first drive projection 210. The first drive projection 210 protrudes beyond a surface of the lower spray arm body 230, and the first drive hole 211 is formed on the first drive projection 210. In one embodiment, the first drive projection 210 is arranged on an upper end face of the lower spray arm body 230. The arrangement of the first drive projection 210 facilitates the opening of the first drive hole 211 with a specific orientation. The first drive hole 211 is arranged on the first drive projection 210. In some embodiments, the orientation (i.e. the normal direction) of the first drive hole 211 may be parallel to left and right symmetry planes of the lower spray arm 200, which ensures that when a water column is sprayed from the first drive hole 211, the reaction force generated causes the lower spray arm 200 to rotate in the first direction.

Referring to FIG. 7 and FIG. 12, the upper spray arm body 120 is provided with a second drive projection 110. The second drive projection 110 protrudes beyond a surface of the upper spray arm body 120, and the second drive hole 111 is formed on the second drive projection 110. In one embodiment, the second drive projection 110 is arranged on an upper end face of the upper spray arm body 120. The second drive projection 110 acts in the same way as the first drive projection 210, and the orientation (i.e. the normal direction) of the second drive hole 111 may be parallel to left and right symmetry planes of the upper spray arm 100. The effect thereof is the same as the first drive hole 211 and is not repeated herein. When a water column is sprayed from the second drive hole 111, the reaction force generated causes the upper spray arm 100 to rotate in the second direction.

In some unillustrated embodiments, the first drive projection 210 may be arranged on a lower end face of the lower spray arm body 230, and the second drive projection 110 may be arranged on a lower end face of the upper spray arm body 120. Moreover, the normal directions of the first drive hole 211 and the second drive hole 111 may not be just perpendicular to the outer surface of the corresponding spray arm, and an angle may be allowed, provided that the lower spray arm 200 can rotate in the first direction and the upper spray arm 100 can rotate in the second direction.

Further, an angle between a normal of the first drive hole 211 and an axis of the lower spray arm upper connecting sleeve 220 is 0°-90°, and an angle between a normal of the second drive hole 111 and an axis of the upper spray arm connecting sleeve 130 is 0°-90°.

In one embodiment, at the same end of the lower spray arm body 230 and the upper spray arm body 120, when the first drive hole 211 and the second drive hole 111 are in opposite directions, it can ensure that rotation directions of the upper injection arm 100 and the lower injection arm 200 are opposite. When the first drive hole 211 and the second drive hole 111 are in the same direction, it can ensure that rotation directions of the upper spray arm 100 and the lower spray arm 200 are the same. A plurality of first drive holes 211 and second drive holes 111 may be provided, to increase the spray volume and improve the driving force.

In one embodiment, two first drive holes 211 may be provided, and the two first drive holes 211 are arranged on two ends of the lower spray arm body 230 respectively. The first drive hole 211 arranged on one end (e.g., the right end) of the lower spray arm body 230 should be in a direction opposite to that the first drive hole 211 arranged on the other end (e.g., the left end) of the lower spray arm body 230, to ensure that the reaction moment generated from each first drive hole 211 is in the same direction, which is conducive to improving the rotational driving force of the lower spray arm 200 and ensuring faster rotation of the lower spray arm 200.

Two second drive holes 111 may be provided, and the two second drive holes 111 are arranged on two ends of the upper spray arm body 120 respectively. The second drive hole 111 arranged on one end (e.g., the right end) of the upper spray arm body 120 should be in a direction opposite to that the second drive hole 111 arranged on the other end (e.g., the left end) of the upper spray arm body 120, to ensure that the reaction moment generated from each second drive hole 111 is in the same direction, which is conducive to improving the rotational driving force of the upper spray arm 100 and ensuring faster rotation of the upper spray arm 100.

The water yield per unit time can be increased by increasing the number of drive holes, to increase the driving force. The arrangement of the first drive hole 211 on the end of the lower spray arm body 230 and the second drive hole 111 on the end of the upper spray arm body 120 facilitates the increase of the moment arm length of the driving force at the first drive hole 211 and the second drive hole 111. In this way, the lower spray arm 200 and the upper spray arm 100 can be driven to rotate only by consuming less water energy. Therefore, in a specific embodiment, the first drive hole 211 is as far as possible from the center position of the lower spray arm body 230 and the second drive hole 111 is as far as possible from the center position of the upper spray arm body 120; and the first drive hole 211 is arranged on an end of the lower spray arm body 230 and the second drive hole 111 is arranged on an end of the upper spray arm body 120. When water columns are sprayed from the first drive hole 211 and the second drive hole 111, rotation shafts of the lower spray arm 200 and the upper spray arm 100 have a large torque, to ensure that the reaction force generated when the water columns are sprayed can be used as much as possible to improve the rotation speed of the lower spray arm 200 and the upper spray arm 100, which is conducive to improving the cleaning effect of the spray arm assembly 1000.

In one embodiment, the first drive projection 210 and the second drive projection 110 are constructed into a shape of a cuboid, cube, rectangular pyramid, trapezoid, or cylinder, but are not limited to the above structures. In the examples of FIG. 12 to FIG. 13, the first drive projection 210 and the second drive projection 110 are both constructed into a shape of a rectangular pyramid.

It needs to be noted that in the present application, the upper and lower position relationship between the upper spray arm 100 and the lower spray arm 200 is described based on an example in which the spray arm assembly 1000 is mounted to a bottom wall of the dishwasher. In some unillustrated embodiments, the spray arm assembly 1000 may also be mounted to a top wall or a sidewall of the dishwasher. When the spray arm assembly 1000 is mounted to a top wall of the dishwasher, the upper spray arm 100 is located below the lower spray arm 200. When the spray arm assembly 1000 is mounted to a sidewall of the dishwasher, the upper spray arm 100 is located on one side of the lower spray arm 200 away from the sidewall of the dishwasher. That is, regardless of where the spray arm assembly 1000 is located in the dishwasher, the upper spray arm 100 is always located on the side of the lower spray arm 200 toward an inner cavity of the dishwasher.

The spray arm assembly 1000 according to the embodiment of the present application is described below in detail with reference to FIG. 12 to FIG. 14 and FIG. 16 to FIG. 27.

Figure 16:
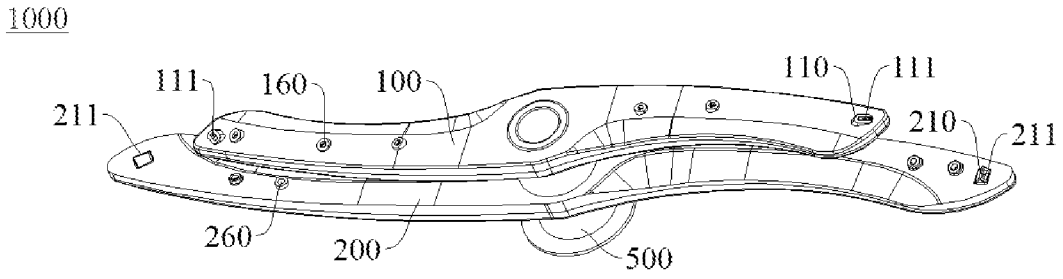
FIG. 16 is a schematic three-dimensional view of a spray arm assembly according to a first embodiment of the present application (an angle between the upper spray arm and the lower spray arm is 0°)

Referring to FIG. 16, the spray arm assembly 1000 according to the embodiment of the present application may include: a spray arm, a first ball assembly 300, a spray arm base 500, and a second ball assembly 400. In one embodiment, the spray arm may include: a lower spray arm 200 and an upper spray arm 100. The upper spray arm 100 is connected to the lower spray arm 200, and the upper spray arm 100 is located above the lower spray arm 200. The upper spray arm 100 is rotatable relative to the lower spray arm 200. The upper spray arm 100 is provided with an upper spray hole 160 for spraying water into the dishwasher. The lower spray arm 200 is provided with a lower spray hole 260 for spraying water into the dishwasher. When the water sprayed from the upper spray hole 160 and the lower spray hole 260 falls on tableware, the tableware can be cleaned. By arranging the upper spray arm 100 above the lower spray arm 200, the number of spray arms is increased, to increase a spray volume of the spray arms, which is conducive to enhancing the cleaning effect of the spray arms on the tableware.

The lower spray arm 200 is provided with a first drive hole 211 for driving the lower spray arm 200 to rotate around a first direction. When a water column inside the spray arm is sprayed from the first drive hole 211, the lower spray arm 200 may be subjected to reaction force (i.e. reverse driving force) of the water column sprayed from the first drive hole 211. In this case, the lower spray arm 200 may rotate around the first direction under the reaction force. The first direction is opposite to an opening direction of the first drive hole 211. The lower spray arm 200 may rotate continuously as the water column is continuously sprayed from the first drive hole 211. The water column sprayed from the first drive hole 211 may sprinkle around with the rotation of the lower spray arm 200, a water flow sprayed from the lower spray hole 260 of the lower spray arm 200 may also enter an operation region of the dishwasher, and then the two cooperate to clean the tableware in the dishwasher or stains on inner walls of the dishwasher.

The upper spray arm 100 is provided with a second drive hole 111 for driving the upper spray arm 100 to rotate around a second direction. When a water column is sprayed from the second drive hole 111, the upper spray arm 100 may be subjected to reaction force of the water column sprayed from the second drive hole 111. In this case, the upper spray arm 100 may rotate around the second direction under the reaction force. The second direction is opposite to an opening direction of the second drive hole 111. The upper spray arm 100 may rotate continuously as the water column is constantly sprayed from the second drive hole 111, and when the upper spray arm 100 rotates, the water column sprayed from the second drive hole 111 is sprinkled around, a water flow sprayed from the upper spray hole 160 of the upper spray arm 100 may also enter an operation region of the dishwasher, and then the upper spray arm 100 and the lower spray arm 200 jointly cooperate to clean the tableware in the dishwasher or stains on inner walls of the dishwasher.

It needs to be noted that in some embodiments, the first direction in which the lower spray arm 200 rotates is opposite to the second direction in which the upper spray arm 100 rotates. When water columns are simultaneously sprayed from the first drive hole 211 of the lower spray arm 200 and the second drive hole 111 of the upper spray arm 100, the lower spray arm 200 and the upper spray arm 100 rotate simultaneously, and rotation directions of the two are opposite (for example, referring to FIG. 16 to FIG. 18, the lower spray arm 200 may rotate counterclockwise, and the upper spray arm 100 may rotate clockwise; the lower spray arm 200 may also rotate clockwise and the upper spray arm 100 may rotate counterclockwise). In this case, the water columns sprayed from the first drive hole 211 of the lower spray arm 200 and the second drive hole 111 of the upper spray arm 100 are sprayed in opposite directions. When the water columns sprayed from the first drive hole 211 and the second drive hole 111 simultaneously fall on the tableware or the inner walls of the dishwasher, due to the inconsistency of cleaning directions after the sprayed water columns are applied to the tableware or the inner walls of the dishwasher, the water columns sprayed from the first drive hole 211 and the second drive hole 111 produce rubbing force on the tableware or the inner walls of the dishwasher, and enhancing the cleaning effect of the spray arm, which can ensure the tableware or the inner walls of the dishwasher to be clean. In addition, rotation of the upper spray arm 100 and the lower spray arm 200 in opposite directions may also make the water sprayed from the upper spray hole 160 of the upper spray arm 100 and the water sprayed from the lower spray hole 260 of the lower spray arm 200 produce rubbing force on the tableware, to further enhance the cleaning effect of the spray arm.

Directions and positions of water columns sprayed by the lower spray arm 100 and the upper spray arm 200 onto the tableware are multi-directional, which reduces the dead angle and makes cleaning easier. Due to a large coverage rate of the water flow, the cleaning time may be reduced correspondingly, which is conducive to shortening the cleaning time.

The first ball assembly 300 is arranged at a position where the upper spray arm 100 is connected to and cooperates with the lower spray arm 200, and the upper spray arm 100 and the lower spray arm 200 are indirectly connected through the first ball assembly 300. When the upper spray arm 100 rotates relative to the lower spray arm 200, the friction between the upper spray arm 100 and the lower spray arm 200 is in a form of rolling friction, instead of sliding friction. This ensures less friction force when the upper spray arm 100 rotates relative to the lower spray arm 200, that is, the rolling friction force has little resistance to the rotation of the spray arm. Therefore, the hydrodynamic loss caused by the friction can be reduced and the utilization of the hydrodynamic power can be improved. At the same time, the rotation of the upper spray arm 100 relative to the lower spray arm 200 is faster, so the arrangement of the first ball assembly 300 is conducive to improving the smoothness during relative rotation of the upper spray arm 100 and the lower spray arm 200, thus helping to reduce the noise of the dishwasher.

In addition, the first ball assembly 300 is arranged between the upper spray arm 100 and the lower spray arm 200 to connect the upper spray arm 100 and the lower spray arm 200 integrally, which, compared with the original form that the upper spray arm 100 and the lower spray arm 200 are separately connected through a buckle, can effectively reduce the height at a position where the upper spray arm 100 is connected to the lower spray arm 200, and reducing a height dimension of the spray arm, saving an inner space of the dishwasher, leaving more space for placement of the tableware, and then increasing the tableware capacity of the dishwasher. For example, the internal loading capacity of the dishwasher can be increased by 10 mm to 40 mm.

The spray arm is connected to the spray arm base 500, the spray arm base 500 is located below the spray arm, and the spray arm is rotatable relative to the spray arm base 500. The arrangement of the spray arm base 500 provides an interface for the connection between the spray arm and the inner liner of the dishwasher. At the same time, the spray arm base 500 may also act as a water intake pipeline of the spray arm. After the water source of the dishwasher is connected, water flows from the spray arm base 500 into the spray arm. In one embodiment, the spray arm base 500 is connected to the lower spray arm 200.

After the water pressure in the lower spray arm 200 reaches a particular value, the lower spray arm 200 begins to spray a water column through the lower spray hole 260 and the first drive hole 211. The lower spray arm 200 rotates around the first direction under the reaction force generated when the water column is sprayed. After the water pressure in the upper spray arm 100 reaches a particular value, the upper spray arm 100 begins to spray a water column through the upper spray hole 160 and the second drive hole 111. The upper spray arm 100 rotates around the second direction under the reaction force generated when the water column is sprayed. The lower spray arm 200 and the upper spray arm 100 may rotate continuously as water columns are constantly sprayed from the spray holes and the drive holes. The water columns sprayed from the spray holes and the drive holes may sprinkle to the tableware surface or the inner walls of the dishwasher along with the rotation of the spray arm, and then wash stains on the tableware or the inner walls of the dishwasher, to complete the cleaning of the tableware by the dishwasher.

Figure 19:
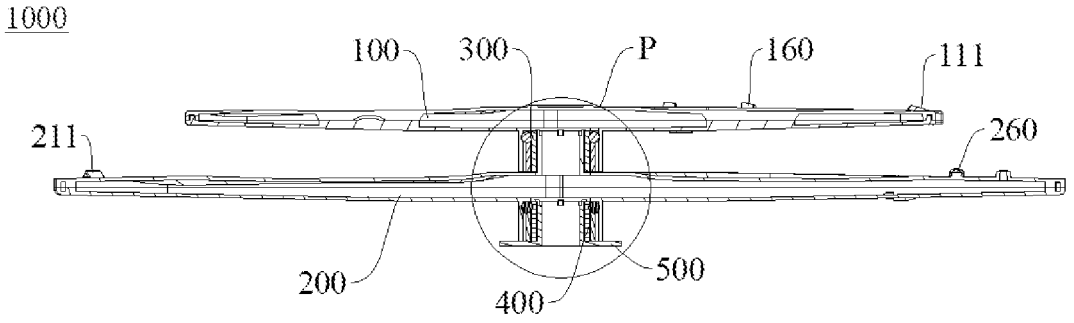
FIG. 19 is a sectional view of the spray arm assembly according to the first embodiment of the present application.

The first ball assembly 400 is arranged at a position where the spray arm is connected to and cooperates with the spray arm base 500. As shown in FIG. 19, the lower spray arm 200 and the spray arm base 500 are indirectly connected through the second ball assembly 400. When the spray arm rotates relative to the spray arm base 500, the friction between the spray arm and the spray arm base 500 is in a form of rolling friction, instead of sliding friction. In this way, the rolling friction force has little resistance to the rotation of the spray arm. Therefore, the hydrodynamic loss caused by the friction can be reduced and the utilization of the hydrodynamic power can be improved. At the same time, the rotation of the spray arm relative to the spray arm base 500 is faster, so the arrangement of the second ball assembly 400 is conducive to improving the smoothness during rotation of the spray arm, thus helping to reduce the noise of the dishwasher.

In addition, the second ball assembly 400 is arranged between the spray arm and the spray arm base 500 to connect the spray arm and the spray arm base 500 integrally, which, compared with the original form that the spray arm and the spray arm base 500 are separately connected through a buckle, can effectively reduce the height at a position where the spray arm is connected to the spray arm base 500, and reducing a height dimension of the spray arm assembly 1000, saving an inner space of the dishwasher, leaving more space for placement of the tableware, and then increasing the tableware capacity of the dishwasher. For example, the internal loading capacity of the dishwasher can be increased by 10 mm to 40 mm.

In the spray arm assembly 1000 according to the embodiment of the present application, the lower spray arm 200 and the upper spray arm 100 are provided, and the number of spray arms is increased, which is conducive to enhancing the cleaning effect of the spray arm on the tableware. Moreover, the lower spray arm 200 is provided with the first drive hole 211, and the upper spray arm 100 is provided with the second drive hole 111, which can ensure that the upper spray arm 100 rotates in an opposite direction relative to the lower spray arm 200, so that the water columns sprayed from the lower spray arm 200 and the upper spray arm 100 produce rubbing force on the tableware, and enhancing the cleaning effect of the spray arm, and ensuring the tableware to be clean. In addition, by arranging the first ball assembly 300 between the upper spray arm 100 and the lower spray arm 200, rolling contact exists between the upper spray arm 100 and the lower spray arm 200, which can thus reduce the friction force between the upper spray arm 100 and the lower spray arm 200, is conducive to reducing the hydrodynamic loss, improving the utilization of the hydrodynamic power, ensuring higher pressure when the water is sprayed from the upper spray hole 160 and the lower spray hole 260, and is conducive to enhancing the cleaning effect of the dishwasher on the tableware. In addition, the arrangement of the spray arm base 500 provides a connection interface for the spray arm. At the same time, the spray arm base 500 may also act as a water intake pipeline of the spray arm. By arranging the second ball assembly 400 between the spray arm and the spray arm base 500, rolling contact exists between the spray arm and the spray arm base 500, which can thus reduce the friction force between the spray arm and the spray arm base 500, is conducive to reducing the hydrodynamic loss, improving the utilization of the hydrodynamic power, ensuring higher pressure when the water is sprayed from the spray hole of the spray arm, and is conducive to enhancing the cleaning effect of the dishwasher on the tableware. At the same time, the upper spray arm 100 and the lower spray arm 200 are connected through the first ball assembly 300, and the spray arm and the spray arm base 500 are connected through the second ball assembly 400, which can effectively reduce a height dimension of the spray arm assembly 1000, thus saving an inner space of the dishwasher, leaving more space for the placement of the tableware, and improving the tableware capacity of the dishwasher.

In some embodiments of the present application, the lower spray arm 200 may include: a lower spray arm upper connecting sleeve 220, a lower spray arm body 230, and a lower spray arm lower connecting sleeve 240. The lower spray arm upper connecting sleeve 220 is arranged on an inner side of the lower spray arm body 230, which facilitates the connection between the upper spray arm 100 and the lower spray arm 200, and ensures that the upper spray arm 100 and the lower spray arm 200 can be reliably integrally connected. The lower spray arm lower connecting sleeve 240 is arranged on a lower side of the lower spray arm body 230, which facilitates the fixing of the lower spray arm 200 to the spray arm base 500.

Figure 20:
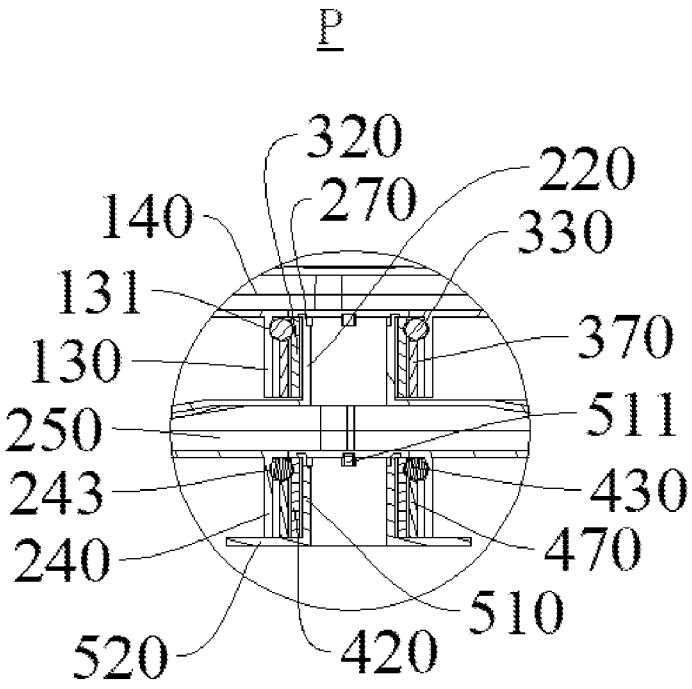
FIG. 20 is a schematic partial enlarged view of P in FIG. 19.

The lower spray arm upper connecting sleeve 220, the lower spray arm body 230, and the lower spray arm lower connecting sleeve 240 are integrally connected, and the lower spray arm upper connecting sleeve 220 and the lower spray arm lower connecting sleeve 240 are both located in the middle of the lower spray arm body 230, which is conducive to ensuring the balance of the spray arm. Referring to FIG. 19 to FIG. 20, the lower spray arm upper connecting sleeve 220, the lower spray arm body 230, and the lower spray arm lower connecting sleeve 240 have a communicated lower chamber 250, the first drive hole 211 is in communication with the lower chamber 250, and the first drive hole 211 is in communication with the lower chamber 250. The lower spray arm upper connecting sleeve 220, the lower spray arm body 230, and the lower spray arm lower connecting sleeve 240 may all be hollow members. Hollow positions of the three members jointly form the lower chamber 250, and the first drive hole 211 is connected to the hollow position of the lower spray arm body 230. Therefore, the first drive hole 211 is in communication with the lower chamber 250.

The spray arm base 500 has a spray arm base chamber 580. The spray arm base chamber 580 is in communication with the lower chamber 250, to ensure that water in the spray arm base 500 can enter the lower spray arm 200. Further, the upper spray arm 100 may include: an upper spray arm body 120 and an upper spray arm connecting sleeve 130. The upper spray arm connecting sleeve 130 is arranged on a lower side of the upper spray arm body 120, which facilitates the connection between the upper spray arm 100 and the lower spray arm 200, and ensures that the upper spray arm 100 and the lower spray arm 200 can be reliably integrally connected.

The upper spray arm body 120 and the upper spray arm connecting sleeve 130 have a communicated upper chamber 140, the second drive hole 111 is in communication with the upper chamber 140, and the upper chamber 140 is further in communication with the lower chamber 250, which can thus ensure water from a water source of the dishwasher can smoothly enter the upper chamber 140 through the spray arm base chamber 580 and the lower chamber 250, and then the water is sprayed to the tableware surface through the water spray holes and the drive holes on the spray arm, to complete the operation of tableware cleaning. As water continues to enter the upper chamber 140 and the lower chamber 250, the water pressure in the upper chamber 140 and the lower chamber 250 increases. In this case, the reaction force produced by the water columns from the first drive hole 211 and the second drive hole 111 is greater, and the upper spray arm 100 and the lower spray arm 200 rotate faster; at the same time, the sprayed water columns beat the tableware with greater force, which is conducive to cleaning stains on the tableware. Therefore, the arrangement of the upper chamber 140 and the lower chamber 250 can ensure sufficient water and a batter washing effect of the dishwasher.

The first ball assembly 300 is arranged at a position where the upper spray arm connecting sleeve 130 is connected to and cooperates with the lower spray arm upper connecting sleeve 220. Thus, when the upper spray arm connecting sleeve 130 and the lower spray arm upper connecting sleeve 220 rotate relative to each other, the first ball assembly 300 may roll, thus reducing the friction force between the upper spray arm connecting sleeve 130 and the lower spray arm upper connecting sleeve 220. At the same time, after the upper spray arm connecting sleeve 130 and the lower spray arm upper connecting sleeve 220 are connected through the first ball assembly 300, height dimensions of the upper spray arm connecting sleeve 130 and the lower spray arm upper connecting sleeve 220 can be reduced, and reducing an overall height dimension of the spray arm, and leaving more space for the placement of the tableware.

In some embodiments of the present application, both the first ball assembly 300 and the second ball assembly 400 include at least a plurality of balls. The plurality of balls of the first ball assembly 300 are arranged at the position where the upper spray arm connecting sleeve 130 is connected to and cooperates with the lower spray arm upper connecting sleeve 220, and the plurality of balls of the second ball assembly 400 are arranged at the position where the lower spray arm 200 is connected to and cooperates with the spray arm base 500.

Further, both the first ball assembly 300 and the second ball assembly 400 further include: a middle sleeve, the middle sleeve is provided with a plurality of ball holes, the balls are mounted in the ball holes, and the balls protrude beyond inner and outer circumferential surfaces of the middle sleeve in a radial direction of the middle sleeve.

In one embodiment, both the first ball assembly 300 and the second ball assembly 400 further include: an inner sleeve, the inner sleeve is arranged on inner sides of the balls, and an outer circumferential surface of the inner sleeve is provided with an inner sleeve ball groove configured to cooperate with the balls.

Further, both the first ball assembly 300 and the second ball assembly 400 further include: an outer sleeve, the outer sleeve is arranged on outer sides of the balls, and an inner circumferential surface of the outer sleeve is provided with an outer sleeve ball groove configured to cooperate with the balls.

In the embodiments shown in FIG. 19 to FIG. 23, any of the first ball assembly 300 and the second ball assembly 400 includes: a middle sleeve, balls, and an inner sleeve. The middle sleeve is provided with a plurality of ball holes, the balls are mounted in the ball holes, and the balls protrude beyond inner and outer circumferential surfaces of the middle sleeve in a radial direction of the middle sleeve. The inner sleeve is arranged on an inner side of the middle sleeve, and an outer circumferential surface of the inner sleeve is provided with an inner sleeve ball groove configured to cooperate with the balls.

In one embodiment, the diameter of the balls is 3 mm to 8 mm, the number of the balls in each ball assembly is 4 to 12, and the number of the balls in each ball assembly is an even number, which ensures the force balance of each ball assembly and alleviates the stress concentration.

The structures of the first ball assembly 300 and the second ball assembly 400 are introduced below in detail with reference to FIG. 19 to FIG. 23 and are illustrated with an example in which the upper spray arm connecting sleeve 130 is fitted over an outer side of the lower spray arm upper connecting sleeve 220 and the lower spray arm lower connecting sleeve 240 is fitted over an outer side of the spray arm base 500.

Figure 21:
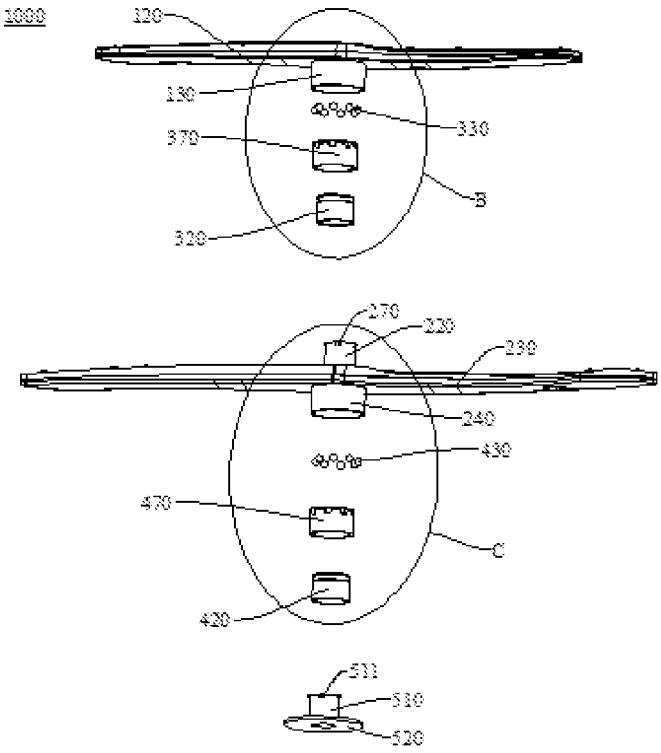
FIG. 21 is an exploded view of the spray arm assembly.
Figure 22:
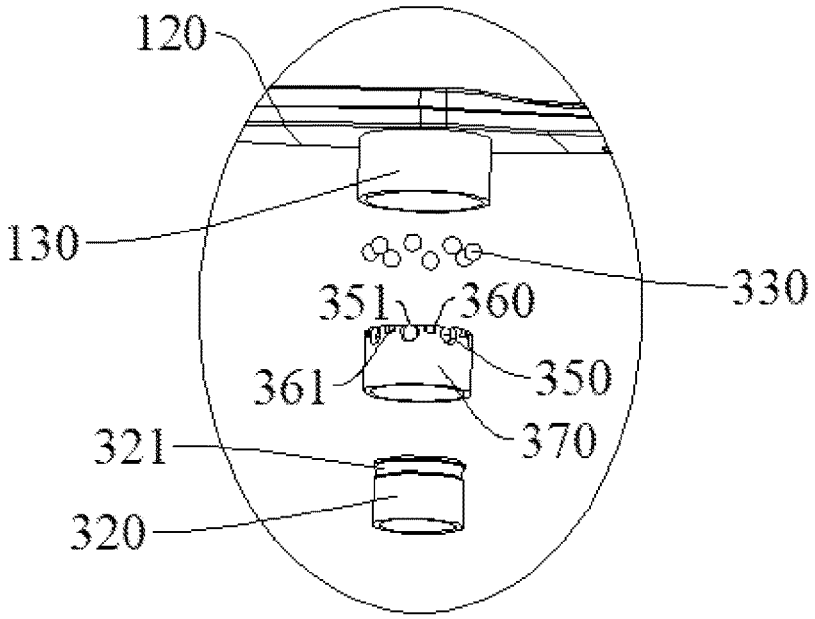
FIG. 22 is a schematic partial enlarged view of B in FIG. 21.

In one embodiment, as shown in FIG. 20 to FIG. 22, the first ball assembly 300 includes: a first middle sleeve 370, first balls 330, and a first inner sleeve 320. The first inner sleeve 320 is arranged on an inner side of the first middle sleeve 370, the first middle sleeve 370 is provided with a plurality of first ball holes 350, and the first balls 330 are mounted in the first ball holes 350. The first ball holes 350 provide support for the fixing of the first balls 330, which ensures that relative positions of the plurality of balls 330 are unchanged, and prevents collision and extrusion between the plurality of balls 330, thus improving the operation stability of the first ball assembly 300.

The first balls 330 are in rolling contact with an inner surface of the upper spray arm connecting sleeve 130, and the first balls 330 are in rolling contact with an outer surface of the first inner sleeve 320. At least a part of the lower spray arm upper connecting sleeve 220 is arranged inside the first inner sleeve 320, and the first inner sleeve 320 is fixedly connected to the lower spray arm upper connecting sleeve 220. Therefore, the upper spray arm 100 and the lower spray arm 200 are indirectly connected through the first ball assembly 300. The structure in which the upper spray arm 100, the lower spray arm 200, and the first ball assembly 300 are connected is simple and stable.

The first balls 330 protrude beyond inner and outer circumferential surfaces of the first middle sleeve 370 in a radial direction of the first middle sleeve 370. In other words, the diameter of the first balls 330 is greater than a wall thickness of the first middle sleeve 370. Outer sides of the first balls 330 protrude outwards beyond the outer circumferential surface of the first middle sleeve 370, and inner sides of the first balls 330 protrude inwards beyond the inner circumferential surface of the first middle sleeve 370.

An outer circumferential surface of the first inner sleeve 320 is provided with a first inner sleeve ball groove 321 configured to cooperate with the first balls 330. An inner circumferential surface of the upper spray arm connecting sleeve 130 is provided with an upper spray arm ball groove 131 configured to cooperate with the first balls 330. The first balls 330 are in rolling contact with both the first inner sleeve ball groove 321 and the upper spray arm ball groove 131. Also, since the first inner sleeve 320 is fixedly connected to the lower spray arm upper connecting sleeve 220, when the lower spray arm 200 and the upper spray arm 100 rotate relative to each other, the upper spray arm connecting sleeve 130 and the lower spray arm upper connecting sleeve 220 are in rolling contact, with less friction force.

The upper spray arm ball groove 131 and the first inner sleeve ball groove 321 are both circumferential annular groves, which can ensure the smooth rotation of the upper spray arm 100 in the whole circle. In a specific embodiment, diameters of the upper spray arm ball groove 131 and the first inner sleeve ball groove 321 may be equal to the diameter of the first balls 330, or may be slightly larger than the diameter of the first balls 330, to ensure that the first balls 330 well cooperate with the upper spray arm ball groove 131 and the first inner sleeve ball groove 321.

The positions of the upper spray arm ball groove 131, the first inner sleeve ball groove 321, and the first ball holes 350 corresponding to each other in a central axis direction of the upper spray arm connecting sleeve 130 can prevent impossible rotation of the upper spray arm 100 caused by extrusion of the first balls 330 due to a sliding trajectory thereof being different from trajectories of the upper spray arm ball groove 131 and the first inner sleeve ball groove 321 during rotation of the upper spray arm 100.

Figure 26:
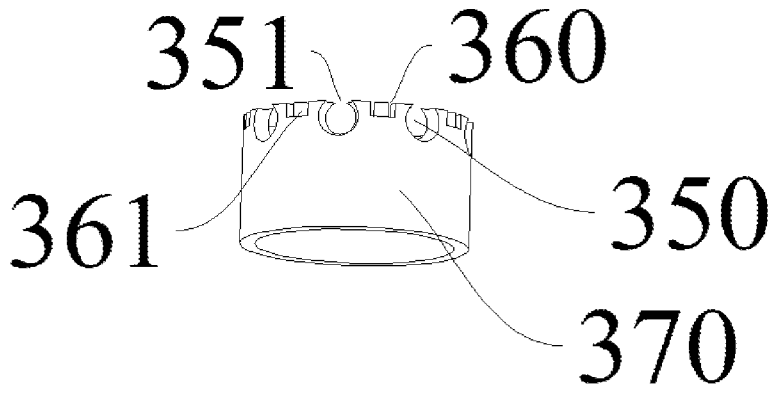
FIG. 26 is a schematic three-dimensional view of a first middle sleeve.

In one embodiment, the first ball holes 350 are arranged at the top of the first middle sleeve 370. Referring to FIG. 26, the first ball holes 350 are major-arc holes, and first ball fetching ports 351 are formed at top notches of the first ball holes 350. The first balls 330 enter the first ball holes 350 or come out of the first ball holes 350 through the first ball fetching ports 351, thus facilitating the mounting and removal of the first balls 330 in the first ball holes 350.

The major-arc holes are holes with a center angle greater than 180° and less than 360°, so that most of each first ball 330 can be located in the first ball holes 350, to prevent the first balls 330 from falling off from the first ball holes 350 after mounting. During the mounting of the first balls 330, the first ball fetching ports 351 can be opened with external force, then the first balls 330 are mounted in the first ball holes 350 through the first ball fetching ports 351, the external force is removed, elastic deformation of the first ball holes 350 disappears accordingly, and the first ball holes 350 reconvert. In this case, the first ball holes 350 tightly wrap the first balls 330, making the mounting of the first balls 330 in the first ball holes 350 firmer and more reliable.

In one embodiment, a first weakening groove 360 is arranged between two adjacent first ball holes 350. With the arrangement of the first weakening groove 360, the stiffness between the two adjacent first ball holes 350 can be reduced. Therefore, when the first balls 330 are mounted, the first ball holes 350 are easy to deform, which reduces the difficulty of mounting or removing the first balls 330. The first weakening groove 360 is provided with a first weakening groove post 361, and the first weakening groove post 361 can play a strengthening role, to prevent the first weakening groove 360 from excessively weakening the stiffness of the first middle sleeve 370, which is conducive to improving the operation reliability of the first ball assembly 300.

In some unillustrated embodiments, the first ball holes 350 are arranged at the bottom of the first middle sleeve 370. Referring to FIG. 26, the first ball holes 350 are major-arc holes, and first ball fetching ports 351 are formed at top notches of the first ball holes 350.

In some other unillustrated embodiments, the first ball holes 350 may be further arranged in middle positions of the first middle sleeve 370. In this case, the first ball holes 350 are round holes running through a wall thickness of the first middle sleeve 370.

In some embodiments, the lower spray arm 200 and the upper spray arm 100 are detachably connected.

Referring to FIG. 19 to FIG. 21, the top of the lower spray arm upper connecting sleeve 220 has a lower spray arm buckle 270. The lower spray arm buckle 270 is configured to clamp an upper surface of the inner sleeve of the first ball assembly 300, that is, the lower spray arm buckle 270 is configured to clamp an upper surface of the first inner sleeve 320. Thus, the lower spray arm 200 and the first inner sleeve 320 can be ensured to be reliably integrally connected, and it is convenient to connect and disconnect the lower spray arm 200 to and from the upper spray arm 100, to facilitate the disassembly of the spray arm 1000.

A top end of the lower spray arm upper connecting sleeve 220 is provided with a plurality of lower spray arm grooves, an opening direction of the lower spray arm grooves is parallel to an axis direction of the lower spray arm upper connecting sleeve 220, the lower spray arm buckle 270 extends upwards from a bottom wall of the lower spray arm grooves, and two sides of the lower spray arm buckle 270 are separated from two sidewalls of the lower spray arm grooves, which can thus ensure that the lower spray arm buckle 270 can elastically deform in the lower spray arm grooves. A top end of the lower spray arm buckle 270 is provided with a hook toward the first inner sleeve 320. The hook is configured to hook a top end of the first inner sleeve 320, to limit relative axial positions of the lower spray arm 200 and the first inner sleeve 320.

When the first inner sleeve 320 is assembled with the lower spray arm 200, an inner circumferential surface of the first inner sleeve 320 extrudes the hook of the lower spray arm buckle 270 to make the lower spray arm buckle 270 deform toward the interior of the lower spray arm upper connecting sleeve 220, to ensure that the lower spray arm buckle 270 can reach the top end of the first inner sleeve 320 from a bottom end of the first inner sleeve 320 (i.e. from the bottom to the top). When the lower spray arm buckle 270 crosses the top end of the first inner sleeve 320, extrusion force on the lower spray arm buckle 270 disappears. Under the action of the elastic force of the lower spray arm buckle 270, the lower spray arm buckle 270 approaches the first inner sleeve 320, to cause the hook to hook the top end of the first inner sleeve 320.

When the first inner sleeve 320 needs to be separated from the lower spray arm 200, it is only necessary to lift the upper spray arm 100 upwards by force, the top end of the first inner sleeve 320 extrudes the hook, making the hook withdraw inside the first inner sleeve 320, and the first inner sleeve 320 can be separated from the lower spray arm 200 by continuously lifting the spray arm 100.

A plurality of (e.g., four) lower spray arm buckles 270 may be provided. The lower spray arm grooves one-to-one correspond to the lower spray arm buckles 270, and the plurality of lower spray arm buckles 270 are evenly distributed along a circumferential direction of the lower spray arm upper connecting sleeve 220, to improve the clamping stability between the lower spray arm buckles 270 and the first inner sleeve 320.

In addition to the above clamping form, the detachable connection manner between the lower spray arm upper connecting sleeve 220 and the first inner sleeve 320 may also be a threaded connection. In some unillustrated embodiments, the first inner sleeve 320 of the first ball assembly 300 has inner sleeve threads, the lower spray arm upper connecting sleeve 220 has lower spray arm upper threads, and the lower spray arm upper threads are screwed with the inner sleeve threads, to implement a detachable connection between the lower spray arm upper connecting sleeve 220 and the first inner sleeve 320. When the inner sleeve threads and the lower spray arm upper threads are unscrewed, the lower spray arm upper connecting sleeve 220 and the first inner sleeve 320 can be disassembled. The lower spray arm upper connecting sleeve 220 and the first inner sleeve 320 are connected by thread, which are easy to assemble and disassemble and reliable to connect.

In some embodiments, as shown in FIG. 14, the lower spray arm upper connecting sleeve 220 is in interference fit with the first inner sleeve 320 of the first ball assembly 300.

In some embodiments, as shown in FIG. 14, the upper spray arm connecting sleeve 130 is in interference fit with the first outer sleeve 310 of the first ball assembly 300, to implement the connection between the upper spray arm 100 and the first ball assembly 300; or In some unillustrated embodiments, the first outer sleeve 310 of the first ball assembly 300 has outer sleeve threads, the upper spray arm connecting sleeve 130 has upper spray arm threads, and the upper spray arm threads are screwed with the outer sleeve threads, to implement the connection between the upper spray arm 100 and the first ball assembly 300.

Figure 23:
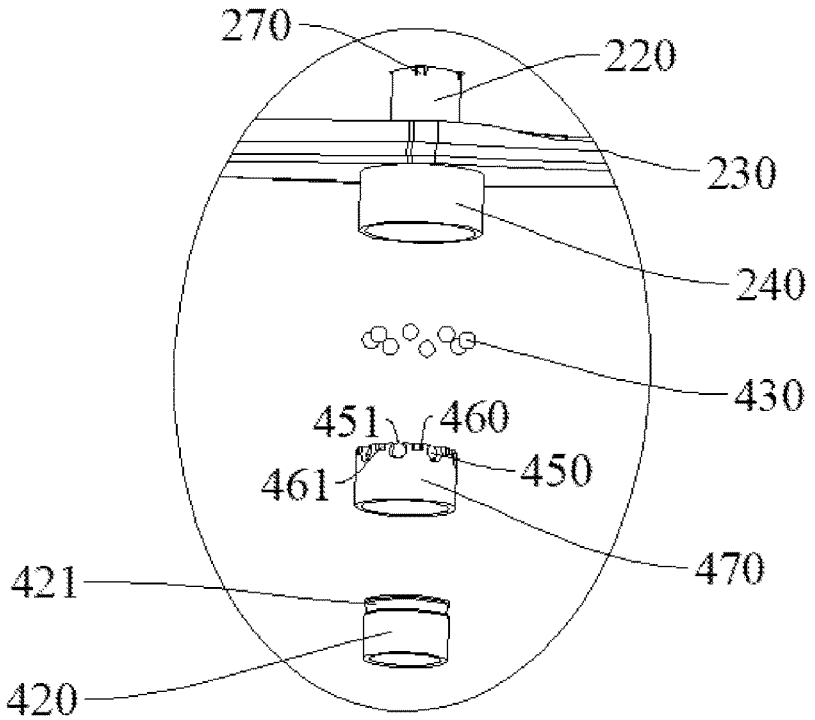
FIG. 23 is a schematic partial enlarged view of C in FIG. 21.

The second ball assembly 400 and the first ball assembly 300 are similar in structure. As shown in FIG. 20 to FIG. 21 and FIG. 23, the second ball assembly 400 includes: a second middle sleeve 470, second balls 430, and a second inner sleeve 420. The second inner sleeve 470 is provided with a plurality of second ball holes 450, and the second balls 430 are mounted in the second ball holes 450. The second ball holes 450 provide support for the fixing of the second balls 430, which ensures that relative positions of the plurality of second balls 430 are unchanged, and prevents collision and extrusion between the plurality of second balls 430, thus improving the operation stability of the first ball assembly 300. Moreover, the second balls 430 protrude beyond inner and outer circumferential surfaces of the second middle sleeve 470 in a radial direction of the second middle sleeve 470. The second inner sleeve 420 is arranged on an inner side of the second middle sleeve 470, and an outer circumferential surface of the second inner sleeve 420 is provided with a second inner sleeve ball groove 421 configured to cooperate with the second balls 430. An inner circumferential surface of the lower spray arm lower connecting sleeve 240 is provided with a lower spray arm ball groove 243 configured to cooperate with the second balls 430. When the lower spray arm 200 rotates relative to the spray arm base 500, the second balls 430 come into rolling contact with the second inner sleeve ball groove 421 and the lower spray arm ball groove 243, with less friction force, which is conducive to improving the smoothness of rotation of the spray arm and reducing the noise of the spray arm assembly 1000.

The lower spray arm ball groove 243 and the second inner sleeve ball groove 421 are both circumferential annular groves, which can ensure the smooth rotation of the lower spray arm 200 in the whole circle. Diameters of the lower spray arm ball groove 243 and the second inner sleeve ball groove 421 may be equal to the diameter of the second balls 430, or may be slightly larger than the diameter of the second balls 430, to ensure that the second balls 430 well cooperate with the lower spray arm ball groove 243 and the second inner sleeve ball groove 421.

The lower spray arm 200 and the spray arm base 500 are detachably connected.

Referring to FIG. 19 to FIG. 21, the spray arm base 500 includes: a spray arm base body 510. The top of the spray arm base body 510 has a spray arm base buckle 511. The spray arm base buckle 511 is configured to clamp a top end of the inner sleeve of the second ball assembly 400, that is, the spray arm base buckle 511 is configured to clamp a top end of the second inner sleeve 420, to implement a fixed connection between the spray arm base buckle 511 and the second inner sleeve 420. The spray arm base 500 and the lower spray arm 200 are indirectly connected through the second ball assembly 400. The structure in which the spray arm base 500, the lower spray arm 200, and the second ball assembly 400 are connected is simple and stable.

A top end of the spray arm base body 510 is provided with a plurality of spray arm base grooves, an opening direction of the spray arm base grooves is parallel to an axis direction of the spray arm base body 510, the spray arm base buckle 511 extends upwards from a bottom wall of the spray arm base grooves, and two sides of the spray arm base buckle 511 are separated from two sidewalls of the spray arm base grooves, which can thus ensure that the spray arm base buckle 511 can elastically deform in the spray arm base grooves. A top end of the spray arm base buckle 511 is provided with a hook toward the second inner sleeve 420. The hook is configured to hook a top end of the second inner sleeve 420, to limit relative axial positions of the spray arm base 500 and the second inner sleeve 420.

When the second inner sleeve 420 is assembled with the spray arm base 500, an inner circumferential surface of the second inner sleeve 420 extrudes the hook of the spray arm base buckle 511 to make the spray arm base buckle 511 deform toward the interior of the spray arm body 510, to ensure that the spray arm base buckle 511 can reach the top end of the second inner sleeve 420 from a bottom end of the second inner sleeve 420 (i.e. from the bottom to the top). When the spray arm base buckle 511 crosses the top end of the second inner sleeve 420, extrusion force on the spray arm base buckle 511 disappears. Under the action of the elastic force of the spray arm base buckle 511, the spray arm base buckle 511 approaches the second inner sleeve 420, to cause the hook to hook the top end of the second inner sleeve 420.

When the second inner sleeve 420 needs to be separated from the spray arm base 500, it is only necessary to lift the lower spray arm 200 upwards by force, the top end of the second inner sleeve 420 extrudes the hook, making the hook withdraw inside the second inner sleeve 420, and the second inner sleeve 420 can be separated from the spray arm base 500 by continuously lifting the lower spray arm 200.

A plurality of (e.g., four) spray arm base buckles 511 may be provided. The spray arm base grooves one-to-one correspond to the spray arm base buckles 511, and the plurality of spray arm base buckles 511 are evenly distributed along a circumferential direction of the spray arm base body 510, to improve the clamping stability between the spray arm base buckles 511 and the second inner sleeve 420.

Further, the spray arm base 500 further includes: a spray arm base flange 520. The spray arm base flange 520 extends outwards along a radial direction of the spray arm base body 510, which is conducive to improving the stability of the connection between the spray arm assembly 1000 and the inner liner of the dishwasher. The second ball assembly 400 is arranged above the spray arm base flange 520. Gaps between lower surface of the lower spray arm lower connecting sleeve 240 and the second ball assembly 400 and an upper surface of the spray arm base flange 520 are both L1. L1 satisfies a relation: 0 mm<L1≤1 mm. That is, gaps between lower surfaces of the lower spray arm lower connecting sleeve 240, the second middle sleeve 470, and the second inner sleeve 420 and the upper surface of the spray arm base flange 520 are L1. L1 may be 0.3 mm, 0.5 mm or 0.8 mm. Therefore, when the lower spray arm 200 and the spray arm base 500 rotate relative to each other, sliding friction caused by contact between the lower surfaces of the lower spray arm lower connecting sleeve 240, the second middle sleeve 470, and the second inner sleeve 420 and the upper surface of the spray arm base flange 520 can be prevented, and the increase of the friction force between the lower spray arm 200 and the spray arm base 500 or even the jam of the lower spray arm 200 caused by the entry of leftovers or other contaminants into the gaps can be prevented. When the lower spray arm 200 tilts, the lower spray arm lower connecting sleeve 240 may quickly contact the spray arm base 500, to avoid further tilt of the lower spray arm 200.

In addition to the above clamping form, the detachable connection manner between the spray arm base body 510 and the second inner sleeve 420 may also be a threaded connection. In some unillustrated embodiments, the second inner sleeve 420 of the second ball assembly 400 has inner sleeve threads, the spray arm base 500 has spray arm base threads, and the spray arm base threads are screwed with the inner sleeve threads, to implement the detachable connection between the spray arm base body 510 and the second inner sleeve 420. When the spray arm base threads and the inner sleeve threads are unscrewed, the spray arm base body 510 and the second inner sleeve 420 can be disassembled. The spray arm base body 510 and the second inner sleeve 420 are connected by thread, which are easy to assemble and disassemble and reliable to connect.

Figure 27:
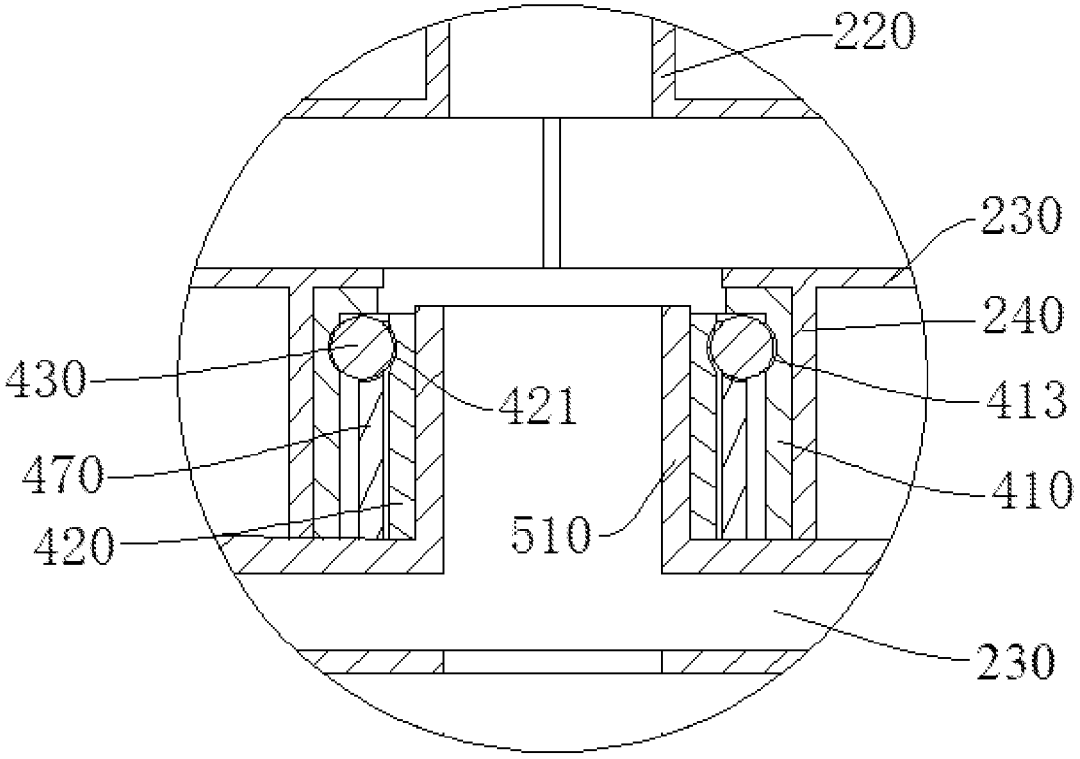
FIG. 27 is a schematic view of a transformed example of a second ball assembly.

In some embodiments, as shown in FIG. 27, the spray arm base 500 is in interference fit with the second inner sleeve 420 of the second ball assembly 400.

Figure 24:
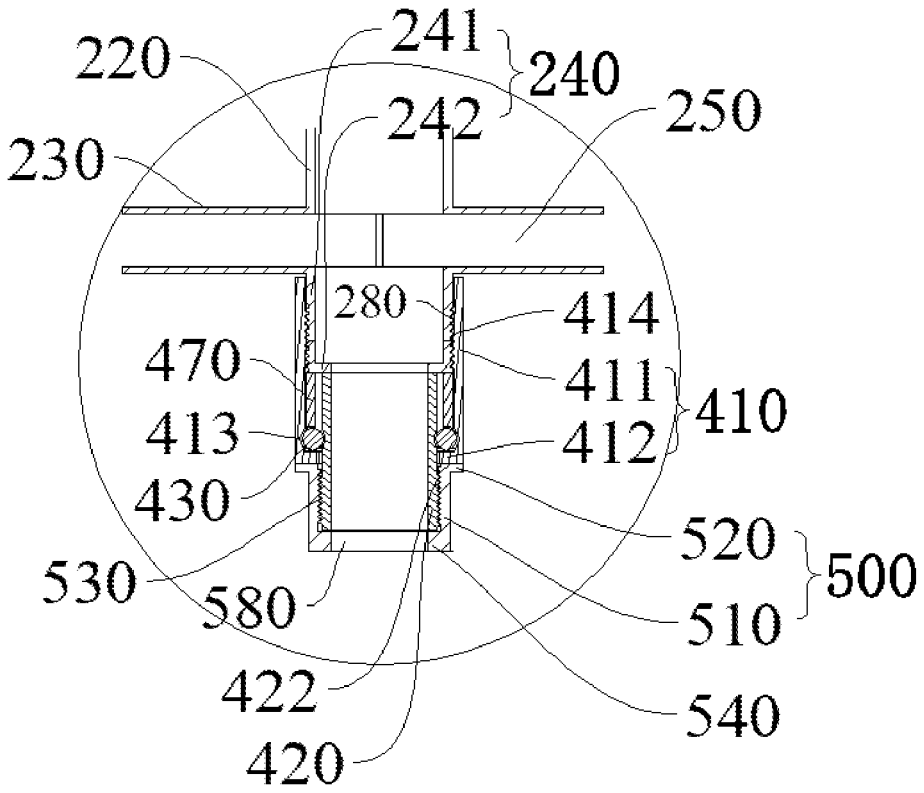
FIG. 24 is a schematic view of a spray arm assembly according to a second embodiment of the present application.
Figure 25:
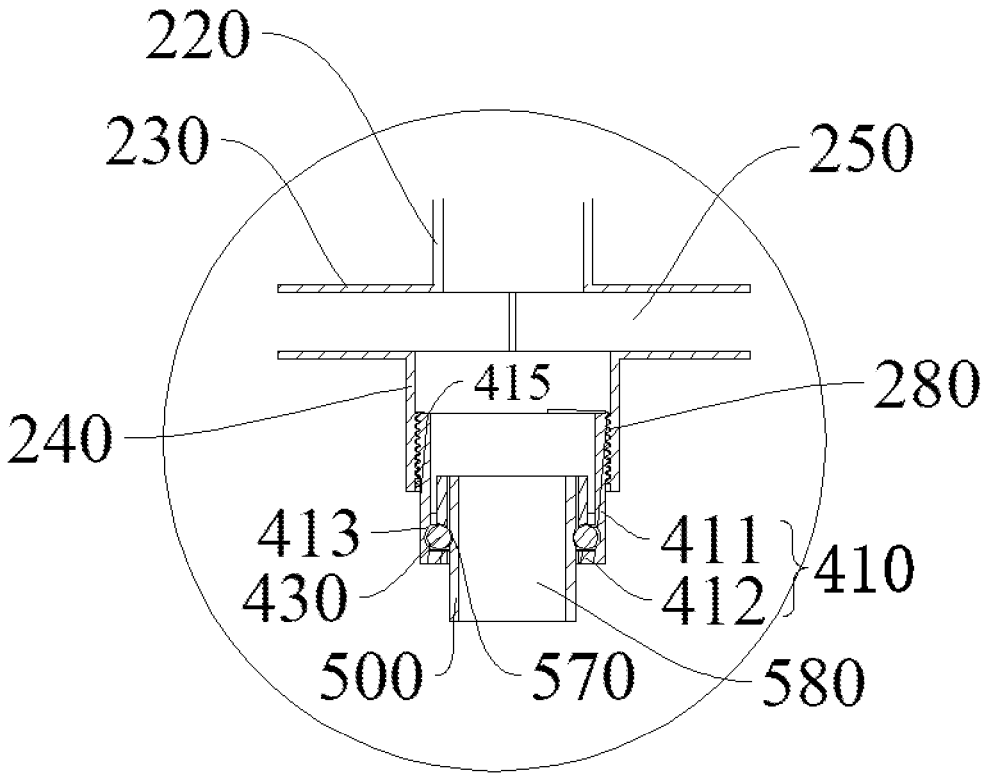
FIG. 25 is a schematic view of a spray arm assembly according to a third embodiment of the present application.

In some embodiments, as shown in FIG. 14 or FIG. 27, the lower spray arm connecting sleeve 240 is in interference fit with the second outer sleeve 410 of the second ball assembly 400; or in some embodiments, as shown in FIG. 24 or FIG. 25, the second outer sleeve 410 of the second ball assembly 400 has outer sleeve threads, the lower spray arm connecting sleeve 240 has lower spray arm lower threads, and the lower spray arm lower threads are screwed with the outer sleeve threads. In one embodiment, the second ball holes 450 are arranged at the top of the second middle sleeve 470. The second ball holes 450 are major-arc holes, and second ball fetching ports 451 are formed at top notches of the second ball holes 450. The second balls 430 enter the second ball holes 450 or come out of the second ball holes 450 through the second ball fetching ports 451, thus facilitating the mounting and removal of the second balls 430 in the second ball holes 450. Most of each second ball 430 can be located in the second ball holes 450, to prevent the second balls 430 from falling off from the second ball holes 450 after mounting.

In one embodiment, a second weakening groove 460 is arranged between two adjacent second ball holes 450, and the second weakening groove 460 is provided with a second weakening groove post 461. The structure of the second middle sleeve 470 may be the same as that of the first middle sleeve 370.

In some unillustrated embodiments, the second ball holes 450 may also be arranged at the bottom of the second middle sleeve 470.

In some other unillustrated embodiments, the second ball holes 450 may be further arranged in middle positions of the second middle sleeve 470. In this case, the second ball holes 450 are round holes running through a wall thickness of the second middle sleeve 470. In the embodiments illustrated in FIG. 14 to FIG. 27, the first ball assembly 300 and the second ball assembly 400 may also adopt the following structure:

any of the first ball assembly 300 and the second ball assembly 400 includes:

an outer sleeve, an inner sleeve, a middle sleeve, and balls. The inner sleeve is arranged inside the outer sleeve, the middle sleeve is arranged between the outer sleeve and the inner sleeve, the middle sleeve is provided with a plurality of ball holes, the balls are mounted in the ball holes, and the balls protrude beyond inner and outer circumferential surfaces of the middle sleeve in a radial direction of the middle sleeve.

In one embodiment, the first ball assembly 300 includes: a first outer sleeve 310, a first middle sleeve 370, first balls 330, and a first inner sleeve 320. The first inner sleeve 320 is arranged inside the first outer sleeve 310, the first middle sleeve 370 is arranged between the first outer sleeve 310 and the first inner sleeve 320, the first middle sleeve 370 is provided with a plurality of first ball holes 350, the first balls 330 are mounted in the first ball holes 350, and the first balls 330 protrude beyond inner and outer circumferential surfaces of the first middle sleeve 370 in a radial direction of the first middle sleeve 370. An outer circumferential surface of the first inner sleeve 320 is provided with a first inner sleeve ball groove 321 configured to cooperate with the first balls 330, and an inner circumferential surface of the upper spray arm connecting sleeve 130 fits an outer circumferential surface of the first outer sleeve 310. In one embodiment, the upper spray arm connecting sleeve 130 is in interference fit with the first outer sleeve 310, to improve the firmness of the connection between the first ball assembly 300 and the upper spray arm 100. An inner circumferential surface of the first outer sleeve 310 is provided with a first outer sleeve ball groove 313 configured to cooperate with the first balls 330. The first balls 330 are used to directly cooperate with the first inner sleeve 320 and the first outer sleeve 310, which can also implement a rolling connection between the upper spray arm connecting sleeve 130 and the lower spray arm upper connecting sleeve 220. The first outer sleeve ball groove 313 and the first inner sleeve ball groove 321 are both circumferential annular groves, which can implement relative rotation of the upper spray arm 100 and the lower spray arm 200 in the whole circle.

When the upper spray arm connecting sleeve 130 and the lower spray arm upper connecting sleeve 220 rotate relative to each other, the first outer sleeve 310 and the first inner sleeve 320 implement relative rotation through the first balls 330. The friction force between the upper spray arm 100 and the lower spray arm 200 is equivalent to rolling friction force, which is conducive to reducing the hydrodynamic loss.

In this case, the first ball assembly 300 is a complete member and can be supplied separately without changing the upper spray arm connecting sleeve 130 and the lower spray arm upper connecting sleeve 220, so that the assembly of the first ball assembly 300 with the upper spray arm connecting sleeve 130 and the lower spray arm upper connecting sleeve 220 can be completed, which is conducive to reducing processing procedures of the spray arm assembly 1000. The first ball assembly 300 is an independent modular member, which is convenient to mount and remove and also reduces the processing cost of the lower spray arm 200 or the upper spray arm 100.

The second ball assembly 400 includes: a second outer sleeve 410, a second middle sleeve 470, second balls 430, and a second inner sleeve 420. The second inner sleeve 420 is arranged inside the second outer sleeve 410, the second middle sleeve 470 is arranged between the second outer sleeve 410 and the second inner sleeve 420, the second middle sleeve 470 is provided with a plurality of second ball holes 450, the second balls 430 are mounted in the second ball holes 450, and the second balls 430 protrude beyond inner and outer circumferential surfaces of the second middle sleeve 470 in a radial direction of the second middle sleeve 470. An outer circumferential surface of the second inner sleeve 420 is provided with a second inner sleeve ball groove 421 configured to cooperate with the second balls 430, and an inner circumferential surface of the lower spray arm lower connecting sleeve 240 fits an outer circumferential surface of the second outer sleeve 410. In one embodiment, the lower spray arm lower connecting sleeve 240 is in interference fit with the second outer sleeve 410, to improve the firmness of the connection between the second ball assembly 400 and the upper spray arm 200. An inner circumferential surface of the second outer sleeve 410 is provided with a second outer sleeve ball groove 413 configured to cooperate with the second balls 430. The second balls 430 are used to directly cooperate with the second inner sleeve 420 and the second outer sleeve 410, which can also implement a rolling connection between the lower spray arm lower connecting sleeve 240 and the spray arm base body 510. The second outer sleeve ball groove 413 and the second inner sleeve ball groove 421 are both circumferential annular groves, which can implement relative rotation of the lower spray arm 200 and the spray arm base 500 in the whole circle.

When the lower spray arm lower connecting sleeve 240 and the spray arm base body 510 rotate relative to each other, the second outer sleeve 410 and the second inner sleeve 420 implement relative rotation through the second balls 430. The friction force between the lower spray arm 200 and the spray arm base 500 is equivalent to rolling friction force, which is conducive to reducing the hydrodynamic loss.

In this case, the second ball assembly 400 is a complete member and can be supplied separately without changing the lower spray arm lower connecting sleeve 240 and the spray arm base body 510, so that the assembly of the second ball assembly 400 with the lower spray arm lower connecting sleeve 240 and the spray arm base body 510 can be completed, which is conducive to reducing processing procedures of the spray arm assembly 1000.

The first middle sleeve 370 and the second middle sleeve 470 mainly have following three functions: (1) each middle sleeve is provided with ball holes, and the balls are mounted in the ball holes, so that positions of the balls can be fixed and limited to prevent the accumulation of the balls; (2) they play a role of isolating food residue, to prevent the food residue from entering the ball groove to cause friction; and (3) they play a strengthening role and can isolate the vibration between the upper spray arm 100 and the lower spray arm 200 as well as between the lower spray arm 200 and the spray arm base 500 to prevent serious shaking of the spray arm.

Referring to FIG. 24 to FIG. 25, in some embodiments of the present application, the lower spray arm 200 has lower spray arm threads 280, and the second ball assembly 400 includes: a bearing base and second balls 430. The second balls 430 are rotatably arranged on the bearing base. The bearing base is provided with base threads cooperating with the lower spray arm threads 280.

According to an embodiment illustrated in FIG. 24 of the present application, the bearing base may include: a second outer sleeve 410, a second middle sleeve 470, and a second inner sleeve 420.

An inner circumferential surface of the second outer sleeve 410 is provided with a second outer sleeve ball groove 413 configured to cooperate with the second balls 430. The second middle sleeve 470 is arranged on an inner side of the second outer sleeve 410. The second balls 430 are arranged on the second middle sleeve 470. The second inner sleeve 420 is arranged on an inner side of the second middle sleeve 470, and an outer circumferential surface of the second inner sleeve 420 is provided with a second inner sleeve ball groove 421 configured to cooperate with the second balls 430. That is, the second balls 430 are in rolling contact with an inner surface of the second outer sleeve 410 and are also in rolling contact with an outer surface of the second inner sleeve 420. The second inner sleeve ball groove 421 and the second outer sleeve ball groove 413 are both circumferential annular groves, which can thus ensure the smooth rotation of the lower spray arm 200 in the whole circle. The second balls 430 are in rolling contact with the second inner sleeve ball groove 421 and the second outer sleeve ball groove 413, with less friction force. In a specific embodiment, diameters of the second inner sleeve ball groove 421 and the second outer sleeve ball groove 413 may be equal to the diameter of the second balls 430, or may be slightly larger than the diameter of the second balls 430, to ensure that the second balls 430 well cooperate with the second inner sleeve ball groove 421 and the second outer sleeve ball groove 413.

Further, referring to FIG. 24, in a central axis direction of the lower spray arm lower connecting sleeve 240, positions of the second outer sleeve ball groove 413, the second inner sleeve ball groove 421, and the second ball holes 450 correspond to each other, the second balls 430 are partially arranged in the second ball holes 450, outer sides of the second balls 430 are in contact with the second outer sleeve ball groove 413, and inner sides of the second balls 430 are in contact with the second inner sleeve ball groove 421, to complete the connection between the second outer sleeve 410 and the second inner sleeve 420. The positions of the second outer sleeve ball groove 413, the second inner sleeve ball groove 421, and the second ball holes 450 corresponding to each other can prevent impossible rotation of the lower spray arm 200 caused by extrusion of the second balls 430 due to a sliding trajectory thereof being different from trajectories of the second outer sleeve ball groove 413 and the second inner sleeve ball groove 421 during rotation of the upper spray arm 200.

Further, an outer circumferential surface of the second inner sleeve 420 is provided with second inner sleeve threads 422, and an inner circumferential surface of the spray arm base 500 is provided with spray arm base threads 530 configured to cooperate with the second inner sleeve threads 422. That is, the spray arm base 500 and the second inner sleeve 420 are fixedly connected by screwing, which are easy to assemble and disassemble and reliable to connect.

In one embodiment, the base threads are second outer sleeve internal threads 414 on the inner circumferential surface of the second outer sleeve 410, the lower spray arm threads 280 are lower spray arm external threads arranged on an outer circumferential surface of the lower spray arm lower connecting sleeve 240, and the lower spray arm external threads are configured to cooperate with the second outer sleeve internal threads 414. That is, the lower spray arm 200 and the second outer sleeve 410 are fixedly connected by screwing, which are easy to assemble and disassemble and reliable to connect.

The lower spray arm 200 and the spray arm base 500 are indirectly connected through the second ball assembly 400. The structure in which the lower spray arm 200, the spray arm base 500, and the second ball assembly 400 are connected is simple and stable.

When the lower spray arm 200 rotates relative to the spray arm base 500, the second balls 430 roll, so that the second outer sleeve 410 and the second inner sleeve 420 rotate relative to each other. Besides, since the lower spray arm 200 is fixed to the second outer sleeve 410 and the spray arm base 500 is fixed to the second inner sleeve 420, relative rotation of the lower spray arm 200 and the spray arm base 500 is implemented.

In one embodiment, the second inner sleeve external threads 422 are located below the second inner sleeve ball groove 421. In other words, the position where the second inner sleeve 420 cooperates with the lower spray arm 200 is located above, and the position where the second inner sleeve 420 is fixed to the spray arm base 500 is located below, so that the height space of the second ball assembly 400 can be fully utilized, avoiding a large axial size at a position where the lower spray arm 200 is connected to the spray arm base 500.

The second middle sleeve 470 is provided with a plurality of second ball holes 450. The second balls 430 are rotatably mounted in the second ball holes 450, and the second ball hole 450 provide support for the fixing of the second balls 430, which ensures that relative positions of the plurality of second balls 430 are unchanged, and prevents collision and extrusion between the plurality of second balls 430, thus improving the operation stability of the second ball assembly 400, to further improve the smoothness during rotation of the spray arm. In one embodiment, the number of the second balls 430 is the same as that of the second ball holes 450.

A plurality of second balls 430 are provided, and the plurality of second balls 430 are evenly distributed along a circumferential direction of the second middle sleeve 470, so that the relative rotation of the lower spray arm 200 and the spray arm base 500 can be more stable.

The second balls 430 protrude beyond inner and outer circumferential surfaces of the second middle sleeve 470 in a radial direction of the second middle sleeve 470, and the second balls 430 are in rolling contact with both the second outer sleeve 410 and the second inner sleeve 420. Besides, since the second outer sleeve 410 is fixed to the lower spray arm lower connecting sleeve 240 and the second inner sleeve 420 is fixed to the spray arm base 500, the lower spray arm 200 and the spray arm base 500 are indirectly connected through the second ball assembly 400, that is, rolling contact also exists between the lower spray arm 200 and the spray arm base 500. The second balls 430 provide support for the connection between the lower spray arm 200 and the spray arm base 500.

When the lower spray arm 200 rotates relative to the spray arm base 500, the second outer sleeve 410 and the second inner sleeve 420 come into contact through the second balls 430. Therefore, rolling friction exists between the second outer sleeve 410 and the second inner sleeve 420.

Referring to FIG. 24, the top of the spray arm base 500 is provided with a spray arm base flange 520, the spray arm base flange 520 extends outwards along a radial direction of the spray arm base 500, the spray arm base flange 520 is arranged below the second outer sleeve 410, and a gap between an upper surface of the spray arm base flange 520 and a lower surface of the second outer sleeve 410 is L2. L2 satisfies a relation: 0 mm<L2≤1 mm. Therefore, when the lower spray arm 200 and the spray arm base 500 rotate relative to each other, sliding friction caused by contact between the lower surface of the second outer sleeve 410 and the upper surface of the spray arm base flange 520 can be prevented, and the increase of the friction force between the lower spray arm 200 and the spray arm base 500 or even the jam of the lower spray arm 200 caused by the entry of leftovers or other contaminants into the gap can be prevented. In one embodiment, L2 may be 0.3 mm, 0.5 mm or 0.8 mm.

In one embodiment, the lower spray arm lower connecting sleeve 240 includes: a connecting sleeve circumferential wall 241 and a connecting sleeve bottom wall 242. The connecting sleeve bottom wall 242 extends inwards along a radial direction of the connecting sleeve circumferential wall 241, and the connecting sleeve bottom wall 242 is arranged on one end of the connecting sleeve circumferential wall 241 away from the spray arm body 230. As shown in FIG. 24, the connecting sleeve bottom wall 242 is arranged on a lower end of the connecting sleeve circumferential wall 241. The second inner sleeve 420 and the second middle sleeve 470 are arranged below the connecting sleeve bottom wall 242, and an inner diameter of the connecting sleeve bottom wall 242 is equal to that of the second inner sleeve 420. When the water source of the dishwasher is opened, a water flow first flows through the second inner sleeve 420 via the spray arm base 500 and then flows into the lower chamber 250. Therefore, the inner diameter of the connecting sleeve bottom wall 242 being equal to that of the second inner sleeve 420 can ensure that the flow velocity in the lower spray arm 200 is equal to that in the second inner sleeve 420 and the flow velocity at which the water enters the lower chamber 250 is stable, and ensuring stable rise of the water pressure in the lower chamber 250, preventing a sudden change of the flow velocity at the position where the lower spray arm 200 is connected to the spray arm base 500, ensuring stable rotation of the lower spray arm 200, and ensuring the high operation reliability of the spray arm assembly 1000.

A gap between an upper surface of the second inner sleeve 420 and a lower surface of the connecting sleeve bottom wall 242 is L3. L3 satisfies a relation: 0 mm<L3≤0.5 mm. For example, L3 may be 0.1 mm, 0.2 mm or 0.3 mm. Therefore, when the lower spray arm 200 rotates relative to the spray arm base 500, sliding friction caused by the contact between the upper surface of the second inner sleeve 420 and the lower surface of the connecting sleeve bottom wall 242 can be prevented. That is, no friction exists between the second inner sleeve 420 and the lower spray arm 200. In addition, the gap between the upper surface of the second inner sleeve 420 and the lower surface of the connecting sleeve bottom wall 242 is smaller, which can avoid water leakage and can also prevent the increase of the friction force between the lower spray arm 200 and the spray arm base 500 or even the jam of the lower spray arm 200 caused by the entry of leftovers or other contaminants into the gap. Moreover, when the lower spray arm 200 tilts, the lower spray arm 200 may quickly contact the second inner sleeve 420, to avoid further tilt of the lower spray arm 200.

Referring to FIG. 24, the bottom of the spray arm base 500 is provided with a spray arm base water intake shaft 540 extending inwards along the radial direction of the spray arm base 500, and an inner diameter of the spray arm base water intake shaft 540 is equal to that of the second inner sleeve 420. Similarly, when the water source of the dishwasher is opened, a water flow first flows through the second inner sleeve 420 via the spray arm base 500. Therefore, the inner diameter of the spray arm base water intake shaft 540 being equal to that of the second inner sleeve 420 can ensure that the flow velocity in the spray arm base 500 is equal to that in the second inner sleeve 420, and the water flow enters the second inner sleeve 420 at a stable water velocity, and ensuring a stable water velocity when the water flows through the second inner sleeve 420 and the connecting sleeve bottom wall 242 into the lower chamber 250, preventing a sudden change of the flow velocity at the position where the lower spray arm 200 is connected to the spray arm base 500, and ensuring stable rotation of the lower spray arm 200.

According to another embodiment illustrated in FIG. 25 of the present application, the bearing base may include: a second outer sleeve 410 and a second middle sleeve 470.

An inner circumferential surface of the second outer sleeve 410 is provided with second outer sleeve ball groove 413 configured to cooperate with the second balls 430, the second middle sleeve 470 is arranged on an inner side of the second outer sleeve 410, the spray arm base 500 is arranged on an inner side of the second middle sleeve 470, and an outer circumferential surface of the spray arm base 500 is provided with a spray arm base ball groove 570 configured to cooperate with the second balls 430.

The second middle sleeve 470 is provided with a plurality of second ball holes 450. The second balls 430 are rotatably mounted in the second ball holes 450, and the second ball hole 450 provide support for the fixing of the second balls 430, which ensures that relative positions of the plurality of second balls 430 are unchanged, and prevents collision and extrusion between the plurality of second balls 430, thus improving the operation stability of the second ball assembly 400, to further improve the smoothness during rotation of the spray arm. In one embodiment, the number of the second balls 430 is the same as that of the second ball holes 450.

A plurality of second balls 430 are provided, and the plurality of second balls 430 are evenly distributed along a circumferential direction of the second middle sleeve 470, so that the relative rotation of the lower spray arm 200 and the spray arm base 500 can be more stable. In one embodiment, the number of the second balls 430 is an even number, which ensures the force balance of the second ball assembly 400 and alleviates the stress concentration.

The second balls 430 protrude beyond inner and outer circumferential surfaces of the second middle sleeve 470 in a radial direction of the second middle sleeve 470. When the lower spray arm 200 rotates relative to the spray arm base 500, the second outer sleeve 410 and the spray arm base 500 come into contact through the second balls 430. Therefore, rolling friction exists between the second outer sleeve 410 and the spray arm base 500.

The spray arm base ball groove 570 and the second outer sleeve ball groove 413 are both circumferential annular groves, which can ensure the smooth rotation of the lower spray arm 200 in the whole circle. The second balls 430 are in rolling contact with the spray arm base ball groove 570 and the second outer sleeve ball groove 413, with less friction force. In a specific embodiment, diameters of the spray arm base ball groove 570 and the second outer sleeve ball groove 413 may be equal to the diameter of the second balls 430, or may be slightly larger than the diameter of the second balls 430, to ensure that the second balls 430 well cooperate with the spray arm base ball groove 570 and the second outer sleeve ball groove 413.

In one embodiment, the base threads are second outer sleeve external threads 415 on the outer circumferential surface of the second outer sleeve 410, the lower spray arm threads 280 are lower spray arm internal threads arranged on an inner circumferential surface of the lower spray arm lower connecting sleeve 240, and the lower spray arm internal threads are configured to cooperate with the second outer sleeve external threads 415. That is, the lower spray arm 200 and the second outer sleeve 410 are fixedly connected by screwing, which are easy to assemble and disassemble and reliable to connect.

The second outer sleeve 410 may include: a second outer sleeve circumferential wall 411 and a second outer sleeve bottom wall 412. The second outer sleeve bottom wall 412 is arranged at the bottom of the second outer sleeve circumferential wall 411, and the second outer sleeve bottom wall 412 extends inwards along a radial direction of the second outer sleeve circumferential wall 411. The second balls 430 are arranged above the second outer sleeve bottom wall 412. Therefore, the second outer sleeve bottom wall 412 may protect the second balls 430 to some extent, preventing the second balls 430 from being exposed to affect the service life of the second balls 430.

The second ball holes 450 are major-arc holes, and second ball fetching ports 451 are formed at bottom gaps of the second ball holes 450. The second balls 430 enter the second ball holes 450 or come out of the second ball holes 450 through the second ball fetching ports 451, thus facilitating the mounting and removal of the second balls 430 in the second ball holes 450.

In one embodiment, a second weakening groove 460 is arranged between two adjacent second ball holes 450. With the arrangement of the second weakening groove 460, the stiffness between the two adjacent second ball holes 450 can be reduced. Therefore, when the second balls 430 are mounted, the second ball holes 450 are easy to deform, which reduces the difficulty of mounting or removing the second balls 430.

Further, the second weakening groove 460 is provided with a second weakening groove post 461. In one embodiment, a central axis of the second weakening groove post 461 is parallel to that of the second middle sleeve 470, which is conducive to simplifying the processing technology of the second middle sleeve 470. The arrangement of the second weakening groove post 461 can play a strengthening role, to prevent the second weakening groove 460 from excessively weakening the stiffness of the second middle sleeve 470, which is conducive to improving the operation reliability of the second ball assembly 400.

The second outer sleeve external threads 415 are arranged on an outer circumferential surface of the second outer sleeve circumferential wall 411, the second outer sleeve ball groove 413 is arranged on an inner circumferential surface of the second outer sleeve circumferential wall 411, and the second outer sleeve ball groove 413 is arranged below the second outer sleeve external threads 415. Therefore, the position where the second outer sleeve 410 is fixed to the lower spray arm 200 is located above, and the position where the second outer sleeve 410 cooperates with the spray arm base 500 is located below, so that the height space can be fully utilized, avoiding a large axial size at a position where the lower spray arm 200 is connected to and cooperates with the spray arm base 500.

In a specific embodiment, the balls may be plastic balls or stainless steel balls. The operation environment of the spray arm assembly 1000 is full of water, the spray arm assembly 1000 is in a hot and wet environment for a long time, and the balls are prone to rust and stagnation; the plastic balls or stainless steel balls have strong corrosion resistance, which can effectively slow down or even avoid the rust of the balls.

In one embodiment, a length of the upper spray arm body 120 is 0.5 to 2 times that of the lower spray arm body 230.

In one embodiment, in some embodiments, the length of the upper spray arm body 120 is 0.5 to 1 times that of the lower spray arm body 230. The upper spray arm body 120 is shorter, which can reduce the weight of the upper spray arm 100, to ensure smooth rotation of the upper spray arm 100, and the structure of the whole spray arm is more stable and is not easy to overturn. In addition, the length of the upper spray arm body 120 being less than that of the lower spray arm body 230 can make the volume of the upper chamber 140 less than that of the lower chamber 250. In the cleaning stage, most of the water flow enters the lower chamber 250 in priority. The water pressure in the lower chamber 250 is higher, which can ensure that the pressure of the water column sprayed from the first drive hole 211 is higher, and the lower spray arm 200 can rotate smoothly along the first direction. By setting the length of the upper spray arm body 120 to be shorter, the volume of the upper chamber 140 can be reduced, to ensure that there is also enough high water pressure in the upper chamber 140 and then ensure that the pressure of the water column sprayed from the second drive hole 111 is large, and producing greater reverse driving force to drive the upper spray arm 100 to smoothly rotate along the second direction.

Alternatively, in some embodiments, the length of the upper spray arm body 120 is greater than that of the lower spray arm body 230, for example, the length of the upper spray arm body 120 is 1 to 2 times that of the lower spray arm body 230, to increase the moment arm length of the upper spray arm body 120, and the upper spray arm body 120 can be driven to rotate with only less driving force. In addition, a longer upper spray arm body 120 indicates a larger washing area. In one embodiment, the length of the upper spray arm body 120 is equal to that of the lower spray arm body 230, and in this case, the length of the upper spray arm body 120 and the lower spray arm body 230 is a maximum size that can be accommodated inside the dishwasher, which is conducive to improving the cleaning capability.

The ratio of the lengths of the shortest spray arm to the longest spray arm should not be less than 0.5, because a too short spray arm may require greater driving force, and the aperture of the drive holes is larger and the number of the drive holes is larger. The amount of water sprayed from the drive hole to the tableware is less than that from the spray hole, which is not conducive to cleaning, so the spray arm should not be too short. Therefore, it is more reasonable to set the minimum ratio of the lengths of the shortest spray arm to the longest spray arm to 0.5.

Figure 17:
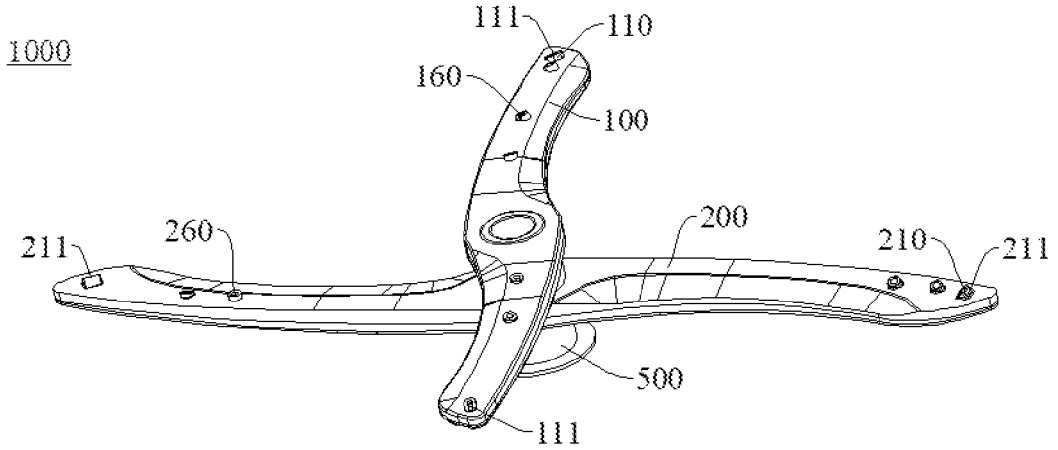
FIG. 17 is a schematic three-dimensional view of the spray arm assembly according to the first embodiment of the present application (the angle between the upper spray arm and the lower spray arm is 90°)
Figure 18:
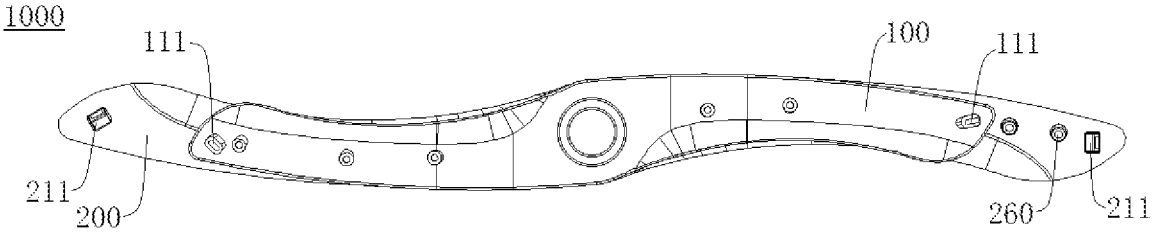
FIG. 18 is a top view of the spray arm assembly according to the first embodiment of the present application (the angle between the upper spray arm and the lower spray arm is 0°)

As shown in FIG. 16 and FIG. 17, the lower spray arm body 230 is provided with a first drive projection 210. The first drive projection 210 protrudes beyond a surface of the lower spray arm body 230, and the first drive hole 211 is formed on the first drive projection 210. In one embodiment, the first drive projection 210 is arranged on an upper end face of the lower spray arm body 230. The arrangement of the first drive projection 210 facilitates the opening of the first drive hole 211 with a specific orientation. The first drive hole 211 is arranged on the first drive projection 210. In some embodiments, the orientation (i.e. the normal direction) of the first drive hole 211 may be parallel to left and right symmetry planes of the lower spray arm 200, which ensures that when a water column is sprayed from the first drive hole 211, the reaction force generated causes the lower spray arm 200 to rotate in the first direction.

The upper spray arm body 120 is provided with a second drive projection 110. The second drive projection 110 protrudes beyond a surface of the upper spray arm body 120, and the second drive hole 111 is formed on the second drive projection 110. In one embodiment, the second drive projection 110 is arranged on an upper end face of the upper spray arm body 120. The second drive projection 110 acts in the same way as the first drive projection 210, and the orientation (i.e. the normal direction) of the second drive hole 111 may be parallel to left and right symmetry planes of the upper spray arm 100. The effect thereof is the same as the first drive hole 211 and is not repeated herein. The difference is that the direction of the second drive hole 111 is opposite to that of the first drive hole 211, to ensure that when a water column is sprayed from the second drive hole 111, the reaction force generated causes the upper spray arm 100 to rotate in the second direction, and ensuring that rotate directions of the upper spray arm 100 and the lower spray arm 200 are opposite.

Further, an angle between a normal of the first drive hole 211 and an axis of the lower spray arm upper connecting sleeve 220 is 0°-90°, and an angle between a normal of the second drive hole 111 and an axis of the upper spray arm connecting sleeve 130 is 0°-90°.

In one embodiment, at the same end of the lower spray arm body 230 and the upper spray arm body 120, when the first drive hole 211 and the second drive hole 111 are in opposite directions, it can ensure that rotation directions of the upper spray arm 100 and the lower spray arm 200 are opposite. A plurality of first drive holes 211 and second drive holes 111 may be provided, to increase the spray volume and improve the driving force.

In one embodiment, two first drive holes 211 may be provided, and the two first drive holes 211 are arranged on two ends of the lower spray arm body 230 respectively. The first drive hole 211 arranged on one end (e.g., the right end) of the lower spray arm body 230 should be in a direction opposite to that the first drive hole 211 arranged on the other end (e.g., the left end) of the lower spray arm body 230, to ensure that the reaction moment generated from each first drive hole 211 is in the same direction, which is conducive to improving the rotational driving force of the lower spray arm 200 and ensuring faster rotation of the lower spray arm 200.

Two second drive holes 111 may be provided, and the two second drive holes 111 are arranged on two ends of the upper spray arm body 120 respectively. The second drive hole 111 arranged on one end (e.g., the right end) of the upper spray arm body 120 should be in a direction opposite to that the second drive hole 111 arranged on the other end (e.g., the left end) of the upper spray arm body 120, to ensure that the reaction moment generated from each second drive hole 111 is in the same direction, which is conducive to improving the rotational driving force of the upper spray arm 100 and ensuring faster rotation of the upper spray arm 100.

The water yield per unit time can be increased by increasing the number of drive holes, to increase the driving force. The arrangement of the first drive hole 211 on the end of the lower spray arm body 230 and the second drive hole 111 on the end of the upper spray arm body 120 facilitates the increase of the moment arm length of the driving force at the first drive hole 211 and the second drive hole 111. In this way, the lower spray arm 200 and the upper spray arm 100 can be driven to rotate only by consuming less water energy. Therefore, in a specific embodiment, the first drive hole 211 is as far as possible from the center position of the lower spray arm body 230 and the second drive hole 111 is as far as possible from the center position of the upper spray arm body 120; and the first drive hole 211 is arranged on an end of the lower spray arm body 230 and the second drive hole 111 is arranged on an end of the upper spray arm body 120. When water columns are sprayed from the first drive hole 211 and the second drive hole 111, rotation shafts of the lower spray arm 200 and the upper spray arm 100 have a large torque, to ensure that the reaction force generated when the water columns are sprayed can be used as much as possible to improve the rotation speed of the lower spray arm 200 and the upper spray arm 100, which is conducive to improving the cleaning effect of the spray arm assembly 1000.

In one embodiment, the first drive projection 210 and the second drive projection 110 are constructed into a shape of a cuboid, cube, rectangular pyramid, trapezoid, or cylinder, but are not limited to the above structures. In the examples of FIG. 16 to FIG. 17 and FIG. 12 to FIG. 13, the first drive projection 210 and the second drive projection 110 are both constructed into a shape of a rectangular pyramid.

Based on the embodiments of FIG. 20 and FIG. 14, the first ball assembly 300 in the present application may be transformed in a variety of manners, all of which fall within the protection scope of the present application. The following is an overview of a variety of transformed examples of the first ball assembly 300 according to the embodiment of the present application with reference to FIG. 20 and FIG. 14.

In a first unillustrated embodiment, the first ball assembly 300 may include only first balls 330, in which the first middle sleeve 370, the first inner sleeve 320, and the first outer sleeve 310 are absent compared with the embodiment of FIG. 14. The first balls 330 are used to directly cooperate with the upper spray arm connecting sleeve 130 and the lower spray arm upper connecting sleeve 220, which can also achieve the rolling connection between the upper spray arm connecting sleeve 130 and the lower spray arm upper connecting sleeve 220. In this case, the inner circumferential surface of the upper spray arm connecting sleeve 130 is provided with an upper spray arm ball groove configured to cooperate with the first balls 330, and the outer circumferential surface of the lower spray arm upper connecting sleeve 220 is provided with a lower spray arm ball groove configured to cooperate with the first balls 330.

In a second unillustrated embodiment, the first ball assembly 300 may include only first balls 330 and a first inner sleeve 320, in which the first middle sleeve 370 and the first outer sleeve 310 are absent compared with the embodiment of FIG. 14. The first balls 330 are used to directly cooperate with the first inner sleeve 320 and the upper spray arm connecting sleeve 130, which can also achieve the rolling connection between the upper spray arm connecting sleeve 130 and the lower spray arm upper connecting sleeve 220. In this case, the inner circumferential surface of the upper spray arm connecting sleeve 130 is provided with an upper spray arm ball groove configured to cooperate with the first balls 330, and the outer circumferential surface of the first inner sleeve 320 is provided with a first inner sleeve ball groove 321 configured to cooperate with the first balls 330.

In a third unillustrated embodiment, the first ball assembly 300 may include only first balls 330 and a first outer sleeve 310, in which the first middle sleeve 370 and the first inner sleeve 320 are absent compared with the embodiment of FIG. 14. The first balls 330 are used to directly cooperate with the lower spray arm upper connecting sleeve 220 and the first outer sleeve 310, which can also achieve the rolling connection between the upper spray arm connecting sleeve 130 and the lower spray arm upper connecting sleeve 220. In this case, the outer circumferential surface of the lower spray arm upper connecting sleeve 220 is provided with a lower spray arm ball groove configured to cooperate with the first balls 330, and the inner circumferential surface of the first outer sleeve 310 is provided with a first outer sleeve ball groove 313 configured to cooperate with the first balls 330.

In a fourth unillustrated embodiment, the first ball assembly 300 may include only first balls 330, a first inner sleeve 320, and a first outer sleeve 310, in which the first middle sleeve 370 is absent compared with the embodiment of FIG. 14. The first balls 330 are used to directly cooperate with the first inner sleeve 320 and the first outer sleeve 310, which can also achieve the rolling connection between the upper spray arm connecting sleeve 130 and the lower spray arm upper connecting sleeve 220. In this case, the first outer sleeve 310 may be in interference fit with the upper spray arm connecting sleeve 130, and the first inner sleeve 320 may be in interference fit with the lower spray arm upper connecting sleeve 220. The inner circumferential surface of the first outer sleeve 310 is provided with a first outer sleeve ball groove 313 configured to cooperate with the first balls 330, and the outer circumferential surface of the first inner sleeve 320 is provided with a first inner sleeve ball groove 321 configured to cooperate with the first balls 330.

In a fifth unillustrated embodiment, the first ball assembly 300 may include only first balls 330 and a first middle sleeve 370, in which the first inner sleeve 320 and the first outer sleeve 310 are absent compared with the embodiment of FIG. 14. The first balls 330 are used to directly cooperate with the upper spray arm connecting sleeve 130 and the lower spray arm upper connecting sleeve 220, which can also achieve the rolling connection between the upper spray arm connecting sleeve 130 and the lower spray arm upper connecting sleeve 220. In this case, the inner circumferential surface of the upper spray arm connecting sleeve 130 is provided with an upper spray arm ball groove configured to cooperate with the first balls 330, and the outer circumferential surface of the lower spray arm upper connecting sleeve 220 is provided with a lower spray arm ball groove configured to cooperate with the first balls 330.

In a sixth unillustrated embodiment, the first ball assembly 300 may include only first balls 330, a first inner sleeve 320, and a first middle sleeve 370, in which the first outer sleeve 310 is absent compared with the embodiment of FIG. 14. The first balls 330 are used to directly cooperate with the first inner sleeve 320 and the upper spray arm connecting sleeve 130, which can also achieve the rolling connection between the upper spray arm connecting sleeve 130 and the lower spray arm upper connecting sleeve 220. In this case, the inner circumferential surface of the upper spray arm connecting sleeve 130 is provided with an upper spray arm ball groove configured to cooperate with the first balls 330, and the outer circumferential surface of the first inner sleeve 320 is provided with a first inner sleeve ball groove 321 configured to cooperate with the first balls 330.

In a seventh unillustrated embodiment, the first ball assembly 300 may include only first balls 330, a first outer sleeve 310, and a first middle sleeve 370, in which the first inner sleeve 320 is absent compared with the embodiment of FIG. 14. The first balls 330 are used to directly cooperate with the lower spray arm upper connecting sleeve 220 and the first outer sleeve 310, which can also achieve the rolling connection between the upper spray arm connecting sleeve 130 and the lower spray arm upper connecting sleeve 220. In this case, the outer circumferential surface of the lower spray arm upper connecting sleeve 220 is provided with a lower spray arm ball groove configured to cooperate with the first balls 330, and the inner circumferential surface of the first outer sleeve 310 is provided with a first outer sleeve ball groove 313 configured to cooperate with the first balls 330.

In some unillustrated embodiments, the lower spray arm upper connecting sleeve 220 may also sleeve the outer side of the upper spray arm connecting sleeve 130. In this case, the inner side of the first ball assembly 300 is in contact with the upper spray arm connecting sleeve 130, and the outer side of the first ball assembly 300 is in contact with the lower spray arm upper connecting sleeve 220. The situation where the lower spray arm upper connecting sleeve 220 is fitted over the inner side of the upper spray arm connecting sleeve 130 is similar to the above seven embodiments, and is not repeated herein.

Based on the embodiments of FIG. 20 and FIG. 27, the second ball assembly 400 in the present application may be transformed in a variety of manners, all of which fall within the protection scope of the present application. The following is an overview of a variety of transformed examples of the second ball assembly 400 according to the embodiment of the present application with reference to FIG. 20 and FIG. 27.

In a first unillustrated embodiment, the second ball assembly 400 may include only second balls 430, in which the second middle sleeve 470, the second inner sleeve 420, and the second outer sleeve 410 are absent compared with the embodiment of FIG. 27. The second balls 430 are used to directly cooperate with the lower spray arm lower connecting sleeve 240 and the spray arm base body 510, which can also achieve the rolling connection between the lower spray arm lower connecting sleeve 240 and the spray arm base body 510. In this case, the inner circumferential surface of the lower spray arm lower connecting sleeve 240 is provided with an upper spray arm ball groove configured to cooperate with the second balls 430, and the outer circumferential surface of the spray arm base body 510 is provided with a lower spray arm ball groove configured to cooperate with the second balls 430.

In a first unillustrated embodiment, the second ball assembly 400 may include only second balls 430 and a second inner sleeve 420, in which the second middle sleeve 470 and the second outer sleeve 410 are absent compared with the embodiment of FIG. 27. The second balls 430 are used to directly cooperate with the second inner sleeve 420 and the lower spray arm lower connecting sleeve 240, which can also achieve the rolling connection between the lower spray arm lower connecting sleeve 240 and the spray arm base body 510. In this case, the inner circumferential surface of the lower spray arm lower connecting sleeve 240 is provided with an upper spray arm ball groove configured to cooperate with the second balls 430, and the outer circumferential surface of the second inner sleeve 420 is provided with a second inner sleeve ball groove 421 configured to cooperate with the second balls 430.

In a third unillustrated embodiment, the second ball assembly 400 may include only second balls 430 and a second outer sleeve 410, in which the second middle sleeve 470 and the second inner sleeve 420 are absent compared with the embodiment of FIG. 27. The second balls 430 are used to directly cooperate with the spray arm base body 510 and the second outer sleeve 410, which can also achieve the rolling connection between the lower spray arm lower connecting sleeve 240 and the spray arm base body 510. In this case, the outer circumferential surface of the spray arm base body 510 is provided with a lower spray arm ball groove configured to cooperate with the second balls 430, and the inner circumferential surface of the second outer sleeve 410 is provided with a second outer sleeve ball groove 413 configured to cooperate with the second balls 430.

In a fourth unillustrated embodiment, the second ball assembly 400 may include only second balls 430, a second inner sleeve 420, and a second outer sleeve 410, in which the second middle sleeve 470 is absent compared with the embodiment of FIG. 27. The second balls 430 are used to directly cooperate with the second inner sleeve 420 and the second outer sleeve 410, which can also achieve the rolling connection between the lower spray arm lower connecting sleeve 240 and the spray arm base body 510. In this case, the second outer sleeve 410 may be in interference fit with the lower spray arm lower connecting sleeve 240, and the second inner sleeve 420 may be in interference fit with the spray arm base body 510. The inner circumferential surface of the second outer sleeve 410 is provided with a second outer sleeve ball groove 413 configured to cooperate with the second balls 430, and the outer circumferential surface of the second inner sleeve 420 is provided with a second inner sleeve ball groove 421 configured to cooperate with the second balls 430.

In a fifth unillustrated embodiment, the second ball assembly 400 may include only second balls 430 and a second middle sleeve 470, in which the second inner sleeve 420 and the second outer sleeve 410 are absent compared with the embodiment of FIG. 27. The second balls 430 are used to directly cooperate with the lower spray arm lower connecting sleeve 240 and the spray arm base body 510, which can also achieve the rolling connection between the lower spray arm lower connecting sleeve 240 and the spray arm base body 510. In this case, the inner circumferential surface of the lower spray arm lower connecting sleeve 240 is provided with an upper spray arm ball groove configured to cooperate with the second balls 430, and the outer circumferential surface of the spray arm base body 510 is provided with a lower spray arm ball groove configured to cooperate with the second balls 430.

In a sixth unillustrated embodiment, the second ball assembly 400 may include only second balls 430, a second inner sleeve 420, and a second middle sleeve 470, in which the second outer sleeve 410 is absent compared with the embodiment of FIG. 27. The second balls 430 are used to directly cooperate with the second inner sleeve 420 and the lower spray arm lower connecting sleeve 240, which can also achieve the rolling connection between the lower spray arm lower connecting sleeve 240 and the spray arm base body 510. In this case, the inner circumferential surface of the lower spray arm lower connecting sleeve 240 is provided with an upper spray arm ball groove configured to cooperate with the second balls 430, and the outer circumferential surface of the second inner sleeve 420 is provided with a second inner sleeve ball groove 421 configured to cooperate with the second balls 430.

In a seventh unillustrated embodiment, the second ball assembly 400 may include only second balls 430, a second outer sleeve 410, and a second outer sleeve 470, in which the second inner sleeve 420 is absent compared with the embodiment of FIG. 27. The second balls 430 are used to directly cooperate with the spray arm base body 510 and the second outer sleeve 410, which can also achieve the rolling connection between the lower spray arm lower connecting sleeve 240 and the spray arm base body 510. In this case, the outer circumferential surface of the spray arm base body 510 is provided with a lower spray arm ball groove configured to cooperate with the second balls 430, and the inner circumferential surface of the second outer sleeve 410 is provided with a second outer sleeve ball groove 413 configured to cooperate with the second balls 430.

In some unillustrated embodiments, the spray arm base body may also sleeve the outer side of the lower spray arm lower connecting sleeve 240. In this case, the inner side of the second ball assembly 400 is in contact with the lower spray arm lower connecting sleeve 240, and the outer side of the second ball assembly 400 is in contact with the spray arm base body 510. The situation where the spray arm base body 510 is fitted over the inner side of the lower spray arm lower connecting sleeve 240 is similar to the above seven embodiments, and is not repeated herein.

It needs to be noted that in the present application, the upper and lower position relationship between the upper spray arm 100 and the lower spray arm 200 is described based on an example in which the spray arms are mounted to a bottom wall of the dishwasher. In some unillustrated embodiments, the spray arms may also be mounted to a top wall or a sidewall of the dishwasher. When the spray arms are mounted to a top wall of the dishwasher, the upper spray arm 100 is located below the lower spray arm 200. When the spray arms are mounted to a sidewall of the dishwasher, the upper spray arm 100 is located on one side of the lower spray arm 200 away from the sidewall of the dishwasher. That is, regardless of where the spray arms are located in the dishwasher, the upper spray arm 100 is always located on the side of the lower spray arm 200 toward an inner cavity of the dishwasher.

The spray arm assembly 1000 according to the embodiment of the present application is described below in detail with reference to FIG. 28 to FIG. 38. The spray arm assembly 1000 may be used in washing appliances. In the following, the spray arm assembly 1000 is applied to a dishwasher as an example to illustrate the structure of the spray arm assembly 1000.

Referring to FIG. 28 to FIG. 32, the spray arm assembly 1000 according to the embodiment of the present application may include a first spray arm 200*a*, a second spray arm 100*a*, and a spray arm base 500. When the spray arm assembly 1000 is mounted to the bottom of the dishwasher, the second spray arm 100*a* is located above the first spray arm 200*a*, and the first spray arm 200*a* is located above the spray arm base 500. When the spray arm assembly 1000 is mounted to the top of the dishwasher, the second spray arm 100*a* is located below the first spray arm 200*a*, and the first spray arm 200*a* is located below the spray arm base 500. When the spray arm assembly 1000 is mounted to a side wall of the dishwasher, the second spray arm 100*a* is located on one side of the first spray arm 200*a* toward an inner cavity of the dishwasher, and the first spray arm 200*a* is located on one side of the spray arm base 500 toward the inner cavity of the dishwasher. For ease of description, the structure of the spray arm assembly 1000 is described below with an example in which the spray arm assembly 1000 is mounted to the bottom of the dishwasher. In this case, the first spray arm 200*a* is a lower spray arm, the second spray arm 100*a* is an upper spray arm, and the spray arm base 500 is located below the second spray arm 100*a* and the first spray arm 200*a*.

It needs to be understood that the terms such as "first" and "second" are used herein for purposes of description and are not intended to indicate or imply relative importance or significance or to imply the number of indicated features. Thus, the feature defined with "first" and "second" may explicitly or implicitly include one or more of this feature.

In some embodiments, the first spray arm 200*a* is a lower spray arm 200, and the second spray arm 100*a* is an upper spray arm 200.

Figure 32:
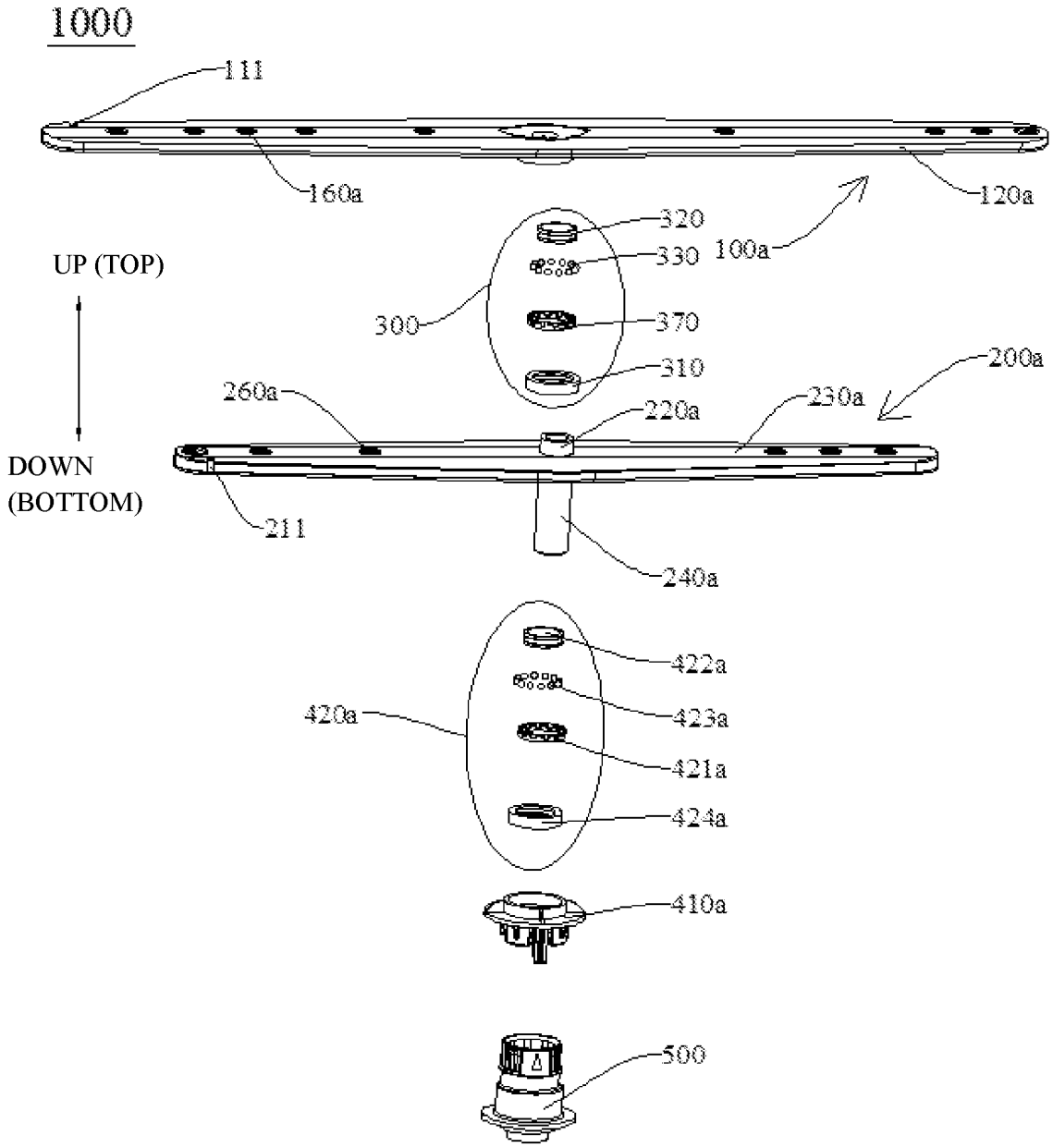
FIG. 32 is a schematic exploded view of the spray arm assembly.

As shown in FIG. 32, the first spray arm 200*a* is provided with a first spray hole 260*a* for spraying water into the dishwasher, and the second spray arm 100*a* is provided with a second spray hole 160*a* for spraying water into the dishwasher. A water source may be sprayed from the first spray hole 260*a* and the second spray hole 160*a*. The sprayed water can clean the tableware when falling on the tableware. Moreover, the second spray arm 100*a* is connected to the first spray arm 200*a* and the second spray arm 100*a* is rotatable relative to the first spray arm 200*a*. With a large number of spray arms, the tableware can be washed repeatedly, and the spray range of the second spray arm 100*a* can be increased, which is conducive to improving the cleaning effect of the spray arm assembly 1000.

In one embodiment, more first spray holes 260*a* and more second spray holes 160*a* are provided, which is conducive to increasing the spray volume of the first spray arm 200*a* and the second spray arm 100*a*.

Referring to FIG. 32, the first spray arm 200*a* is provided with a first drive hole 211 for driving the first spray arm 200*a* to rotate around a first direction. When a water column inside the spray arm is sprayed from the first drive hole 211, the first spray arm 200*a* may be subjected to reaction force (i.e. reverse driving force) of the water column sprayed from the first drive hole 211. In this case, the first spray arm 200*a* may rotate around the first direction under the reaction force. The first direction is opposite to an opening direction of the first drive hole 211. The first spray arm 200*a* may rotate continuously as the water column is continuously sprayed from the first drive hole 211. The water column sprayed from the first drive hole 211 may sprinkle around with the rotation of the first spray arm 200*a*, a water flow sprayed from the first spray hole 260*a* of the first spray arm 200*a* may also enter an operation region of the dishwasher, and then the two cooperate to clean the tableware in the dishwasher or stains on inner walls of the dishwasher.

Referring to FIG. 32, the second spray arm 100*a* is provided with a second drive hole 111 for driving the second spray arm 100*a* to rotate around a second direction. When a water column is sprayed from the second drive hole 111, the second spray arm 100*a* may be subjected to a reaction force of the water column sprayed from the second drive hole 111. In this case, the second spray arm 100*a* may rotate around the second direction under the reaction force. The second direction is opposite to an opening direction of the second drive hole 111. The second spray arm 100*a* may rotate continuously as the water column is constantly sprayed from the second drive hole 111, and when the second spray arm 100*a* rotates, the water column sprayed from the second drive hole 111 is sprinkled around, a water flow sprayed from the second spray holes 160 of the second spray arm 100*a* may also enter an operation region of the dishwasher, and then the second spray arm 100*a* and the first spray arm 200*a* jointly cooperate to clean the tableware in the dishwasher or stains on inner walls of the dishwasher.

In one embodiment, as shown in FIG. 32, the first drive hole 211 is arranged on an end of the first spray arm 200*a* and the second drive hole 111 is arranged on an end of the second spray arm 100*a*. This can ensure that when water columns are sprayed from the first drive hole 211 and the second drive hole 111, the moment arm is longer, helping to increase the rotational torque of the first spray arm 200*a* and the second spray arm 100*a*, to ensure that the first spray arm 200*a* and the second spray arm 100*a* have a large rotation speed, and the water columns sprayed from the first drive hole 211 and the second drive hole 111 fall on the inner walls of the dishwasher and the tableware with greater beating force, which is conducive to improving the cleaning effect of the spray arm assembly 1000.

It needs to be noted that in some embodiments, the first direction in which the first spray arm 200*a* rotates is opposite to the second direction in which the second spray arm 100*a* rotates. When water columns are simultaneously sprayed from the first drive hole 211 of the first spray arm 200*a* and the second drive hole 111 of the second spray arm 100*a*, the first spray arm 200*a* and the second spray arm 100*a* rotate simultaneously, and rotation directions of the two are opposite (for example, referring to FIG. 32, the first spray arm 200*a* may rotate counterclockwise, and the second spray arm 100*a* may rotate clockwise; the first spray arm 200*a* may also rotate clockwise and the second spray arm 100*a* may rotate counterclockwise). In this case, the water columns sprayed from the first drive hole 211 of the first spray arm 200*a* and the second drive hole 111 of the second spray arm 100*a* are sprayed in opposite directions. When the water columns sprayed from the first drive hole 211 and the second drive hole 111 simultaneously fall on the tableware or the inner walls of the dishwasher, due to the inconsistency of cleaning directions after the sprayed water columns are applied to the tableware or the inner walls of the dishwasher, the water columns sprayed from the first drive hole 211 and the second drive hole 111 produce rubbing force on the tableware or the inner walls of the dishwasher, and enhancing the cleaning effect of the spray arms, which can ensure the tableware or the inner walls of the dishwasher to be clean. In addition, rotation of the second spray arm 100*a* and the first spray arm 200*a* in opposite directions may also make the water sprayed from the second spray hole 160*a* of the second spray arm 100*a* and the water sprayed from the second spray hole 260 of the first spray arm 200*a* produce rubbing force on the tableware, to further enhance the cleaning effect of the spray arms. In this case, the first drive hole 211 and the second drive hole 111 are in opposite directions at the same end of the first spray arm 200*a* and the second spray arm 100*a*.

In some other embodiments, the first direction in which the first spray arm 200*a* rotates may be the same as the second direction in which the second spray arm 100*a* rotates. In this case, the first drive hole 211 and the second drive hole 111 are in the same direction at the same end of the first spray arm 200*a* and the second spray arm 100*a*, and the first spray arm 200*a* and the second spray arm 100*a* rotate in the same direction, which can increase the spray volume of the spray arm assembly 1000 and is also conducive to improving the cleaning effect of the spray arm assembly 1000. By changing apertures of the first drive hole 211 and the second drive hole 111, the driving force of the first drive hole 211 on the first spray arm 200*a* and the driving force of the second drive hole 111 on the second spray arm 100*a* may be changed, to change rotation speeds of the first spray arm 200*a* and the second spray arm 100*a*, so that the first spray arm 200*a* and the second spray arm 100*a* can rotate at the same speed and in the same direction or at different speeds and in the same direction.

Directions and positions of water columns sprayed by the first spray arm 200*a* and the second spray arm 100*a* onto the tableware are multi-directional, which reduces the dead angle and makes cleaning easier. Due to a large coverage rate of the water flow, the cleaning time may be reduced correspondingly, which is conducive to shortening the cleaning time.

As shown in FIG. 28 to FIG. 32, the spray arm base 500 is arranged on one side of the first spray arm 200*a* away from the second spray arm 100*a*, that is, the spray arm base 500 is located at the bottom of the first spray arm 200*a*, and the first spray arm 200*a* is rotatable relative to the spray arm base 500, which increases the spraying range of the first spray arm 200*a*, ensures that the spray arm assembly 1000 can clean the whole tableware, and further improves the cleaning effect of the spray arm assembly 1000.

The spray arm base 500 and the first spray arm 200*a* are detachably connected through a connector 400*a*. The connector 400*a* is arranged between the spray arm base 500 and the first spray arm 200*a*. The connector 400*a* indirectly connects the spray arm base 500 and the first spray arm 200*a* integrally. The spray arm base 500, the first spray arm 200*a*, and the connector 400*a* may be separated from each other, to ensure convenient assembly or disassembly of the spray arm base 500 and the first spray arm 200*a*.

A water intake shaft 330*a* is formed inside the spray arm base 500. The water intake shaft 330*a* is located below the spray arm base 500. The spray arm base 500 may be fixedly connected to an inner liner of the dishwasher, and the water intake shaft 330*a* may be connected to a water source supply member. Therefore, the arrangement of the spray arm base 500 not only provides support for the first spray arm 200*a* and the second spray arm 100*a*, but also provides a water source channel for the first spray arm 200*a* and the second spray arm 100*a*.

Figure 29:
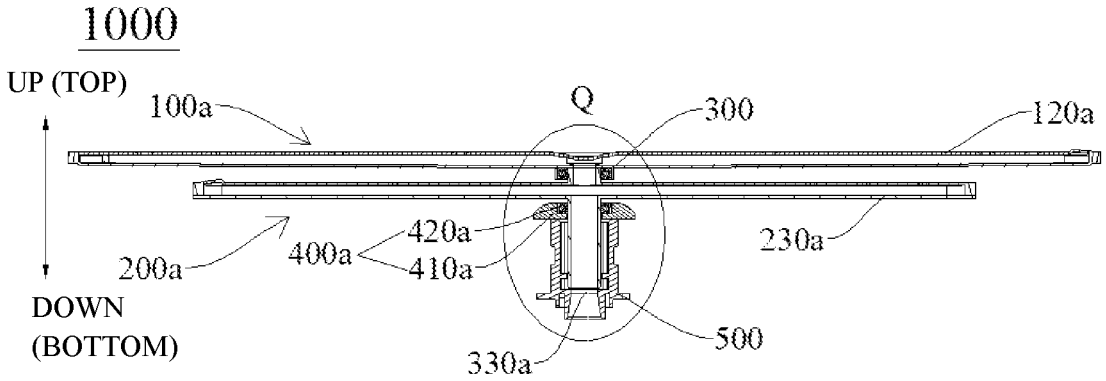
FIG. 29 is a front sectional view of the spray arm assembly.

Referring to FIG. 29, the first spray arm 200*a* may include: a first spray arm body 230*a* and a first spray arm water intake shaft 240*a*. The first spray arm water intake shaft 240*a* is arranged on a surface of the first spray arm body 230*a* away from the second spray arm 100*a*, that is, the first spray arm water intake shaft 240*a* is located below the first spray arm body 230*a*. The first spray arm water intake shaft 240*a* is arranged through the connector 400*a*, and the first spray arm water intake shaft 240*a* at least partially extends into the spray arm base 500. The bottom of the first spray arm water intake shaft 240*a* may be adjacent to the water intake shaft 330*a* of the spray arm base 500. Water of a water source may directly enter the first spray arm water intake shaft 240*a* through the water intake shaft 330*a*. The first spray arm water intake shaft 240*a* may act as a water intake pipeline to supply water for the first spray arm 200*a*, which ensures that the water in the water source can smoothly enter the spray arms.

In one embodiment, upon connection of the spray arm base 500 with the first spray arm 200*a*, after the water pressure in the first spray arm 200*a* reaches a particular value, the first spray arm 200*a* begins to spray a water column through the first spray hole 260*a* and the first drive hole 211. The first spray arm 200*a* rotates around the first direction under the reaction force generated when the water column is sprayed. After the water pressure in the second spray arm 100*a* reaches a particular value, the second spray arm 100*a* begins to spray a water column through the second spray hole 160*a* and the second drive hole 111. The second spray arm 100*a* rotates around the second direction under the reaction force generated when the water column is sprayed. The first spray arm 200*a* and the second spray arm 100*a* may rotate continuously as water columns are constantly sprayed from the spray holes and the drive holes. The water columns sprayed from the spray holes and the drive holes may sprinkle to the tableware surface or the inner walls of the dishwasher along with the rotation of the spray arm, and then wash stains on the tableware or the inner walls of the dishwasher, to complete the cleaning of the tableware by the dishwasher.

Figure 30:
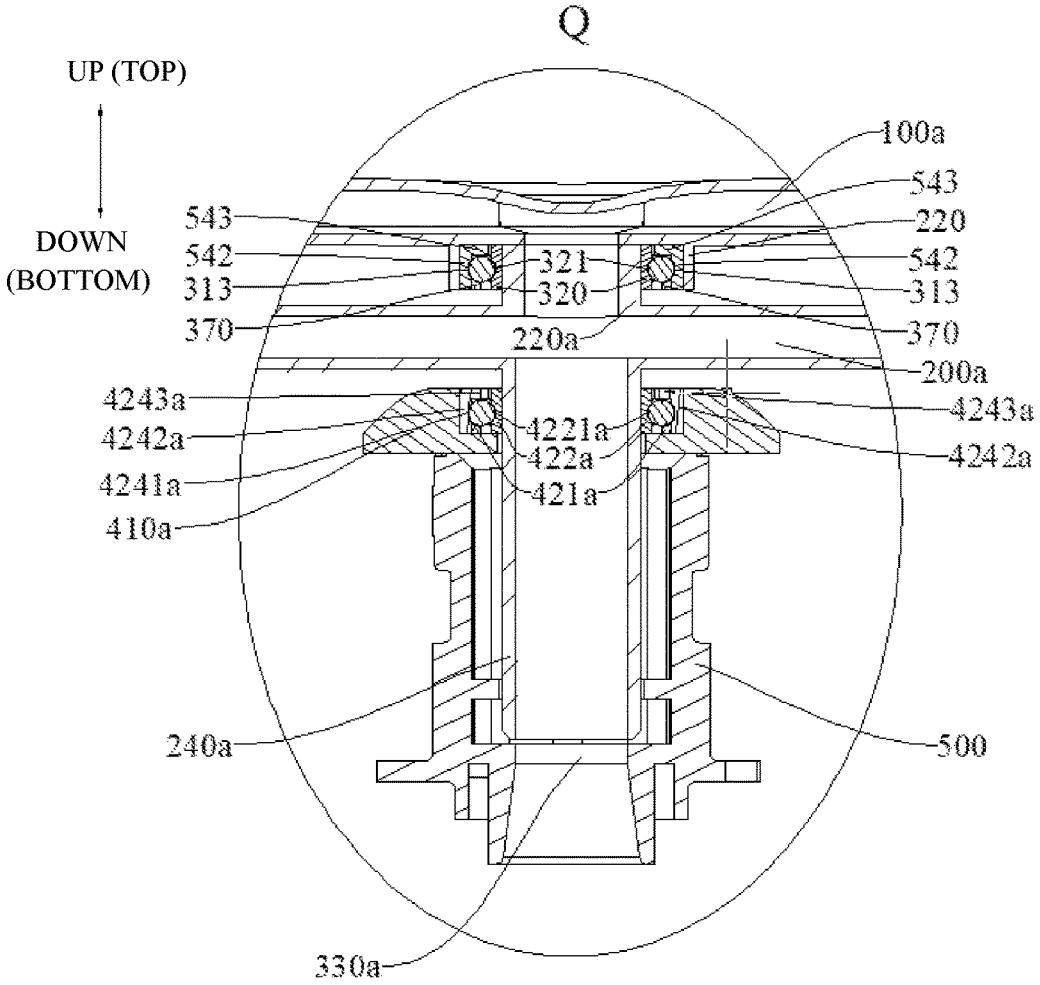
FIG. 30 is a schematic partial enlarged view of Q in FIG. 29.
Figure 31:
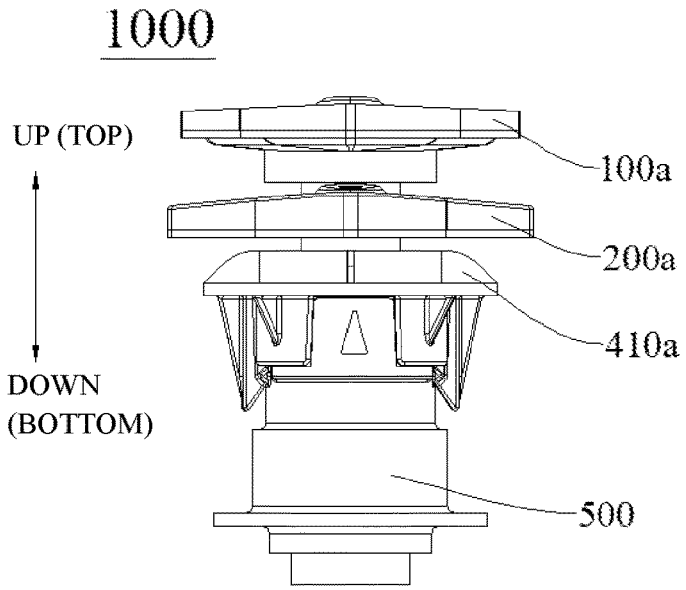
FIG. 31 is a left view of the spray arm assembly.

Further, referring to FIG. 29 to FIG. 30, the connector 400*a* may include: a connection support 410*a* and a third ball assembly 420*a*. The third ball assembly 420*a* may be placed in the connection support 410*a*. The arrangement of the connection support 410*a* provides support for the third ball assembly 420*a*.

Figure 28:
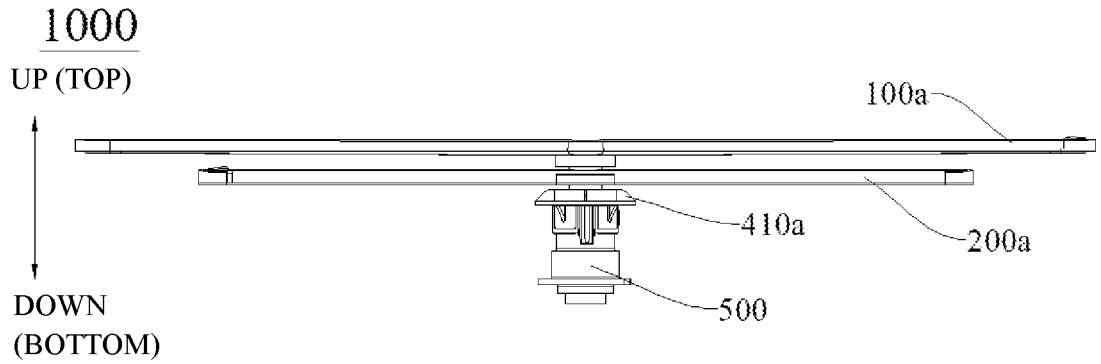
FIG. 28 is a front view of the spray arm assembly.

As shown in FIG. 28 to FIG. 30, the first spray arm water intake shaft 240*a* is arranged through the connection support 410*a*, and the third ball assembly 420*a* is arranged at a position where the connection support 410*a* is connected to and cooperates with the first spray arm water intake shaft 240*a*. That is, the third ball assembly 420*a* is arranged in the connection support 410*a*, and an outer surface of the third ball assembly 420*a* is fixedly connected to a part (e.g., a support connecting sleeve 412*a*) of the connection support 410*a*. The first spray arm water intake shaft 240*a* simultaneously passes through the third ball assembly 420*a* and the connection support 410*a*, and at the position where the first spray arm water intake shaft 240*a* is connected to and cooperates with the connection support 410*a*, the first spray arm water intake shaft 240*a* is indirectly connected to the connection support 410*a* through a fixed connection to the third ball assembly 420*a*. The tight connection between the first spray arm 200*a*, the third ball assembly 420*a*, and the connection support 410*a* is conducive to improving the tightness between the spray arm base 500 and the first spray arm 200*a*, and reducing water leakage.

By arranging the third ball assembly 420*a*, when the first spray arm 200*a* rotates relative to the connection support 410*a*, the friction between the first spray arm 200*a* and the connection support 410*a* is in a form of rolling friction. This ensures less friction force when the first spray arm 200*a* rotates relative to the connection support 410*a*, that is, the rolling friction force has little resistance to the rotation of the first spray arm 200*a*. Therefore, the hydrodynamic loss caused by the friction can be reduced and the utilization of the hydrodynamic power can be improved. At the same time, the rotation of the first spray arm 200*a* relative to the connection support 410*a* is faster, so the arrangement of the third ball assembly 420*a* is conducive to improving the smoothness during rotation of the first spray arm 200*a*, thus helping to reduce the noise of the dishwasher.

In addition, the third ball assembly 420*a* is arranged between the first spray arm 200*a* and the connection support 410*a* to connect the first spray arm 200*a* and the connection support 410*a* integrally, which can effectively reduce the height at a position where the first spray arm 200*a* is connected to the connection support 410*a*, and reducing a height dimension of the spray arm assembly 1000, saving an inner space of the dishwasher, leaving more space for placement of the tableware, and then increasing the tableware capacity of the dishwasher. In one embodiment, the internal loading capacity of the dishwasher can be increased by 10 mm to 40 mm.

In the spray arm assembly 1000 according to the embodiment of the present application, by arranging the first spray arm 200*a* and the second spray arm 100*a*, the number of spray arms of the spray arm assembly 1000 is increased, to increase the spray volume of the spray arm component 1000, which is conducive to enhancing the cleaning effect of the spray arm component 1000 on the tableware. by arranging the connector 400*a* between the spray arm base 500 and the first spray arm 200*a*, rapid disassembly and assembly of the spray arm base 500 and the first spray arm 200*a* can be achieved, which ensures convenient assembly or disassembly of the spray arm assembly 1000 and provides support and a water source channel for the first spray arm 200*a* and the second spray arm 100*a*. Moreover, the friction force between the spray arm base 500 and the first spray arm 200*a* is small, which is conducive to improving the utilization of hydrodynamic force and reducing the noise of the spray arm assembly 1000, and in addition, is further conducive to improving the tightness between the spray arm base 500 and the first spray arm 200*a*, and preventing the water in the spray arm assembly 1000 from leaking between the spray arm base 500 and the first spray arm 200*a*.

In some unillustrated embodiments, the spray arm assembly 1000 is provided with only one spray arm, that is, the spray arm assembly 1000 does not include the second spray arm 100*a*, but only includes a first spray arm 200*a*, a connector 400*a*, and a spray arm base 500, which can also implement a detachable connection between the first spray arm 200*a* and the spray arm base 500.

In some other unillustrated embodiments, the spray arm assembly 1000 is provided with three or more spray arms. A detachable connection between the spray arm base 500 and the nearest spray arm can be implemented only by ensuring that the spray arm base 500 and the spray arm are connected through the connector 400*a*.

Figure 35:
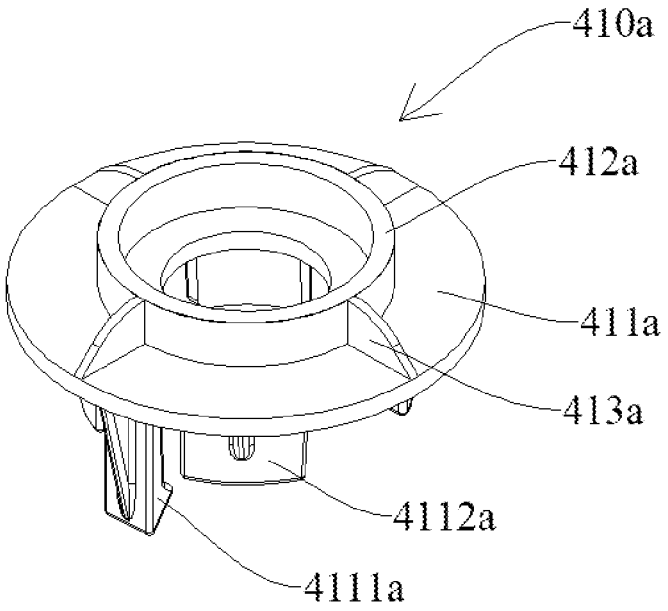
FIG. 35 is a schematic three-dimensional view of a connection support.
Figure 36:
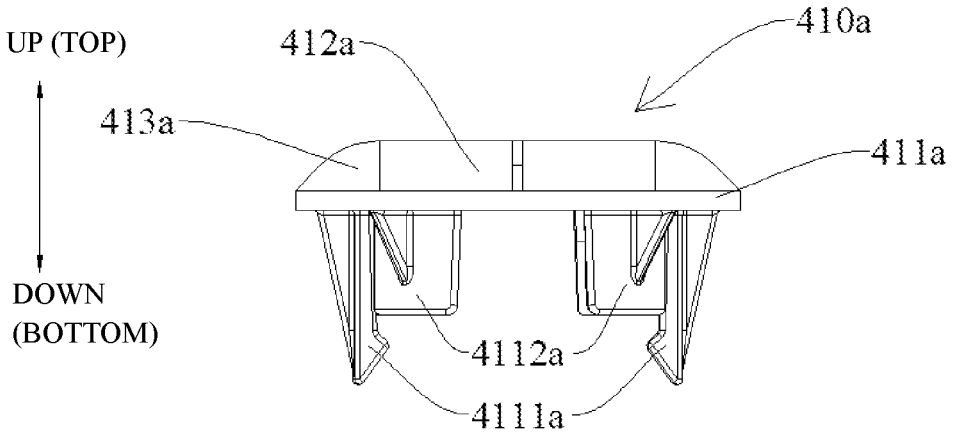
FIG. 36 is a front view of the connection support.
Figure 37:
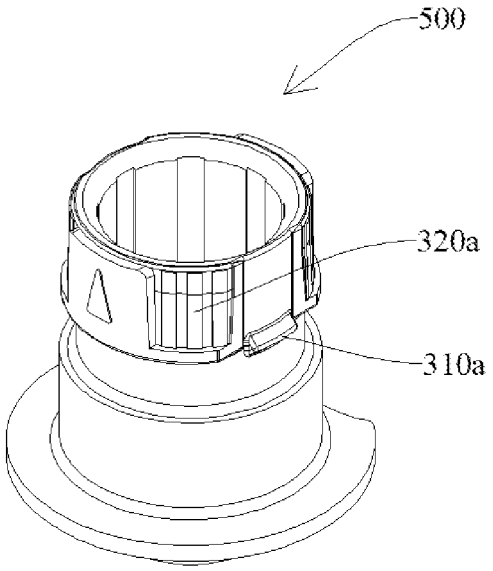
FIG. 37 is a schematic three-dimensional view of a spray arm base.
Figure 38:
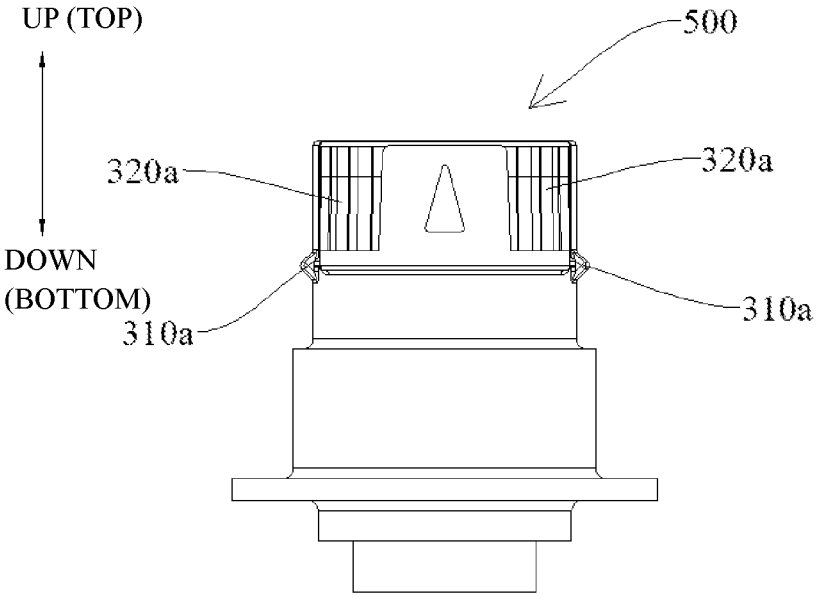
FIG. 38 is a front view of the spray arm base.

Further, referring to FIG. 35 to FIG. 36, the connection support 410*a* may include: a support body 411*a*. A surface of the support body 411*a* toward the first spray arm body 230*a* is provided with a support connecting sleeve 412*a*. That is, the support connecting sleeve 412*a* is arranged above the support body 411*a*, and the support connecting sleeve 412*a* is fixedly connected to the support body 411*a*. The third ball assembly 420*a* is arranged between the support connecting sleeve 412*a* and the first spray arm water intake shaft 240*a*, an outer part (e.g., a third outer sleeve 424*a* mentioned below) of the third ball assembly 420*a* is fixedly connected to the support connecting sleeve 412*a*, and an inner part (e.g., a third inner sleeve 422*a* mentioned below) of the third ball assembly 420*a* is fixedly connected to the first spray arm body 230*a*. Moreover, the outer part and the inner part of the third ball assembly 420*a* may rotate relative to each other, to ensure that the connection support 410*a* and the first spray arm 200*a* may rotate relative to each other.

In one embodiment, referring to FIG. 35 to FIG. 36, a plurality of ribbed plates 413*a* are arranged between the support connecting sleeve 412*a* and the support body 411*a*. The plurality of ribbed plates 413*a* are evenly arranged along an outer circumferential surface of the support connecting sleeve 412*a*, which not only can ensure enough strength of the connection between the support connecting sleeve 412*a* and the support body 411*a* to prevent the failure of the connection between the connection support 410*a* and the first spray arm 200*a* caused by damage such as bending or fracture of the support connecting sleeve 412*a*, but also can ensure identical and uniform strength of the connection between the support connecting sleeve 412*a* and the support body 411*a* on different radial sections of the support connecting sleeve 412*a*, to ensure high reliability of the connection between the support connecting sleeve 412*a* and the support body 411*a* and also increase the service life of the connection support 410*a* to meet the habit of frequently inserting and removing the spray arm.

Further, referring to FIG. 32, the connection support 410*a* is detachably connected to the spray arm base 500, which can ensure that when one of the connection support 410*a* and the spray arm base 500 is damaged, only one of them needs to be replaced. This not only is conducive to reducing the maintenance cost, but also is convenient for an operator to assemble or disassemble the spray arm assembly 1000. When the connection support 410*a* is separated from the spray arm base 500, the spray arms (i.e., the first spray arm 200*a* and the second spray arm 100*a*) can be separated from the spray arm base 500, to facilitate the replacement of the spray arms.

In one embodiment, referring to FIG. 35 to FIG. 38, one side of the support body 411*a* away from the first spray arm body 230*a* is provided with a buckle 4111*a*, that is, the buckle 4111*a* is located below the support body 411*a*. An outer circumferential surface of the spray arm base 500 is provided with a projection 310*a*, and the buckle 4111*a* is configured to engage with the projection 310*a*, to integrally connect the support body 411*a* with the spray arm base 500. In one embodiment, an inner diameter of the buckle 4111*a* is smaller than an outer diameter of the projection 310*a*. In a specific embodiment, when the support body 411*a* is connected to the spray arm base 500, after the buckle 4111*a* is aligned with an upper-side position of the projection 310*a*, the support body 411*a* moves downwards. After the buckle 4111*a* encounters the projection 310*a*, the buckle 4111*a* deforms outwards as the downward force of the support body 411*a* increases. When the inner diameter of the buckle 4111*a* is larger than or equal to the outer diameter of the projection 310*a*, the support body 411*a* continuously moves downwards, and the buckle 4111*a* reconverts accordingly, to clamp the buckle 4111*a* to the bottom of the projection 310*a*. In this case, the buckle 4111*a* is located below the projection 310*a*, and since the outer diameter of the projection 310*a* is greater than the inner diameter of the buckle 4111*a*, the projection 310*a* limits the buckle 4111*a* below the projection 310*a*; at the same time, the support body 411*a* abuts against the top of the spray arm base 500, to axially limit the connection support 410*a* to prevent the connection support

410*a* from being detached from the spray arm base 500 upwards or downwards, and ensuring that the connection support 410*a* and the spray arm base 500 are fixed and reliable.

When the spray arm and the spray arm base 500 need to be disassembled, the connection support 410*a* is lifted upwards by force, and the buckle 4111*a* deforms outwards, to ensure that the buckle 4111*a* can cross the projection 310*a* from bottom to top to achieve the separation of the connection support 410*a* from the spray arm base 500. The connection support 410*a* is connected to the first spray arm 200*a*, to achieve the separation of the spray arm from the spray arm base 500.

The arrangement of the buckle 4111*a* and the projection 310*a* can ensure a reliable connection between the connection support 410*a* and the spray arm base 500, the connection support 410*a* and the spray arm base 500 have no relative axial motion, and the structure of the engagement of the buckle 4111*a* with the projection 310*a* is simple, which is conducive to improving assembly and disassembly convenience of the connection support 410*a* and the spray arm base 500, and is convenient for repeated insertion and removal, to meet testing and user cleaning requirements (during the test or actual use of the dishwasher, the spray arm is frequently inserted and removed to ensure that there is no interference with internal parts of the dishwasher and to flush the spray arm periodically).

In one embodiment, a plurality of buckles 4111*a* and a plurality of projections may be provided and the two are equal in number. Moreover, the plurality of buckles 4111*a* may be evenly arranged on a lower side of the support body 411*a*, and the projections 310*a* may be evenly arranged on the spray arm base 500, which not only can ensure a reliable connection between the buckles 4111*a* and the projections 310*a*, but also can ensure equal strength of the connection between the connection support 410*a* and the spray arm base 500 on the cross sections, to ensure a firm connection between the connection support 410*a* and the spray arm base 500, to prevent the separation of the connection support 410*a* from the spray arm base 500 during the operation of the spray arm assembly 1000.

In one embodiment, both the number of the buckles 4111*a* and the number of the projections 310*a* may be two. Moreover, the two buckles 4111*a* are arranged below the support body 411*a*, and the two projections 310*a* are symmetrically arranged on an outer circumferential surface of the spray arm base 500, that is, the two buckles 4111*a* are at an angle of 180°, and the two projections 310*a* are at an angle of 180°, which not only can ensure a reliable connection between the buckles 4111*a* and the projections 310*a*, but also is conducive to reducing the difficulty of the engagement of the buckles 4111*a* with the projections 310*a* by arranging fewer buckles 4111*a* and projections 310*a*, and ensuring a simple connection between the connection support 410*a* from the spray arm base 500.

Further, referring to FIG. 35 to FIG. 38, one side of the support body 411*a* away from the first spray arm body 230*a* is provided with a limiting buckle 4112*a*, that is, the limiting buckle 4112*a* is arranged below the support body 411*a*, and the outer circumferential surface of the spray arm base 500 is provided with a slot 320*a* configured to engage with the limiting buckle 4112*a*, to prevent relative rotation between the connection support 410*a* from the spray arm base 500.

The limiting buckle 4112*a* is constructed into an arc-shaped tile structure, and the shape of the slot 320*a* is consistent with that of the limiting buckle 4112*a*, to ensure good matching between the limiting buckle 4112*a* and the slot 320*a*. In one embodiment, an outer circumferential surface of the limiting buckle 4112*a* and a lower surface of the support body 411*a* may be further provided with reinforcing ribs, to improve the strength and stiffness of the connection between the limiting buckle 4112*a* and the support body 411*a*.

In a specific embodiment, after the engagement of the buckle 4111*a* with the projection 310*a*, the limiting buckle 4112*a* engages with the slot 320*a*, and the bottom of the limiting buckle 4112*a* abuts against the bottom of the slot 320*a* to prevent continuous downward movement of the limiting buckle 4112*a*, so that further downward movement of the support body 411*a* can be limited, to ensure correct relative positions of the connection support 410*a* and the spray arm base 500. That is, this can prevent the separation of the buckles 4111*a* from the projection 310*a* and an unreliable connection between the connection support 410*a* and the spray arm base 500 caused by continuous downward movement of the support body 411*a* after the engagement of the buckle 4111*a* with the projection 310*a* when the support body 411*a* fits with the spray arm base 500. Moreover, the trapping of the limiting buckle 4112*a* into the slot 320*a* can prevent rotation of the limiting buckle 4112*a* around a central axis of the connection support 410*a*, to prevent the rotation of the connection support 410*a*, to ensure a reliable connection between the connection support 410*a* and the spray arm base 500 without relative rotation.

In one embodiment, a plurality of limiting buckles 4112*a* and a plurality of slots 320*a* may be provided and the two are equal in number. Moreover, the plurality of limiting buckles 4112 may be evenly arranged below the support base 411*a*, and the plurality of slots 320*a* may be evenly arranged on the spray arm base 500, which can ensure a reliable connection between the limiting buckles 4112*a* and the slots 320*a*, to play a better role in preventing rotation of the connection support 410*a*.

In one embodiment, both the number of the limiting buckles 4112*a* and the number of the slots 320*a* may be four. Moreover, the four limiting buckles 4112*a* are evenly arranged below the support base 411*a*, and the four slots 320*a* may be evenly arranged on the outer circumferential surface of the spray arm base 500, that is, any two adjacent limiting buckles 4112*a* are at an angle of 90°, and any two adjacent slots 320*a* are at an angle of 90°, which can ensure a reliable connection between the limiting buckles 4112*a* and the slots 320*a*, to ensure high reliability of the connection between the connection support 410*a* and the spray arm base 500 and effectively prevent relative rotation between the connection support 410*a* and the spray arm base 500.

In one embodiment, referring to FIG. 29 to FIG. 30 and FIG. 32, a first ball assembly 300 is arranged at a position where the first spray arm 200*a* is connected to and cooperates with the second spray arm 100*a*, the second spray arm 100*a* is indirectly connected to the first spray arm 200*a* through the first ball assembly 300, and the structure in which the second spray arm 100*a*, the first ball assembly 300, and the first spray arm 200*a* are connected is simple and stable.

Further, referring to FIG. 30 and FIG. 32, the first spray arm 200*a* may further include: a first spray arm connecting sleeve 220*a*. The first spray arm connecting sleeve 220*a* is arranged on a surface of the first spray arm body 230*a* toward the second spray arm 100*a*. That is, the first spray arm connecting sleeve 220*a* is located above the first spray arm body 230*a*, and the first spray arm connecting sleeve 220*a* may be fixedly connected to a part (e.g., a first inner sleeve 320 mentioned below) of the first ball assembly 300.

Therefore, the arrangement of the first spray arm connecting sleeve 220*a* facilitates the connection of the first spray arm 200*a* with the first ball assembly 300.

Referring to FIG. 30, the second spray arm 100*a* may include: a second spray arm body 120*a* and a second spray arm connecting sleeve 130*a*. The second spray arm connecting sleeve 130*a* is arranged on a surface of the second spray arm body 120*a* toward the first spray arm body 230*a*. That is, the second spray arm connecting sleeve 130*a* is arranged below the second spray arm body 120*a*, and the second spray arm connecting sleeve 130*a* is fixedly connected to the second spray arm body 120*a*. The second spray arm connecting sleeve 130*a* may be fixedly connected to a part (e.g., a first outer sleeve 310 mentioned below) of the first ball assembly 300. Therefore, the arrangement of the second spray arm connecting sleeve 130*a* facilitates the connection of the second spray arm 100*a* with the first ball assembly 300.

In one embodiment, the first ball assembly 300 is arranged between the first spray arm connecting sleeve 220*a* and the second spray arm connecting sleeve 130*a*, to indirectly connect the first spray arm 200*a* with the second spray arm 100*a*. When the second spray arm 100*a* rotates relative to the first spray arm 200*a*, the friction between the second spray arm 100*a* and the first spray arm 200*a* is in a form of rolling friction. This ensures less friction force when the second spray arm 100*a* rotates relative to the first spray arm 200*a*, that is, the rolling friction force has little resistance to the rotation of the second spray arm 100*a*. Therefore, the hydrodynamic loss caused by the friction can be reduced and the utilization of the hydrodynamic power can be improved. At the same time, the rotation of the second spray arm 100*a* relative to the first spray arm 200*a* is faster, so the arrangement of the first ball assembly 300 is conducive to improving the smoothness during rotation of the second spray arm 100*a*, thus helping to reduce the noise of the dishwasher.

In addition, the first ball assembly 300 is arranged between the second spray arm 100*a* and the first spray arm 200*a*, to connect the second spray arm 100*a* and the first spray arm 200*a* integrally. therefore, when the first spray arm connecting sleeve 220*a* and the second spray arm connecting sleeve 130*a* rotate relative to each other, the first ball assembly 300 may play a role of reducing the friction force between the first spray arm connecting sleeve 220*a* and the second spray arm connecting sleeve 130*a*. At the same time, compared with the original form that the second spray arm 100*a* and the first spray arm 200*a* are separately connected through a buckle, this can effectively reduce the height at a position where the second spray arm 100*a* is connected to the first spray arm 200*a*, and reducing a height dimension of the spray arm assembly 1000, saving an inner space of the dishwasher, leaving more space for placement of the tableware, and then increasing the tableware capacity of the dishwasher. In one embodiment, the internal loading capacity of the dishwasher can be increased by 10 mm to 40 mm.

The structures of the third ball assembly 420*a* and the first ball assembly 300 are introduced below in detail with reference to FIG. 30 and FIG. 32 to FIG. 34, and are illustrated with an example in which the second spray arm connecting sleeve 130*a* is fitted over an outer side of the first spray arm connecting sleeve 220*a* and the first spray arm water intake shaft 240*a* is arranged on an inner side of the support connecting sleeve 412*a*.

Figure 33:
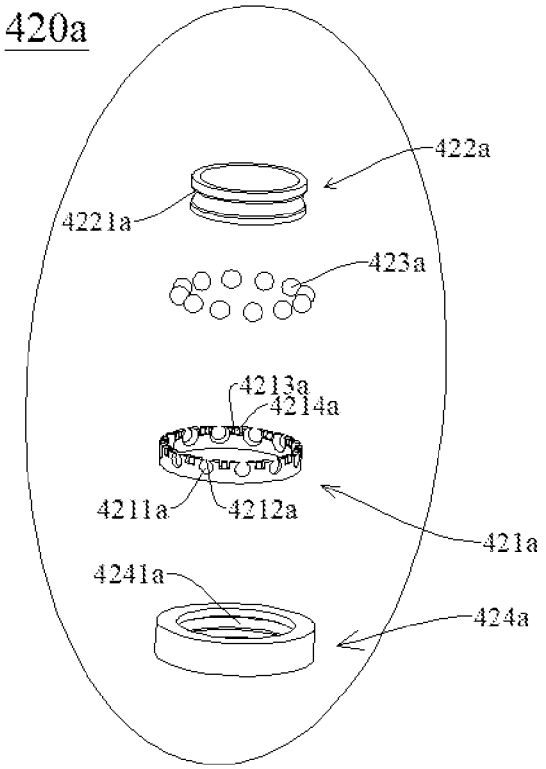
FIG. 33 is a schematic exploded view of a third ball assembly.

As shown in FIG. 30 and FIG. 32 to FIG. 33, the third ball assembly 420*a* may include: a third outer sleeve 424*a*, a third middle sleeve 421*a*, third balls 423*a*, and a third inner sleeve 422*a*. The third middle sleeve 421*a* is provided with a plurality of third ball holes 4211*a*. The third balls 423*a* are mounted in the third ball holes 4211*a*, and the third balls 423*a* protrude beyond inner and outer circumferential surfaces of the third middle sleeve 421*a* in a radial direction of the third middle sleeve 421*a*. The third inner sleeve 422*a* is arranged on an inner side of the third middle sleeve 421*a*, and an outer circumferential surface of the third inner sleeve 422*a* is provided with a third inner sleeve ball groove 4221*a* configured to cooperate with the third balls 423*a*. An inner circumferential surface of the third outer sleeve 424*a* is provided with a third outer sleeve ball groove 4241*a* configured to cooperate with the third balls 423*a*, and the third balls 423*a* are configured to roll between the third outer sleeve ball groove 4241*a* and the third inner sleeve ball groove 4221*a*. Moreover, the third outer sleeve 424*a* is configured to be fixedly connected to the support connecting sleeve 412*a*, and the third inner sleeve 422*a* is configured to be fixedly connected to the first spray arm water intake shaft 240*a*. Therefore, the arrangement of the third ball assembly 420*a* can ensure the smooth rotation of the first spray arm 200*a* relative to the spray arm base 500.

In this case, the third ball assembly 420*a* is a complete member and can be supplied separately without changing the first spray arm water intake shaft 240*a* and the support connecting sleeve 412*a*, so that the assembly of the third ball assembly 420*a* with the first spray arm water intake shaft 240*a* and the support connecting sleeve 412*a* can be completed, which is conducive to reducing processing procedures of the spray arm assembly 1000. The third ball assembly 420*a* is an independent modular member, which is convenient to mount and remove and also reduces the processing cost of the first spray arm 200*a* or the connection support 410*a*.

The third outer sleeve ball groove 4241*a* and the third inner sleeve ball groove 4221*a* are both circumferential annular groves, which can thus ensure the smooth rotation of the first spray arm 200*a* in the whole circle. The third balls 423*a* are in rolling contact with the third outer sleeve ball groove 4241*a* and the third inner sleeve ball groove 4221*a*, with less friction force. In a specific embodiment, diameters of the third outer sleeve ball groove 4241*a* and the third inner sleeve ball groove 4221*a* may be equal to the diameter of the third balls 423*a*, or may be slightly larger than the diameter of the third balls 423*a*, to ensure that the third balls 423*a* well cooperate with the third outer sleeve ball groove 4241*a* and the third inner sleeve ball groove 4221*a*.

The first spray arm connecting sleeve 220*a* is coaxially arranged with the first spray arm water intake shaft 240*a*. Referring to FIG. 30 and FIG. 33, in a central axis direction of the first spray arm connecting sleeve 220*a*, positions of the third outer sleeve ball groove 4241*a*, the third inner sleeve ball groove 4221*a*, and the third ball holes 4211*a* correspond to each other, and the third balls 423*a* are partially arranged in the third ball holes 4211*a*. Outer sides of the third balls 423*a* are in contact with the third outer sleeve ball groove 4241*a*, and inner sides of the third balls 423*a* are in contact with the third inner sleeve ball groove 4221*a*, to complete the indirect connection between the third outer sleeve 424*a* and the third inner sleeve 422*a*. Moreover, the positions of the third outer sleeve ball groove 4241*a*, the third inner sleeve ball groove 4221*a*, and the third ball holes 4211*a* corresponding to each other can prevent impossible rotation of the first spray arm 200*a* caused by extrusion of the third balls 423*a* due to a sliding trajectory thereof being different from trajectories of the third outer sleeve ball groove 4241*a* and the third inner sleeve ball groove 4221*a* during rotation of the first spray arm 200*a* relative to the spray arm base 500.

In one embodiment, the third outer sleeve 424*a* may include: a third outer sleeve circumferential wall 4242*a* and a third outer sleeve top wall 4243*a*. The third outer sleeve top wall 4243*a* is arranged on one end of the third outer sleeve circumferential wall 4242*a* close to the first spray arm body 230*a*. As shown in FIG. 30 and FIG. 33, the third outer sleeve top wall 4243*a* is arranged on an upper end of the third outer sleeve circumferential wall 4242*a*, and the third outer sleeve top wall 4243*a* extends inwards along a radial direction of the third outer sleeve circumferential wall 4242*a*. That is, half of the cross section of the third outer sleeve 424*a* is in an inverted "L" shape. Moreover, an inner diameter of the third outer sleeve top wall 4243*a* is slightly larger than an outer diameter of the third inner sleeve 422*a*, to ensure that the third outer sleeve 424*a* has no contact with the third inner sleeve 422*a* when the third outer sleeve 424*a* rotates relative to the third inner sleeve 422*a*, and then ensure normal rotation of the first spray arm 200*a*. Besides, the third outer sleeve top wall 4243*a* is located above the third balls 423*a* and can shield the third balls 423*a*, which prevents residues in the dishwasher from entering the third ball assembly 420*a* to impede the normal operation of the third ball assembly 420*a* and can prevent the third balls 423*a* from slipping out of the third ball assembly 420*a*. The third outer sleeve ball groove 4241*a* is arranged on an inner circumferential surface of the third outer sleeve circumferential wall 4242*a* to ensure that the third balls 423*a* can roll along the third outer sleeve ball groove 4241*a*, to ensure reliable operation of the third ball assembly 420*a*.

In one embodiment, the third ball holes 4211*a* are disposed at the top of the third middle sleeve 421*a*, the third ball holes 4211*a* are major-arc holes, and third ball fetching ports 4212*a* are formed at top notches of the third ball holes 4211*a*. The third balls 423*a* enter the third ball holes 4211*a* or come out from the third ball holes 4211*a* through the third ball fetching ports 4212*a*, thus facilitating the mounting and removal of the third balls 423*a* in the third ball holes 4211*a*. The major-arc holes are holes with a center angle greater than 180° and less than 360°, so that most of each third ball 423*a* can be located in the third ball holes 4211*a*, to prevent the third balls 423*a* from falling off from the third ball holes 4211*a* after mounting. During the mounting of the third balls 423*a*, the third ball fetching ports 4212*a* can be opened with external force, then the third balls 423*a* are mounted in the third ball holes 4211*a* through the third ball fetching ports 4212*a*, the external force is removed, elastic deformation of the third ball holes 4211*a* disappears accordingly, and the third ball holes 4211*a* reconvert. In this case, the third ball holes 4211*a* tightly wrap the third balls 423*a*, making the mounting of the third balls 423*a* in the third ball holes 4211*a* firmer and more reliable.

Further, a third weakening groove 4213*a* is arranged between two adjacent third ball holes 4211*a*. With the arrangement of the third weakening groove 4213*a*, the stiffness between the two adjacent third ball holes 4211*a* can be reduced. Therefore, when the third balls 423*a* are mounted, the third ball holes 4211*a* are easy to deform, which reduces the difficulty of mounting or removing the third balls 423*a*.

The third weakening groove 4213*a* is provided with a third weakening groove post 4214*a*. In one embodiment, a central axis of the third weakening groove post 4214*a* is parallel to that of the third middle sleeve 421*a*, which is conducive to simplifying the processing technology of the third middle sleeve 421*a*. The arrangement of the third weakening groove post 4214*a* can play a strengthening role, to prevent the third weakening groove 4213*a* from excessively weakening the stiffness of the third middle sleeve 421*a*, which is conducive to improving the operation reliability of the third ball assembly 420*a*.

In some unillustrated embodiments, the third ball holes 4211*a* may be further arranged in middle positions of the third middle sleeve 421*a*. In this case, the third ball holes 4211*a* are round holes running through a wall thickness of the third middle sleeve 421*a*.

In one embodiment, the third balls 423*a* may be plastic third balls 423*a* or stainless steel third balls 423*a*. The operation environment of the spray arm assembly 1000 is full of water, the spray arm assembly 1000 is in a hot and wet environment for a long time, and the third balls 423*a* are prone to rust and stagnation; the plastic third balls 423*a* or stainless steel third balls 423*a* have strong corrosion resistance, which can effectively slow down or even avoid the rust of the third balls 423*a*.

In one embodiment, the third outer sleeve 424*a* is mounted inside the support connecting sleeve 412*a*, and an inner diameter of the support connecting sleeve 412*a* is equal to an outer diameter of the third outer sleeve 424*a*. In one embodiment, the support connecting sleeve 412*a* is in interference fit with the third outer sleeve 424*a*, to ensure that the third outer sleeve 424*a* can be firmly fixed in the support connecting sleeve 412*a* and then ensure that the connection between the third ball assembly 420*a* and the connection support 410*a* is reliable. Similarly, the third inner sleeve 422*a* is nested on the first spray arm water intake shaft 240*a*, and an outer diameter of the first spray arm water intake shaft 240*a* is equal to an inner diameter of the third inner sleeve 422*a*. In one embodiment, the first spray arm water intake shaft 240*a* is in interference fit with the third inner sleeve 422*a*, to ensure that the third inner sleeve 422*a* can be firmly fixed on the first spray arm water intake shaft 240*a* and then ensure that the connection between the third ball assembly 420*a* and the first spray arm 200*a* is reliable. Therefore, the respective connections of the third ball assembly 420*a* with the support body 411*a* and the first spray arm 200*a* can ensure a reliable connection between the support body 411*a* and the first spray arm 200*a*, and ensuring high reliability of the operation of the support body 411*a* and the first spray arm 200*a*. When the support connecting sleeve 412*a* moves relative to the first spray arm water intake shaft 240*a*, the third outer sleeve 424*a* and the third inner sleeve 422*a* move relative to each other. Also, since the third balls 423*a* are arranged between the third outer sleeve 424*a* and the third inner sleeve 422*a*, the friction force between the support connecting sleeve 412*a* and the first spray arm water intake shaft 240*a* is equivalent to rolling friction force, which is conducive to reducing the hydrodynamic loss and making more hydrodynamic force used for cleaning the tableware.

Figure 34:
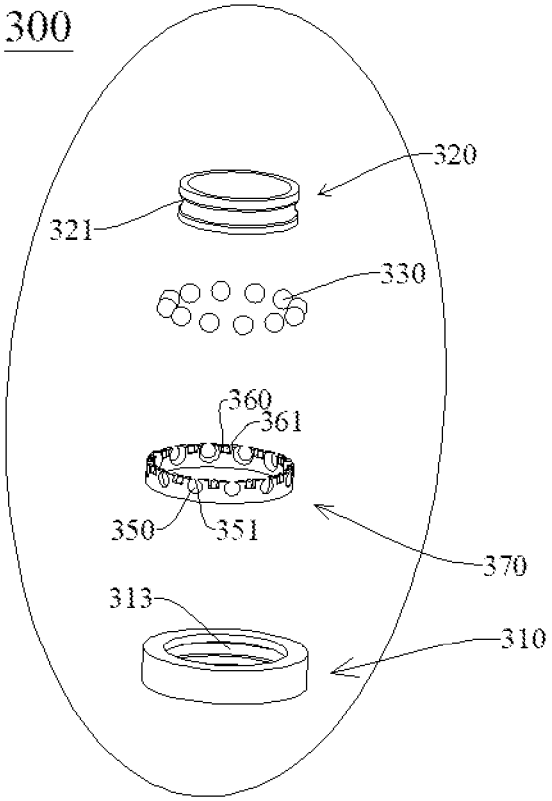
FIG. 34 is a schematic exploded view of the first ball assembly.

The first ball assembly 300 and the third ball assembly 420*a* are similar in structure. As shown in FIG. 30, FIG. 32, and FIG. 34, the first ball assembly 300 may include: a first outer sleeve 310, a first middle sleeve 370, first balls 330, and a first inner sleeve 320. The first middle sleeve 370 is provided with a plurality of first ball holes 350, the first balls 330 are mounted in the first ball holes 350, and the first balls 330 protrude beyond inner and outer circumferential sources of the first middle sleeve 370 in a radial direction of the first middle sleeve 370. The first inner sleeve 320 is arranged on an inner side of the first middle sleeve 370, and an outer circumferential surface of the first inner sleeve 320 is provided with a first inner sleeve ball groove 321 configured to cooperate with the first balls 330, an inner circumferential surface of the first outer sleeve 310 is provided with a first outer sleeve ball groove 313 configured to cooperate with the first balls 330, and the first balls 330 are configured to roll between the first outer sleeve ball groove 313 and the first inner sleeve ball groove 321. Moreover, the first outer sleeve 310 is configured to be fixedly connected to the second spray arm connecting sleeve 130*a*, and the first inner sleeve 320 is configured to be fixedly connected to the first spray arm connecting sleeve 220*a*. Therefore, the arrangement of the first ball assembly 300 can ensure the smooth rotation of the first spray arm 200*a* relative to the second spray arm 100*a*.

In this case, the first ball assembly 300 is a complete member and can be supplied separately without changing the second spray arm connecting sleeve 130*a* and the first spray arm upper connecting sleeve 220*a*, so that the assembly of the first ball assembly 300 with the second spray arm connecting sleeve 130*a* and the first spray arm upper connecting sleeve 220*a* can be completed, which is conducive to reducing processing procedures of the spray arm assembly 1000.

The first outer sleeve 310 and the first inner sleeve ball groove 321 are both circumferential annular groves, which can thus ensure the smooth rotation of the second spray arm 100*a* in the whole circle. The first balls 330 are in rolling contact with the first outer sleeve ball groove 313 and the first inner sleeve ball groove 321, with less friction force. In a specific embodiment, diameters of the first outer sleeve ball groove 313 and the first inner sleeve ball groove 321 may be equal to the diameter of the first balls 330, or may be slightly larger than the diameter of the first balls 330, to ensure that the first balls 330 well cooperate with the first outer sleeve ball groove 313 and the first inner sleeve ball groove 321.

The first spray arm connecting sleeve 220*a* is coaxially arranged with the second spray arm connecting sleeve 130*a*. Referring to FIG. 30, FIG. 32, and FIG. 34, in a central axis direction of the first spray arm connecting sleeve 220*a*, positions of the first outer sleeve ball groove 313, the first inner sleeve ball groove 321, and the first ball holes 350 correspond to each other, and the first balls 330 are partially arranged in the first ball holes 350. Outer sides of the first balls 330 are in contact with the first outer sleeve ball groove 313, and inner sides of the first balls 330 are in contact with the first inner sleeve ball groove 321, to complete an indirection connection between the first outer sleeve 310 and the first inner sleeve 320. Moreover, the positions of the first outer sleeve ball groove 313, the first inner sleeve ball groove 321, and the first ball holes 350 corresponding to each other can prevent impossible relative rotation of the first spray arm 200*a* and the second spray arm 100*a* caused by extrusion of the first balls 330 due to a sliding trajectory thereof being different from trajectories of the first outer sleeve ball groove 313 and the first inner sleeve ball groove 321 during rotation of the first spray arm 200*a* relative to the second spray arm 100*a*.

In one embodiment, the first outer sleeve 310 may include: a first outer sleeve circumferential wall 542 and a first outer sleeve top wall 543. The first outer sleeve top wall 543 is arranged on one end of the first outer sleeve circumferential wall 542 close to the second spray arm body 120*a*. As shown in FIG. 30 and FIG. 34, the first outer sleeve top wall 543 is arranged on an upper end of the first outer sleeve circumferential wall 542, and the first outer sleeve top wall 543 extends inwards along a radial direction of the first outer sleeve circumferential wall 542. That is, half of the cross section of the first outer sleeve 310 is in an inverted "L" shape. Moreover, an inner diameter of the first outer sleeve top wall 543 is slightly larger than an outer diameter of the first inner sleeve 320, to ensure that the first outer sleeve 310 has no contact with the first inner sleeve 320 when the first outer sleeve 310 rotates relative to first inner sleeve 320, and then ensure normal rotation of the first spray arm 200*a*. Besides, the first outer sleeve top wall 543 is located above the first balls 330 and can shield the first balls 330, which prevents residues in the dishwasher from entering the first ball assembly 300 to impede the normal operation of the first ball assembly 300 and can prevent the first balls 330 from slipping out of the third ball assembly 300. The first outer sleeve ball groove 313 is arranged on an inner circumferential surface of the first outer sleeve circumferential wall 542 to ensure that the first balls 330 can roll along the first outer sleeve ball groove 313, to ensure reliable operation of the first ball assembly 300.

In one embodiment, the first ball holes 350 are arranged at the top of the first middle sleeve 370, the first ball holes 350 are major-arc holes, and first ball fetching ports 351 are formed at top notches of the first ball holes 350. The first balls 330 enter the first ball holes 350 or come out from the first ball holes 350 through the first ball fetching ports 351, thus facilitating the mounting and removal of the first balls 330 in the first ball holes 350. The major-arc holes are holes with a center angle greater than 180° and less than 360°, so that most of each first ball 330 can be located in the first ball holes 350, to prevent the first balls 330 from falling off from the first ball holes 350 after mounting. During the mounting of the first balls 330, the first ball fetching ports 351 can be opened with external force, then the first balls 330 are mounted in the first ball holes 350 through the first ball fetching ports 351, the external force is removed, elastic deformation of the first ball holes 350 disappears accordingly, and the first ball holes 350 reconvert. In this case, the first ball holes 350 tightly wrap the first balls 330, making the mounting of the first balls 330 in the first ball holes 350 firmer and more reliable.

Further, a first weakening groove 360 is arranged between two adjacent first ball holes 350. With the arrangement of the first weakening groove 360, the stiffness between the two adjacent first ball holes 350 can be reduced. Therefore, when the first balls 330 are mounted, the first ball holes 350 are easy to deform, which reduces the difficulty of mounting or removing the first balls 330.

The first weakening groove 360 is provided with a first weakening groove post 361. In one embodiment, a central axis of the first weakening groove post 361 is parallel to that of the first middle sleeve 370, which is conducive to simplifying the processing technology of the first middle sleeve 370. The arrangement of the first weakening groove post 361 can play a strengthening role, to prevent the first weakening groove 360 from excessively weakening the stiffness of the first middle sleeve 370, which is conducive to improving the operation reliability of the first ball assembly 300.

In some unillustrated embodiments, the first ball holes 350 may be further arranged in middle positions of the first middle sleeve 370. In this case, the first ball holes 350 are round holes running through a wall thickness of the first middle sleeve 370.

In one embodiment, the first balls 330 may be plastic first balls 330 or stainless steel first balls 330. The operation environment of the spray arm assembly 1000 is full of water, the spray arm assembly 1000 is in a hot and wet environment for a long time, and the first balls 330 are prone to rust and stagnation; the plastic first balls 330 or stainless steel first balls 330 have strong corrosion resistance, which can effectively slow down or even avoid the rust of the first balls 330.

In one embodiment, the first outer sleeve 310 is mounted inside the second spray arm connecting sleeve 130*a*, and an inner diameter of the second spray arm connecting sleeve 130*a* is equal to an outer diameter of the first outer sleeve 310. In one embodiment, the second spray arm connecting sleeve 130*a* is in interference fit with the first outer sleeve 310, to ensure that the first outer sleeve 310 can be firmly fixed in the second spray arm connecting sleeve 130*a* and then can ensure that the connection between the first ball assembly 300 and the second spray arm 100*a* is reliable. Similarly, the first inner sleeve 320 is nested on the first spray arm connecting sleeve 220*a*, and an outer diameter of the first spray arm connecting sleeve 220*a* is equal to an inner diameter of the first inner sleeve 320. In one embodiment, the first spray arm connecting sleeve 220*a* is in interference fit with the first inner sleeve 320, to ensure that the first inner sleeve 320 can be firmly fixed on the first spray arm connecting sleeve 220*a* and then ensure that the connection between the first ball assembly 300 and the first spray arm 200*a* is reliable. Therefore, the respective connections of the first ball assembly 300 with the second spray arm 100*a* and the first spray arm 200*a* can ensure a reliable connection between the second spray arm 100*a* and the first spray arm 200*a*, and ensuring high reliability of the operation of the second spray arm 100*a* and the first spray arm 200*a*. When the second spray arm connecting sleeve 130*a* moves relative to the first spray arm connecting sleeve 220*a*, the first outer sleeve 310 and the first inner sleeve 320 move relative to each other. Also, since the first balls 330 are arranged between the first outer sleeve 310 and the first inner sleeve 320, the friction force between the second spray arm connecting sleeve 130*a* and the first spray arm connecting sleeve 220*a* is equivalent to rolling friction force, which is conducive to reducing the hydrodynamic loss and making more hydrodynamic force used for cleaning the tableware.

In one embodiment, a length of the second spray arm body 120*a* is 0.5 to 2 times that of the first spray arm body 230*a*. That is, the length of the second spray arm body 120*a* may be greater than or equal to that of the first spray arm body 230*a* or less than that of the first spray arm body 230*a*.

In some embodiments, the length of the second spray arm body 120*a* is 0.5 to 1 times that of the first spray arm body 230*a* (the length of the first spray arm body 230*a* is greater than or equal to that of the second spray arm body 120*a*). The second spray arm body 120*a* is shorter, which can reduce the weight of the second spray arm 100*a*, to ensure smooth rotation of the second spray arm 100*a*, and the structure of the whole spray arm assembly 1000 is more stable and is not easy to overturn. In addition, the length of the second spray arm body 120*a* being less than that of the first spray arm body 230*a* can make the volume in the second spray arm body 120*a* less than that in the first spray arm body 230*a*. In the cleaning stage, most of the water flow enters the first spray arm body 230*a* in priority. The water pressure in the first spray arm body 230*a* is higher, which can ensure that the pressure of the water column sprayed from the first spray arm 200*a* is higher, and the first spray arm 200*a* can rotate smoothly. By setting the length of the second spray arm body 120*a* to be shorter, the volume of the second spray arm body 120*a* can be reduced, to ensure that there is also enough high water pressure in the second spray arm body 120*a* and then ensure that the pressure of the water column sprayed from the second spray arm 100*a* is large, to ensure that the second spray arm 100*a* can rotate smoothly.

In some other embodiments, the length of the second spray arm body 120*a* is 1 to 2 times that of the first spray arm body 230*a* (the length of the first spray arm body 230*a* is less than or equal to that of the second spray arm body 120*a*). When the length of the second spray arm body 120*a* is greater than that of the first spray arm body 230*a*, the moment arm length of the second spray arm body 120*a* can be increased, so that the second spray arm body 120*a* can be driven to rotate only with less driving force. In addition, a longer second spray arm body 120*a* indicates a larger washing area.

In one embodiment, the length of the second spray arm body 120*a* may be equal to that of the first spray arm body 230*a*. In this case, greater water pressure can be ensured in the first spray arm body 230*a* and the second spray arm body 120*a*, to ensure that the first spray arm 200*a* and the second spray arm 100*a* can rotate smoothly. Moreover, the length of the first spray arm body 230*a* and the second spray arm body 120*a* is a maximum size that can be accommodated inside the dishwasher, which is conducive to improving the cleaning capability of the spray arm assembly 1000.

It needs to be noted that the ratio of the lengths of the shortest spray arm body to the longest spray arm body should not be less than 0.5, because a too short spray arm body may require greater driving force, and the aperture of the drive holes is larger and the number of the drive holes is larger. The amount of water sprayed from the drive hole to the tableware is less than that from the spray hole, which is not conducive to cleaning, so the spray arm body should not be too short. Therefore, it is more reasonable to set the minimum ratio of the lengths of the shortest spray arm body to the longest spray arm body to 0.5.

In one embodiment, an inner diameter of the water intake shaft 330*a* of the spray arm base 500 is equal to that of the first spray arm water intake shaft 240*a*, to ensure that the water source enters from the water intake shaft 330*a* into the first spray arm water intake shaft 240*a* at a stable speed, which can prevent unstable operation of the spray arm assembly 1000 caused by a sudden change in the water velocity, is conducive to improving the utilization of the hydrodynamic force and reducing the energy loss, and then can ensure reliable operation of the spray arm assembly 1000.

In some unillustrated embodiments, the connection support 410*a* and the spray arm base 500 may be an integrally formed member. In this case, the connection support 410*a* and the spray arm base 500 are non-detachable.

Based on the embodiments of FIG. 30 and FIG. 32 to FIG. 35, the third ball assembly 420*a* and the first ball assembly 300 in the present application may be transformed in a variety of manners, all of which fall within the protection scope of the present application.

The following is an overview of a variety of transformed examples of the third ball assembly 420*a* according to the embodiment of the present application with reference to FIG. 30, FIG. 32 to FIG. 33, and FIG. 35.

In one embodiment, in a first unillustrated embodiment, the third ball assembly 420*a* may include only third balls 423*a*, in which the third middle sleeve 421*a*, the third inner sleeve 422*a*, and the third outer sleeve 424*a* are absent compared with the embodiment of FIG. 30. The third balls 423*a* are used to directly cooperate with the first spray arm water intake shaft 240*a* and the support connecting sleeve 412*a*, which can also achieve the rolling connection between the first spray arm water intake shaft 240*a* and the support connecting sleeve 412*a*. In this case, an outer circumferential surface of the first spray arm water intake shaft 240*a* is provided with a first spray arm ball groove configured to cooperate with the third balls 423*a*, and an inner circumferential surface of the support connecting sleeve 412*a* is provided with a support ball groove configured to cooperate with the third balls 423*a*.

In one embodiment, in a second unillustrated embodiment, the third ball assembly 420*a* may include only third balls 423*a* and a third inner sleeve 422*a*, in which the third middle sleeve 421*a* and the third outer sleeve 424*a* are absent compared with the embodiment of FIG. 30. The third balls 423*a* are used to directly cooperate with the third inner sleeve 422*a* and the support connecting sleeve 412*a*, which can also achieve the rolling connection between the first spray arm water intake shaft 240*a* and the support connecting sleeve 412*a*. In this case, an inner circumferential surface of the support connecting sleeve 412*a* is provided with a support ball groove configured to cooperate with the third balls 423*a*.

In one embodiment, in a third unillustrated embodiment, the third ball assembly 420*a* may include only third balls 423*a* and a third outer sleeve 424*a*, in which the third middle sleeve 421*a* and the third inner sleeve 422*a* are absent compared with the embodiment of FIG. 30. The third balls 423*a* are used to directly cooperate with the first spray arm water intake shaft 240*a* and the third outer sleeve 424*a*, which can also achieve the rolling connection between the first spray arm water intake shaft 240*a* and the support connecting sleeve 412*a*. In this case, an outer circumferential surface of the first spray arm water intake shaft 240*a* is provided with a first spray arm ball groove configured to cooperate with the third balls 423*a*.

In one embodiment, in a fourth unillustrated embodiment, the third ball assembly 420*a* may include only third balls 423*a*, a third inner sleeve 422*a*, and a third outer sleeve 424*a*, in which the third middle sleeve 421*a* is absent compared with the embodiment of FIG. 30. The third balls 423*a* are used to directly cooperate with the third inner sleeve 422*a* and the third outer sleeve 424*a*, which can also achieve the rolling connection between the first spray arm water intake shaft 240*a* and the support connecting sleeve 412*a*.

In one embodiment, in a fifth unillustrated embodiment, the third ball assembly 420*a* may include only third balls 423*a* and a third middle sleeve 421*a*, in which the third inner sleeve 422*a* and the third outer sleeve 424*a* are absent compared with the embodiment of FIG. 30. The third balls 423*a* are used to directly cooperate with the first spray arm water intake shaft 240*a* and the support connecting sleeve 412*a*, which can also achieve the rolling connection between the first spray arm water intake shaft 240*a* and the support connecting sleeve 412*a*. In this case, an outer circumferential surface of the first spray arm water intake shaft 240*a* is provided with a first spray arm ball groove configured to cooperate with the third balls 423*a*, and an inner circumferential surface of the support connecting sleeve 412*a* is provided with a support ball groove configured to cooperate with the third balls 423*a*.

In one embodiment, in a sixth unillustrated embodiment, the third ball assembly 420*a* may include only third balls 423*a*, a third inner sleeve 422*a*, and a third middle sleeve 421*a*, in which the third outer sleeve 424*a* is absent compared with the embodiment of FIG. 30. The third balls 423*a* are used to directly cooperate with the third inner sleeve 422*a* and the support connecting sleeve 412*a*, which can also achieve the rolling connection between the first spray arm water intake shaft 240*a* and the support connecting sleeve 412*a*. In this case, an inner circumferential surface of the support connecting sleeve 412*a* is provided with a support ball groove configured to cooperate with the third balls 423*a*.

In one embodiment, in a seventh unillustrated embodiment, the third ball assembly 420*a* may include only third balls 423*a*, a third outer sleeve 424*a*, and a third middle sleeve 421*a*, in which the third inner sleeve 422*a* is absent compared with the embodiment of FIG. 30. The third balls 423*a* are used to directly cooperate with the first spray arm water intake shaft 240*a* and the third outer sleeve 424*a*, which can also achieve the rolling connection between the first spray arm water intake shaft 240*a* and the support connecting sleeve 412*a*. In this case, an outer circumferential surface of the first spray arm water intake shaft 240*a* is provided with a first spray arm ball groove configured to cooperate with the third balls 423*a*.

The situation where the first spray arm water intake shaft 240*a* is fitted over an outer side of the support connecting sleeve 412*a* is similar to the above seven embodiments. In this case, an outer side of the third ball assembly 420*a* cooperates with the first spray arm water intake shaft 240*a*, and an inner side of the third ball assembly 420*a* cooperates with the support connecting sleeve 412, which is not repeated herein.

The following is an overview of a variety of transformed examples of the first ball assembly 300 according to the embodiment of the present application with reference to FIG. 30, FIG. 32, and FIG. 34 to FIG. 35.

In one embodiment, in a first unillustrated embodiment, the first ball assembly 300 may include only first balls 330, in which the first middle sleeve 370, the first inner sleeve 320, and the first outer sleeve 310 are absent compared with the embodiment of FIG. 30. The first balls 330 are used to directly cooperate with the first spray arm connecting sleeve 220*a* and the second spray arm connecting sleeve 130*a*, which can also achieve the rolling connection between the first spray arm connecting sleeve 220*a* and the second spray arm connecting sleeve 130*a*. In this case, an outer circumferential surface of the first spray arm connecting sleeve 220*a* is provided with a first spray arm second ball groove configured to cooperate with the first balls 330, and an inner circumferential surface of the second spray arm connecting sleeve 130*a* is provided with a second spray arm ball groove configured to cooperate with the first balls 330.

In one embodiment, in a second unillustrated embodiment, the first ball assembly 300 may include only first balls 330 and a first inner sleeve 320, in which the first middle sleeve 370 and the first outer sleeve 310 are absent compared with the embodiment of FIG. 30. The first balls 330 are used to directly cooperate with the first inner sleeve 320 and the second spray arm connecting sleeve 130*a*, which can also achieve the rolling connection between the first spray arm connecting sleeve 220*a* and the second spray arm connecting sleeve 130*a*. In this case, an inner circumferential surface of the second spray arm connecting sleeve 130*a* is provided with a second spray arm ball groove configured to cooperate with the first balls 330.

In one embodiment, in a third unillustrated embodiment, the first ball assembly 300 may include only first balls 330 and a first outer sleeve 310, in which the first middle sleeve 370 and the first inner sleeve 320 are absent compared with the embodiment of FIG. 30. The first balls 330 are used to directly cooperate with the first spray arm connecting sleeve 220*a* and the second spray arm connecting sleeve 130*a*, which can also achieve the rolling connection between the first spray arm connecting sleeve 220*a* and the second spray arm connecting sleeve 130*a*. In this case, an outer circumferential surface of the first spray arm connecting sleeve 220*a* is provided with a first spray arm second ball groove configured to cooperate with the first balls 330.

In one embodiment, in a fourth unillustrated embodiment, the first ball assembly 300 may include only first balls 330, a first inner sleeve 320, and a first outer sleeve 310, in which the first middle sleeve 370 is absent compared with the embodiment of FIG. 30. The first balls 330 are used to directly cooperate with the first inner sleeve 320 and the first outer sleeve 310, which can also achieve the rolling connection between the first spray arm connecting sleeve 220*a* and the second spray arm connecting sleeve 130*a*.

In one embodiment, in a fifth unillustrated embodiment, the first ball assembly 300 may include only first balls 330 and a first middle sleeve 370, in which the first inner sleeve 320 and the first outer sleeve 310 are absent compared with the embodiment of FIG. 30. The first balls 330 are used to directly cooperate with the first spray arm connecting sleeve 220*a* and the second spray arm connecting sleeve 130*a*, which can also achieve the rolling connection between the first spray arm connecting sleeve 220*a* and the second spray arm connecting sleeve 130*a*. In this case, an outer circumferential surface of the first spray arm connecting sleeve 220*a* is provided with a first spray arm second ball groove configured to cooperate with the first balls 330, and an inner circumferential surface of the second spray arm connecting sleeve 130*a* is provided with a second spray arm ball groove configured to cooperate with the first balls 330.

In one embodiment, in a sixth unillustrated embodiment, the first ball assembly 300 may include only first balls 330, a first inner sleeve 320, and a first middle sleeve 370, in which the first outer sleeve 310 is absent compared with the embodiment of FIG. 30. The first balls 330 are used to directly cooperate with the first inner sleeve 320 and the second spray arm connecting sleeve 130*a*, which can also achieve the rolling connection between the first spray arm connecting sleeve 220*a* and the second spray arm connecting sleeve 130*a*. In this case, an inner circumferential surface of the second spray arm connecting sleeve 130*a* is provided with a second spray arm ball groove configured to cooperate with the first balls 330.

In one embodiment, in a seventh unillustrated embodiment, the first ball assembly 300 may include only first balls 330, a first outer sleeve 310, and a first middle sleeve 370, in which the first inner sleeve 320 is absent compared with the embodiment of FIG. 30. The first balls 330 are used to directly cooperate with the first spray arm connecting sleeve 220*a* and the second spray arm connecting sleeve 130*a*, which can also achieve the rolling connection between the first spray arm connecting sleeve 220*a* and the second spray arm connecting sleeve 130*a*. In this case, an outer circumferential surface of the first spray arm connecting sleeve 220*a* is provided with a first spray arm second ball groove configured to cooperate with the first balls 330.

The situation where the first spray arm connecting sleeve 220*a* is fitted over an outer side of the second spray arm connecting sleeve 130*a* is similar to the above seven embodiments. In this case, an outer side of the first ball assembly 300 cooperates with the first spray arm connecting sleeve 220*a*, and an inner side of the third ball assembly 420*a* cooperates with the second spray arm connecting sleeve 130*a*, which is not repeated herein.

The first middle sleeve 370 and the third middle sleeve 421*a* mainly have following three functions: (1) each middle sleeve is provided with ball holes, and the balls are mounted in the ball holes, so that positions of the balls can be fixed and limited to prevent the accumulation of the balls; (2) they play a role of isolating food residue, to prevent the food residue from entering the ball groove to cause friction; and (3) they play a strengthening role and can isolate the vibration between the first spray arm 200*a* and the second spray arm 100*a* to prevent serious shaking of the spray arm.

A washing appliance according to an embodiment in another aspect of the present application includes the spray arm assembly 1000 described above. The washing appliance may be a dishwasher or a washing appliance with a washing function such as a fruit and vegetable cleaning machine or a medical cleaning machine, and the effects thereof are similar to the effect of the arrangement of the spray arm assembly 1000 in the dishwasher, which are not repeated one by one herein.

In the description of the present specification, reference throughout this specification to "an embodiment," "some embodiments," "example," "specific example" or "some examples" means that a particular feature, structure, material, or characteristic described in connection with the embodiment or example is included in at least one embodiment or example of the present application. In the present specification, the schematic expressions to the above-mentioned terms are not necessarily referring to the same embodiment or example. Furthermore, the described particular features, structures, materials, or characteristics may be combined in any suitable manner in one or more embodiments or examples. In addition, combinations of different embodiments or examples described in the specification may be presented.

What is claimed is:

1. A spray arm assembly, comprising:

an upper spray arm and a lower spray arm, the upper spray arm being connected to the lower spray arm and being located above the lower spray arm; and a first ball assembly arranged at a position where the upper spray arm is connected to and cooperates with the lower spray arm, and the upper spray arm is rotatable relative to the lower spray arm;

wherein the upper spray arm comprises an upper spray arm body and an upper spray arm connecting sleeve, the upper spray arm connecting sleeve is arranged on a lower side of the upper spray arm body, the lower spray arm comprises a lower spray arm upper connecting sleeve and a lower spray arm body, the lower spray arm upper connecting sleeve is arranged on an upper side of the lower spray arm body, and the first ball assembly is arranged at a position where the upper spray arm connecting sleeve is connected to and cooperates with the lower spray arm upper connecting sleeve;

wherein the first ball assembly comprises at least a plurality of balls, and the plurality of balls are arranged between the lower spray arm upper connecting sleeve and the upper spray arm connecting sleeve;

wherein the first ball assembly further comprises: a bearing base, and the balls are fitted between the lower spray arm upper connecting sleeve and the upper spray arm connecting sleeve through the bearing base.

2. The spray arm assembly according to claim 1, wherein the bearing base comprises:

an inner sleeve configured to cooperate with one of the lower spray arm upper connecting sleeve and the upper spray arm connecting sleeve;

a middle sleeve fitted over the inner sleeve, the middle sleeve being provided with a plurality of ball holes, the balls being mounted in the ball holes, and the balls protruding from inner and outer circumferential surfaces of the middle sleeve in a radial direction of the middle sleeve; and an outer sleeve fitted over the middle sleeve, the outer sleeve being configured to cooperate with the other one of the lower spray arm upper connecting sleeve and the upper spray arm connecting sleeve.

3. The spray arm assembly according to claim 2, wherein the inner sleeve is integrated with one of the lower spray arm upper connecting sleeve and the upper spray arm connecting sleeve, so that the inner sleeve constitutes a part of the one; and/or the outer sleeve is integrated with the other one of the lower spray arm upper connecting sleeve and the upper spray arm connecting sleeve, so that the outer sleeve constitutes a part of the other one.

4. The spray arm assembly according to claim 2, wherein the upper spray arm connecting sleeve is fitted over an outer side of the lower spray arm upper connecting sleeve, the inner sleeve cooperates with the lower spray arm upper connecting sleeve, and the outer sleeve cooperates with the upper spray arm connecting sleeve or the outer sleeve is integrated with the upper spray arm connecting sleeve, so that the outer sleeve constitutes a part of the upper spray arm connecting sleeve.

5. The spray arm assembly according to claim 4, wherein the lower spray arm upper connecting sleeve and the inner sleeve are detachably connected, wherein the top of the lower spray arm upper connecting sleeve is provided with a buckle, and the buckle is configured to clamp an upper surface of the inner sleeve, or wherein the lower spray arm upper connecting sleeve has lower spray arm external threads, the inner sleeve has inner sleeve internal threads, and the inner sleeve internal threads are configured to be screwed with and fixed to the lower spray arm external threads.

6. The spray arm assembly according to claim 2, wherein a plurality of balls are arranged above a middle sleeve, and ball holes are major-arc holes and are formed with ball fetching ports are formed at top notches, wherein a weakening groove is arranged between two adjacent ball holes.

7. The spray arm assembly according to claim 1, wherein the bearing base comprises:

an inner sleeve configured to cooperate with one of the lower spray arm upper connecting sleeve and the upper spray arm connecting sleeve; and an outer sleeve fitted over the inner sleeve, the outer sleeve being configured to cooperate with the other one of the lower spray arm upper connecting sleeve and the upper spray arm connecting sleeve.

8. The spray arm assembly according to claim 1, wherein a length of the upper spray arm body is 0.5 to 2 times a length of the lower spray arm body.

9. A spray arm assembly, comprising:

a spray arm comprising an upper spray arm and a lower spray arm, the upper spray arm being connected to the lower spray arm and being located above the lower spray arm;

a first ball assembly arranged at a position where the upper spray arm is connected to and cooperates with the lower spray arm, and the upper spray arm is rotatable relative to the lower spray arm;

a spray arm base, wherein the spray arm is connected to the spray arm base, and the spray arm is rotatable relative to the spray arm base; and a second ball assembly arranged at a position where the spray arm is connected to and cooperates with the spray arm base.

10. The spray arm assembly according to claim 9, wherein the lower spray arm comprises: a lower spray arm upper connecting sleeve and a lower spray arm body, the lower spray arm upper connecting sleeve is arranged on an upper side of the lower spray arm body, the upper spray arm comprises: an upper spray arm body and an upper spray arm connecting sleeve, the upper spray arm connecting sleeve is arranged on a lower side of the upper spray arm body, and the first ball assembly is arranged at a position where the upper spray arm connecting sleeve is connected to and cooperates with the lower spray arm upper connecting sleeve.

11. The spray arm assembly according to claim 10, wherein both the first ball assembly and the second ball assembly comprise at least a plurality of balls, the plurality of balls of the first ball assembly are arranged at the position where the upper spray arm connecting sleeve is connected to and cooperates with the lower spray arm upper connecting sleeve, and the plurality of balls of the second ball assembly are arranged at the position where the lower spray arm is connected to and cooperates with the spray arm base.

12. The spray arm assembly according to claim 11, wherein both the first ball assembly and the second ball assembly further comprise: a middle sleeve, the middle sleeve is provided with a plurality of ball holes, the balls are mounted in the ball holes, and the balls protrude beyond inner and outer circumferential surfaces of the middle sleeve in a radial direction of the middle sleeve.

13. The spray arm assembly according to claim 11, wherein both the first ball assembly and the second ball assembly further comprise: an inner sleeve, the inner sleeve is arranged on inner sides of the balls, and an outer circumferential surface of the inner sleeve is provided with an inner sleeve ball groove configured to cooperate with the balls.

14. The spray arm assembly according to claim 13, wherein both the first ball assembly and the second ball assembly further comprise: an outer sleeve, the outer sleeve is arranged on outer sides of the balls, and an inner circumferential surface of the outer sleeve is provided with an outer sleeve ball groove configured to cooperate with the balls.

15. The spray arm assembly according to claim 14, wherein the upper spray arm connecting sleeve is in interference fit with the outer sleeve of the first ball assembly; or the outer sleeve of the first ball assembly has outer sleeve threads, the upper spray arm connecting sleeve has upper spray arm threads, and the upper spray arm threads are screwed with the outer sleeve threads.

16. The spray arm assembly according to claim 15, wherein an inner sleeve of a second ball assembly has inner sleeve threads, the spray arm base has spray arm base threads, and the spray arm base threads are screwed with the inner sleeve threads, or wherein the spray arm base is in interference fit with the inner sleeve of the second ball assembly.

17. The spray arm assembly according to claim 14, wherein the lower spray arm lower connecting sleeve is in interference fit with the outer sleeve of the second ball assembly; or the outer sleeve of the second ball assembly has outer sleeve threads, the lower spray arm lower connecting sleeve has lower spray arm lower threads, and the lower spray arm lower threads are screwed with the outer sleeve threads.

18. The spray arm assembly according to claim 13, wherein the lower spray arm and the upper spray arm are detachably connected, wherein the top of the lower spray arm upper connecting sleeve has a lower spray arm buckle, and the lower spray arm buckle is configured to clamp an upper surface of the inner sleeve of the first ball assembly.

19. The spray arm assembly according to claim 18, wherein the inner sleeve of the first ball assembly has inner sleeve threads, the lower spray arm upper connecting sleeve has lower spray arm upper threads, and the lower spray arm upper threads are screwed with the inner sleeve threads, or wherein the lower spray arm upper connecting sleeve is in interference fit with the inner sleeve of the first ball assembly.

20. The spray arm assembly according to claim 11, wherein both the first ball assembly and the second ball assembly further comprise: an outer sleeve, the outer sleeve is arranged on outer sides of the balls, and an inner circumferential surface of the outer sleeve is provided with an outer sleeve ball groove configured to cooperate with the balls.

21. A spray arm assembly comprises:

an upper spray arm and a lower spray arm, the upper spray arm being connected to the lower spray arm and being located above the lower spray arm;

a first ball assembly arranged at a position where the upper spray arm is connected to and cooperates with the lower spray arm, and the upper spray arm is rotatable relative to the lower spray arm;

wherein the lower spray arm is a first spray arm, and the first spray arm comprises: a first spray arm body and a first spray arm water intake shaft;

the spray arm assembly further comprises: a spray arm base, the first spray arm water intake shaft is arranged on one side of the first spray arm body toward the spray arm base, and the first spray arm is rotatable relative to the spray arm base; and a connector comprising: a connection support and a third ball assembly, the first spray arm water intake shaft is arranged through the connection support, and the third ball assembly is arranged at a position where the connection support is connected to and cooperates with the first spray arm water intake shaft.

22. The spray arm assembly according to claim 21, wherein the connection support comprises: a support body, a surface of the support body toward the first spray arm body is provided with a support connecting sleeve, and the third ball assembly is arranged between the support connecting sleeve and the first spray arm water intake shaft.

23. The spray arm assembly according to claim 22, wherein the support connecting sleeve is fitted over an outer side of the first spray arm water intake shaft, the third ball assembly comprises at least a plurality of third balls, and the plurality of third balls are arranged between the support connecting sleeve and the first spray arm water intake shaft.

24. The spray arm assembly according to claim 23, wherein the third ball assembly further comprises: a third middle sleeve, the third middle sleeve is provided with a plurality of third ball holes, the third balls are mounted in the third ball holes, and the third balls protrude beyond inner and outer circumferential surfaces of the third middle sleeve in a radial direction of the third middle sleeve.

25. The spray arm assembly according to claim 23, wherein the third ball assembly further comprises: a third inner sleeve, the third inner sleeve being arranged on inner sides of the third balls, and an inner circumferential surface of the third inner sleeve being configured to cooperate with the first spray arm water intake shaft, and an outer circumferential surface of the third inner sleeve being provided with a third inner sleeve ball groove configured to cooperate with the third balls; and/or a third outer sleeve arranged on outer sides of the third balls, an outer circumferential surface of the third outer sleeve being configured to cooperate with the support connecting sleeve, and an inner circumferential surface of the third outer sleeve being provided with a third outer sleeve ball groove configured to cooperate with the third balls.

26. The spray arm assembly according to claim 21, wherein the upper spray arm is a second spray arm, the second spray arm is connected to the first spray arm and the second spray arm is rotatable relative to the first spray arm, the second spray arm is arranged on one side of the first spray arm away from the spray arm base, and the first ball assembly is arranged at a position where the first spray arm is connected to and cooperates with the second spray arm, wherein the first spray arm further comprises: a first spray arm connecting sleeve arranged on a surface of the first spray arm body toward the second spray arm; and the second spray arm comprises: a second spray arm body and a second spray arm connecting sleeve, the second spray arm connecting sleeve being arranged on a surface of the second spray arm body toward the first spray arm body, and the first ball assembly being arranged between the first spray arm connecting sleeve and the second spray arm connecting sleeve.

27. The spray arm assembly according to claim 26, wherein the second spray arm connecting sleeve is fitted over an outer side of the first spray arm connecting sleeve, the first ball assembly comprises at least a plurality of first balls, and the plurality of first balls are arranged between the first spray arm connecting sleeve and the second spray arm connecting sleeve.

28. The spray arm assembly according to claim 27, wherein the first ball assembly further comprises: a first middle sleeve, the first middle sleeve is provided with a plurality of first ball holes, the first balls are mounted in the first ball holes, and the first balls protrude beyond inner and outer circumferential surfaces of the first middle sleeve in a radial direction of the first middle sleeve.

29. The spray arm assembly according to claim 27, wherein the first ball assembly further comprise: a first inner sleeve, the first inner sleeve being arranged on inner sides of the first balls, and an inner circumferential surface of the first inner sleeve being configured to cooperate with the first spray arm connecting sleeve, and an outer circumferential surface of the first inner sleeve being provided with a first inner sleeve ball groove configured to cooperate with third balls; and/or a first outer sleeve arranged on outer sides of the first balls, an outer circumferential surface of the first outer sleeve being configured to cooperate with the second spray arm connecting sleeve, and an inner circumferential surface of the first outer sleeve being provided with a first outer sleeve ball groove configured to cooperate with the first balls.

30. A washing appliance, comprising:

a spray arm assembly, comprising:

an upper spray arm and a lower spray arm, the upper spray arm being connected to the lower spray arm and being located above the lower spray arm; and a first ball assembly arranged at a position where the upper spray arm is connected to and cooperates with the lower spray arm, and the upper spray arm is rotatable relative to the lower spray arm;

wherein the upper spray arm comprises an upper spray arm body and an upper spray arm connecting sleeve, the upper spray arm connecting sleeve is arranged on a lower side of the upper spray arm body, the lower spray arm comprises a lower spray arm upper connecting sleeve and a lower spray arm body, the lower spray arm upper connecting sleeve is arranged on an upper side of the lower spray arm body, and the first ball assembly is arranged at a position where the upper spray arm connecting sleeve is connected to and cooperates with the lower spray arm upper connecting sleeve;

wherein the first ball assembly comprises at least a plurality of balls, and the plurality of balls are arranged between the lower spray arm upper connecting sleeve and the upper spray arm connecting sleeve;

wherein the first ball assembly further comprises: a bearing base, and the balls are fitted between the lower spray arm upper connecting sleeve and the upper spray arm connecting sleeve through the bearing base.

* * * * *